US011815331B2

(12) United States Patent
Freeman et al.

(10) Patent No.: US 11,815,331 B2
(45) Date of Patent: Nov. 14, 2023

(54) BACK-UP SIGHTS WITH COMPACT APERTURE, CENTERING SIGHT POST, AND MINIATURIZED WINDAGE DETENT MECHANISM

(71) Applicant: Magpul Industries Corp., Austin, TX (US)

(72) Inventors: Zachary Freeman, Broomfield, CO (US); Eric Nakayama, Broomfield, CO (US); Timothy Eric Roberts, Broomfield, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 17/802,245

(22) PCT Filed: Aug. 25, 2021

(86) PCT No.: PCT/US2021/047522
§ 371 (c)(1),
(2) Date: Aug. 25, 2022

(87) PCT Pub. No.: WO2022/060543
PCT Pub. Date: Mar. 24, 2022

(65) Prior Publication Data

US 2023/0272996 A1 Aug. 31, 2023

Related U.S. Application Data

(60) Provisional application No. 63/070,357, filed on Aug. 26, 2020.

(51) Int. Cl.

| | |
|---|---|
| ***F41G 1/033*** | (2006.01) |
| ***F41G 1/18*** | (2006.01) |
| ***F41G 1/08*** | (2006.01) |

(52) U.S. Cl.
CPC ..... *F41G 1/033* (2013.01); *F41G 1/08* (2013.01); *F41G 1/18* (2013.01)

(58) Field of Classification Search
CPC ..... F41G 1/00–545
See application file for complete search history.

(56) References Cited

U.S. PATENT DOCUMENTS

| | | | |
|---|---|---|---|
| 4,200,989 A | 5/1980 | Brouthers | |
| 5,533,292 A | 7/1996 | Swan | |

(Continued)

FOREIGN PATENT DOCUMENTS

| | | | |
|---|---|---|---|
| CN | 104567544 A | 4/2015 | |
| DE | 202014010600 U1 * | 3/2016 | ..... F41G 1/033 |

(Continued)

OTHER PUBLICATIONS

International Search Report and Written Opinion received for PCT Application Serial No. PCT/US21/47522 dated May 6, 2022, 20 pages.

(Continued)

*Primary Examiner* — Gabriel J. Klein
(74) *Attorney, Agent, or Firm* — Neugeboren O'Dowd PC

(57) ABSTRACT

A sighting system for a firearm and related methods are disclosed. The sighting system has front and rear flip-up sights, wherein the front sight comprises a flip-up portion having an aperture through which a sight post can partially extend; a knob comprising one or more notches on a first side and the sight post extending from a second side; at least one detent arranged to face and interact with the one or more notches. The knob is configured to rotate about a first axis, where the rotation causes the sight post to move in a first direction along the first axis; tilting of the knob in a second direction based on the detent interfacing with the notches; and tilting of the sight post in the second direction, thereby (Continued)

forcing at least a portion of the sight post to press against the aperture, or a combination thereof.

18 Claims, 36 Drawing Sheets

(56) References Cited

U.S. PATENT DOCUMENTS

| | | | | |
|---|---|---|---|---|
| 5,966,825 | A * | 10/1999 | Biemont | F41G 1/545 42/136 |
| 6,418,657 | B1 | 7/2002 | Brown | |
| 6,481,146 | B2 | 11/2002 | Carrier, III | |
| 6,779,290 | B1 | 8/2004 | Houtsma | |
| 7,076,907 | B2 | 7/2006 | Nesseth et al. | |
| 7,356,962 | B2 | 4/2008 | Swan | |
| 7,814,698 | B2 | 10/2010 | Fluhr et al. | |
| 7,921,591 | B1 | 4/2011 | Adcock | |
| 8,015,744 | B1 | 9/2011 | Swan | |
| 8,069,607 | B2 | 12/2011 | Ballard | |
| 8,196,333 | B2 | 6/2012 | Hopkins et al. | |
| 8,375,619 | B2 * | 2/2013 | Hewes | F41G 1/033 42/136 |
| 8,484,882 | B2 | 7/2013 | Haley et al. | |
| 8,621,775 | B2 | 1/2014 | Troy | |
| 9,062,931 | B2 | 6/2015 | Troy et al. | |
| 9,261,330 | B2 | 2/2016 | Troy | |
| 9,322,615 | B2 | 4/2016 | Raybman | |
| 9,448,035 | B2 * | 9/2016 | Wilson | F41G 1/04 |
| 9,683,811 | B1 | 6/2017 | Warensford | |
| 9,733,045 | B1 | 8/2017 | Bozek | |
| 9,733,046 | B1 | 8/2017 | Bozek | |
| 9,835,411 | B2 | 12/2017 | Larson, Jr. et al. | |
| 9,976,834 | B1 | 5/2018 | Cheng et al. | |
| 10,030,935 | B1 * | 7/2018 | Ding | F41G 1/17 |
| 10,119,784 | B1 | 11/2018 | Ding et al. | |
| 10,222,179 | B2 | 3/2019 | Smith et al. | |
| 10,317,171 | B2 | 6/2019 | Odle et al. | |
| 10,330,437 | B2 | 6/2019 | Kung et al. | |
| 10,337,837 | B2 | 7/2019 | Keller et al. | |
| 10,605,565 | B1 | 3/2020 | Geissele et al. | |
| 2008/0276520 | A1 | 11/2008 | Ballard | |
| 2011/0308132 | A1 * | 12/2011 | Hewes | F41G 1/28 42/135 |
| 2015/0198414 | A1 * | 7/2015 | Raybman | F41G 1/17 42/111 |
| 2016/0209166 | A1 * | 7/2016 | Larson, Jr. | F41A 35/06 |
| 2018/0245880 | A1 | 8/2018 | Campbell | |
| 2019/0017784 | A1 * | 1/2019 | Smith | F41G 1/17 |

FOREIGN PATENT DOCUMENTS

| | | | | |
|---|---|---|---|---|
| FR | 2822228 | A1 * | 9/2002 | F41G 1/18 |
| TW | I583915 | B | 5/2017 | |

OTHER PUBLICATIONS

"M16A2 Rifle Sights", Wikipedia, 29 pages, Online available at <https://en.wikipedia.org/wiki/M16_rifle> and retrieved on: Oct. 17, 2022.

"A.R.M.S.® #40™ Stand Alone Flip-Up Sight" ARMS, 3 pages, Online available at <https://armsmounts.com/shop/iron-sights/a-r-m-s-40-stand-alone-flip-up-rear-sight/> and retrieved on: Oct. 17, 2022.

"A.R.M.S.® #40™L Low Profile Rear Sight NSN 1005-01-575-3508", ARMS, 3 pages, Online available at <https://armsmounts.com/shop/iron-sights/a-r-m-s-401-low-profile-rear-sight/> and retrieved on: Oct. 17, 2022.

"A.R.M.S.® #71L-R Rear Sight", ARMS, 3 pages, Online available at <https://armsmounts.com/shop/iron-sights/a-r-m-s-71l-r-rear-sight/> and retrieved on: Oct. 17, 2022.

"MBUS® Sight—Rear", Magpul, 8 pages, Online available at <https://magpul.com/firearm-accessories/mbus-sight-rear.html> and retrieved on: Oct. 17, 2022.

"MBUS Pro® Sight—Rear", Magpul, 7 pages, Online available at <https://magpul.com/catalog/product/view/id/6259/s/mbus-pro-sight-rear/category/61> and retrieved on: Oct. 17, 2022.

"Flip up Rear Sight", Mission First Tactical, 2 pages, Online available at <https://www.missionfirsttactical.com/BUPSWR> and retrieved on: Oct. 17, 2022.

"Troy Di-Optic Aperture Front & Rear Sight COMBO", Larue Tactical, 1 page, Online available at <https://www.larue.com/products/troy-di-optic-aperture-front-rear-sight-combo/> and retrieved on: Oct. 19, 2022.

"UTG® AR15 Low Profile Flip-up Rear Sight with Dual Aiming Aperture", Leapers, Inc., 1 page, Online available at <https://www.leapers.com/index.php?act=prod_detail&itemno=MNT-955> and retrieved on: Oct. 17, 2022.

"UTG® Accu-Sync® Spring-loaded AR15 Flip-up Rear Sight, Black", Leapers, Inc., 1 page, Online available at <https://www.leapers.com/index.php?act=prod_detail&itemno=MNT-957> and retrieved on: Oct. 17, 2022.

"Trinity Force AR-15 Polymer Flip-Up Sight Set—OPF56", AR15Discounts, 2 pages, Online available at <https://ar15discounts.com/products/trinity-force-ar-15-polymer-flip-up-sight-set/>, and retrieved on: Oct. 19, 2022.

"AR-556® Low Profile Flip-Up Rear Sight", ShopRuger, Everything and Anything Ruger and Marlin, 2 pages, Online available at <https://shopruger.com/AR-556-Low-Profile-Flip-Up-Rear-Sight/productinfo/18141/> and retrieved on: Oct. 17, 2022.

"Ruger® Rapid Deploy Rear Sight", ShopRuger, Everything and Anything Ruger and Marlin, 4 pages, Online available at <https://shopruger.com/Ruger-Rapid-Deploy-Rear-Sight/productinfo/90415/> and retrieved on: Oct. 17, 2022.

"F.A.B. RBS Rear Back-Up Sight", F.A.B. Defense, 1 page, Online available at <https://www.fab-defense.com/en/category-parts-and-upgrades/id-1426/rear-back-up-sight.html> and retrieved on: Oct. 17, 2022.

"LWRCI Skirmish Back Up Iron Sights (BUIS) Set", High Performance Firearms, 3 pages, Online available at <https://www.lwrci.com/LWRCI-Skirmish-Back-Up-Iron-Sights-BUIS-Set_p_30.html> and retrieved on: Oct. 17, 2022.

"Diamondhead Polymer Diamond Integrated Sighting System Front/Rear Sights AR-15 1498", Optics Planet, 1 page, Online available at <https://www.opticsplanet.com/diamondhead-polymer-diamond-integrated-sighting-system-front-rear-sights-ar-15-m.html> and retrieved on: Oct. 19, 2022.

"Mckrbus | Rear Flip Back up Sight", CAA, 2 pages, Online available at <https://caagearup.com/product/frs-rear-flip-up-sight/> and retrieved on: Oct. 17, 2022.

"C4 Rear Sight", Ultradyne American Ingenuity, 2 pages, Online available at <https://ultradyneusa.com/product/c4-folding-rear-sight/> and retrieved on: Oct. 17, 2022.

"Multiple Aperture Device with Locking Mechanical Detent NSN 1005-01-527-6333", GG&G, 2 pages, Online available at <https://www.gggaz.com/mad-back-up-iron-sight.html> and retrieved on: Oct. 17, 2022.

"Spikes Tactical Gen II Micro Rear Sight", Spikes Tactical, 4 pages, Online available at <https://www.spikestactical.com/collections/sights/spikes-tactical-gen-ii-micro-rear-sight/> and retrieved on: Oct. 17, 2022.

"Folding Micro Front Sight PN:25654", Knights Armament, 4 pages, Online available at <https://www.knightarmco.com/12657/shop/sighting/micro-flip-up-front-sight> and retrieved on: Oct. 17, 2022.

"F.A.B. FBS Front Back-Up Sight", F.A.B. Defense, 1 page, Online available at <https://www.fab-defense.com/en/category-parts-and-upgrades/id-1425/front-back-up-sight.html> and retrieved on: Oct. 17, 2022.

"Mckfbus | Front Flip Back Up Sight", CAA, 1 page, Online available at <https://caagearup.com/product/ffs-front-flip-up-sight/> and retrieved on: Oct. 17, 2022.

"PEAK/01 World's finest fixed iron sights", ScalarWorks, 13 pages, Online available at <https://scalarworks.com/shop/iron-sights/peak-01/> and retrieved on: Oct. 17, 2022.

(56) References Cited

OTHER PUBLICATIONS

"Tuor Multi-Axis and Ambidextrous BUIS", The Firearm Blog, 7 pages, Online available at <https://www.thefirearmblog.com/blog/2015/01/20/tuor-multi-axis-ambidextrous-buis/> and retrieved on: Oct. 17, 2022.
Office Action received for Taiwan Patent Application Serial No. 111148952 dated Feb. 21, 2023, 8 pages.

* cited by examiner

BACK-UP SIGHTS WITH COMPACT APERTURE, CENTERING SIGHT POST, AND MINIATURIZED WINDAGE DETENT MECHANISM

CLAIM OF PRIORITY UNDER 35 U.S.C. § 119

The present Application for Patent claims priority to Provisional Application No. 63/070,357 entitled "BACK-UP SIGHTS WITH COMPACT APERTURE, CENTERING SIGHT POST, AND MINIATURIZED WINDAGE DETENT MECHANISM" filed Aug. 26, 2020, and assigned to the assignee hereof and hereby expressly incorporated by reference herein.

FIELD OF THE DISCLOSURE

The present disclosure relates generally to back-up sights. In particular, but not by way of limitation, the present disclosure relates to systems, methods and apparatuses for providing a more stable and accurate sight post on the front sight, a more compact aperture on the rear sight, and a more compact windage detent on the rear sight.

DESCRIPTION OF RELATED ART

Misalignment of Front Sight Post

Typical front sight posts are threaded directly in an arm or a housing in which they reside. Further, elevation adjustment of the sight post usually requires some sort of tool (screwdriver, bullet tip, specific adjustment tool, etc.). In some instances, sight posts also feature a spring-loaded detent for locking the post into position to prevent it from shifting. Ideally, sight posts should remain stable and not shift in any direction. In existing systems, however, the tolerance between the sight post and the arm or housing typically resides within the thread fitment between the sight post and the arm (or housing). In some cases, this tolerance is insufficient, causing the sight post to move out of alignment due to movement of the firearm, vibrations, etc.

Rear Aperture Misalignment Between Large and Small Apertures

Military rear peep sights typically feature multiple apertures. For instance, a small aperture hole may be used for precision and a larger aperture hole may be used during low-to-intermediate lighting conditions or to improve speed at close range. Traditionally, rear sights on weapons like the M16 have an L-shaped aperture housing (or "aperture") that is flipped 90° to select between the two aperture holes. Since the aperture is threadedly attached to the windage screw (which remains fixed during aperture selection), this aperture rotation causes the aperture to shift a small distance laterally along the threading (i.e., along a horizontal axis passing through the windage screw). To compensate for this lateral shift, the two aperture holes are often laterally offset from each other to maintain a consistent aiming point. In some circumstances, this lateral shift issue is exacerbated by apertures that rotate between 150° and 180°, rather than the traditional 90°, resulting in even greater lateral shift between the apertures. Some of these sights also appear to use a canted design, so the offset is incorporated without introducing a jog between the upper and lower aperture holes. In such cases, both apertures and the surrounding material are in view of the user. Since sight function and aesthetics are highly related, this kind of offset (i.e., by tilting, jogging, and/or locating the aperture off-center) may be visually distracting to the user and may encourage misalignment or canting of the firearm.

To reduce the stowed size of the older L-shaped aperture system in folding backup sights (e.g., 90° rotation between small and large apertures), nesting apertures (e.g., A.R.M.S. #40L) were developed. In nested apertures, only the small aperture rotates, and when the small aperture is in use, the user looks through both apertures concentrically. One issue with these nested apertures is that some users prefer to have the sight deploy with the large aperture first (i.e., greater speed/visibility at the cost of precision) and then allow the small aperture to be selectable. While nested designs can be used this way, the small aperture is susceptible to damage when stowed flipped-down.

Windage Detent

Detent mechanisms often employ a separate spring and a detent (e.g., ball bearing or a detent plunger) to interface with multiple detent pockets or grooves to create defined positions and a tactile/audible feedback of such positions. In some circumstances, rear pop-up sights using such spring and detent mechanisms for the windage knobs are bulky.

Thus, there is a need for a refined sighting system for both front and rear sights that is not only aesthetically pleasing and easy to use, but also compact in terms of size and/or the number of parts used.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the disclosure may be characterized as sighting system for a firearm, comprising: a front sight and a rear sight. In some embodiments, the front sight further comprises: a first base; a first flip-up portion, wherein the first flip-up portion comprises two front arms and a horizontal connector connecting the two front arms, wherein the horizontal connector includes an aperture; a knob comprising one or more notches on a first side of the knob; a sight post extending from a second side of the knob, wherein the sight post is shaped and sized to extend at least partially through the aperture; at least one detent and one or more protrusions, the at least one detent and one or more protrusions arranged to face the one or more notches, and wherein the one or more notches are shaped and sized to interact with one or more of the at least one detent and the one or more protrusions. In some embodiments, the knob is configured to rotate about a first axis, wherein the rotation causes one or more of: the sight post to move in a first direction along the first axis; tilting of the knob in a second direction, the tilting based at least in part on one or more of the at least one detent and the one or more protrusions interfacing with the one or more notches; and tilting of the sight post in the second direction, wherein the tilting of the sight post in the second direction forces at least a portion of the sight post to press against the aperture.

Other embodiments of the disclosure may also be characterized as a flip-up aiming sight for use with a firearm, the flip-up aiming sight positioned near a distal end of the firearm, the flip-up aiming sight comprising: a base for attachment to the firearm; a first arm and a second arm, the first arm and the second arm positioned on opposite sides of a longitudinal plane through the firearm; a horizontal connector for connecting the first arm and the second arm, wherein the horizontal connector includes a first aperture, the first aperture having a plurality of angled faces; a second aperture, the second aperture formed by the first arm, the second arm, and the horizontal connector; and a knob positioned within the second aperture. In some embodiments, the knob comprises one or more notches on a first side of the knob and a sight post extending from a second side of the knob. In some cases, at least a portion of the sight post extends through the first aperture. In some embodiments, the second aperture comprises at least one detent and one or more protrusions, the at least one detent and one or more protrusions shaped and sized to interact with the one or more notches when the knob is rotated. In some cases, the knob is rotationally arranged within the second aperture and is configured to rotate about a first vertical axis, wherein the rotation causes one or more of: tilting of the knob based at least in part on the at least one detent interfacing with one of the one or more notches; and tilting of the sight post in a direction along the longitudinal axis through the firearm, wherein the tilting of the sight post forces the sight post to press against one or more angled faces of the first aperture.

Still other embodiments of the disclosure can be characterized as a flip-up aiming sight for use with a firearm, the flip-up aiming sight positioned near a proximal end of the firearm, the flip-up aiming sight comprising: a base for attachment to the firearm; a first arm and a second arm, the first arm and the second arm positioned on opposite sides of a longitudinal plane through the firearm; a first opening positioned between the first arm and the second arm; and an aperture mechanism positioned in the first opening. In some embodiments, the aperture mechanism comprises: a first end having a first aperture and a second end having a second aperture, wherein the first aperture is larger than the second aperture. In some embodiments, a first vertical axis passes through a center of the first aperture. In some embodiments, the first vertical axis also passes through a center of the second aperture. In some embodiments, the flip-up aiming sight further comprises a windage screw, the windage screw passing through the first arm and the second arm; and a windage knob coupled to the windage screw, the windage knob arranged on an outside face of one of the first arm or the second arm. In some embodiments, the windage knob is configured to rotate about a horizontal axis passing through the windage screw. In some embodiments, the aperture mechanism is configured to flip or rotate 180 degrees about the horizontal axis when the windage knob is rotated.

In some embodiments of the sighting system and/or the flip-up aiming sight, each of the sight post and the aperture comprise a plurality of angled faces. In some embodiments, the tilting of the sight post in the second direction forces one or more angled faces of the sight post to press against one or more angled faces of the aperture. In some embodiments, the aperture is a diamond-shaped aperture.

In some embodiments of the sighting system, the first flip-up portion further comprises a first opening and a second opening, wherein the first and the second openings are arranged between the two arms and separated by the horizontal connector. In some embodiments, the elevation knob is rotationally arranged within the first opening. In some embodiments, the sight post extends at partially through the aperture into the second opening.

In some embodiments of the sighting system, the at least one detent is arranged below the knob and near a front or a rear of the first opening. In some embodiments, the tilting of the knob and the sight post in the second direction comprises tilting forward when the at least one detent is arranged near the rear of the first opening, or tilting rearward when the at least one detent is arranged near a front of the first opening, wherein the forward or rearward tilting is based at least in part on the at least one detent pushing up on the knob.

In some embodiments, the one or more notches comprises at least two notches arranged around an outer circumference of the knob, and wherein adjacent notches of the at least two notches are separated by a non-notched portion, wherein the non-notched portions of the knob are shaped and sized to pass over, and press against, the at least one detent when the knob is rotated.

In some embodiments, the aperture is a diamond-shaped aperture comprising four corners and one or more circular cutouts, one circular cutout per corner.

In some embodiments, the sight post comprises a diamond-shaped cross section. In some embodiments, the aperture comprises four angled faces. In some embodiments, the tilting of the sight post comprises applying a bias to the sight post, wherein the bias is arranged to split two of the four angled faces of the aperture and wedge or force the sight post to a centered position relative to a plane comprising a barrel axis and parallel to the barrel axis of the firearm.

In some embodiments of the sighting system, the first axis passes through one or more of a center of the knob and a center of the sight post, and wherein a second axis passes through a center of the diamond-shaped aperture. In some embodiments of the sighting system, the first axis and the second axis tilt with respect to each other based at least in part on the tilting of the sight post, the tilting of the knob, or a combination thereof.

In some embodiments of the sighting system, the rear sight further comprises a second base and a second flip-up portion, the second flip-up portion further comprising: two rear arms; a third opening positioned between the two rear arms; and an aperture mechanism, wherein the aperture mechanism comprises a first end having a first rear aperture and a second end having a second rear aperture, wherein the first rear aperture is of a different size than the second rear aperture, and wherein the first aperture and the second aperture are aligned along a first vertical axis.

In some embodiments of the sighting system, the rear sight further comprises a windage screw, the windage screw passing through each of the two rear arms of the second flip-up portion; and a windage knob coupled to the windage screw, wherein the windage knob is arranged on an outside face of one of the two rear arms of the second flip-up portion. In some embodiments, the aperture mechanism is configured to flip around the windage screw when the windage knob is rotated.

In some embodiments, the sighting system further comprises a first tab and a second tab. In some embodiments, the aperture mechanism is slidably coupled to the windage screw via at least one of the first tab and the second tab. In some embodiments, the sighting system further comprises a third tab positioned between the first tab and the second tab, wherein the third tab is a threaded tab configured to move laterally along the windage screw when one or more of the windage knob and the windage screw rotate.

In some embodiments, rotation of the windage knob further causes one or more of the third tab to push against an inside edge of one of the first tab and the second tab; and lateral movement of the aperture mechanism with the third tab.

In some embodiments, the rear sight comprises a second base and a second flip-up portion, the second flip-up portion further comprising: two rear arms; a third opening positioned between the two rear arms; and an aperture mechanism, wherein the aperture mechanism comprises a first end having a first rear aperture and a second end having a second rear aperture, wherein the first rear aperture is of a different size than the second rear aperture, and wherein a first vertical axis passes through a center of the first aperture and a second vertical axis passes through a center of the second aperture, and wherein the first vertical axis is different from the second vertical axis.

In some embodiments of the flip-up aiming sight (e.g., positioned near the distal end of the firearm), the first vertical axis passes through one or more of a center of the knob and a center of the sight post, and a second vertical axis passes through a center of the first aperture, wherein the first vertical axis and the second vertical axis tilt with respect to each other based at least in part on the tilting of the sight post, the tilting of the knob, or a combination thereof.

In some embodiments of the flip-up aiming sight (e.g., positioned near the proximal end of the firearm), the flip-up aiming sight further comprises a first tab; a second tab; and a third tab positioned between the first tab and the second tab, wherein the third tab is configured to move laterally along the windage screw when one or more of the windage screw and the windage knob rotate. In some embodiments, rotation of the windage knob further causes one or more of: the third tab to push against an inside edge of one of the first tab and the second tab; and lateral movement of the aperture mechanism with the third tab.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

Figure 1:
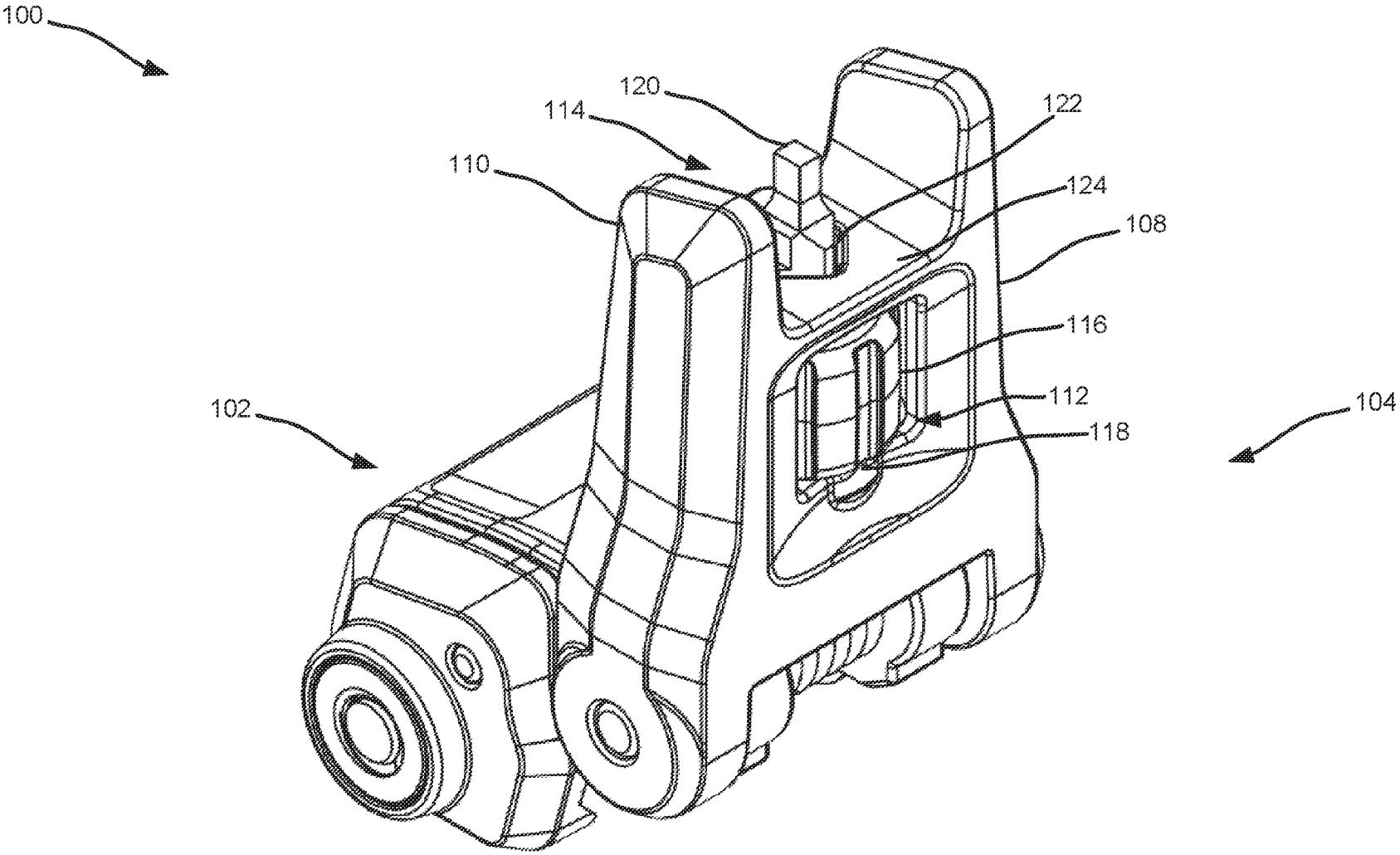
FIG. 1 is a perspective view of a front sight of a sighting system in a deployed position, according to an embodiment of the disclosure.

The word "exemplary" is used herein to mean "serving as an example, instance, or illustration." Any embodiment described herein as "exemplary" is not necessarily to be construed as preferred or advantageous over other embodiments. In the following detailed description, references are made to the accompanying drawings that form a part hereof, and in which are shown by way of illustrations or specific examples. These aspects may be combined, other aspects may be utilized, and structural changes may be made without departing from the present disclosure. Example aspects may be practiced as methods, systems, or apparatuses. The following detailed description is therefore not to be taken in a limiting sense, and the scope of the present disclosure is defined by the appended claims and their equivalents.

For the purposes of this disclosure, and when referencing a direction of intended fire, the terms "front" and "distal" shall refer to a side or direction associated with a direction of intended fire, while the terms "back", "rear", or "proximal" shall be associated with the intended bracing of the firearm. For instance, the front sight (e.g., described in relation to FIG. 1) may be installed near a distal end of a firearm, while the rear sight (e.g., described in relation to FIG. 18) may be installed near a proximal end of a firearm. For the purposes of this disclosure, the terms "elevation knob" and "knob" may be used interchangeably and may be used to refer to a rotationally arranged knob (e.g., knob 116) in the front sight. Additionally, the terms "front sight", "front flip-up sight", "front aiming sight", "flip-up aiming sight", and "front sighting system" may be used interchangeably throughout this Application. Similarly, the terms "rear sight", "rear flip-up sight", "rear aiming sight", and "flip-up aiming sight", and "rear sighting system" may be used interchangeably throughout this Application.

Centering of Front Sight Post

As previously indicated, given the tolerance issues in the art, there is a need for greater stability in the front sight post, even where detents in the elevation knob (or simply, knob) are used to provide tactile feedback to the user. To ensure the front sight post remains centered, this disclosure provides a diamond-shaped aperture for the front sight post and a single detent, rather than the two detents seen in some prior art designs, to provide tactile feedback to the user when the elevation knob is rotated. In some circumstances, the single detent may be arranged at one of a front or rear of the elevation knob and may cause the elevation knob to tilt in an opposite direction to the direction of the detent. For instance, if the detent is arranged at or near a rear of the elevation knob, it may cause the elevation knob to tilt forward (pitch down). Similarly, if the detent is arranged at or near a front of the elevation knob, it may cause the elevation knob to tilt rearward (pitch up). In some circumstances, this tilt of the elevation knob may also cause the front sight post to tilt (e.g., forward, rearward), thus pushing the angled faces of the front sight post against angled faces of the diamond-shaped aperture and wedging the front sight post into a centered and stable position, thereby taking up any thread tolerance between the knob and the front sight post. It should be noted that, other types of apertures (e.g., triangle-shaped aperture, pentagon-shaped aperture, rhombus-shaped aperture etc.) besides diamond-shaped apertures are contemplated in different embodiments.

FIG. 1 illustrates an example of a front flip-up sight 100 of a sighting system, according to an embodiment of the disclosure. In this example, the front flip-up sight 100 is in a deployed position. In some embodiments, the front flip-up sight 100 may be configured to be attached near a distal end of a firearm (not shown), for instance, on an accessory mount rail (e.g., Picatinny Rail). As seen, the front flip-up sight 100 includes a base 102 and a flip-up portion 104. In some examples, the flip-up portion 104 includes two arms (e.g., first arm 108, second arm 110), a horizontal connector 124 connecting the two arms, a first opening 112 between the arms 108, 110 and a second opening 114 between the arms 108, 110. As illustrated, the horizontal connector 124 arranged between the arms 108, 118 separates the two openings 112, 114. Although not necessary, in some cases, the two openings 112, 114 may be rectangular openings.

In some embodiments, the front flip-up sight 100 comprises an elevation knob 116 rotationally arranged within the first opening 112. Further, a sight post 120 may be threadedly engaged with a threaded aperture at or near a center of the elevation knob 116. In the example shown, the sight post 120 extends from a top of the elevation knob 116, passes through a diamond-shaped aperture 122 in the horizontal connector 124, and extends at least partially into the second opening 114. In some embodiments, the sight post 120 may have a diamond-shaped cross section when viewed from above that can match, but be slightly smaller, than the diamond-shaped aperture 122, further described in relation to FIG. 6. For instance, the cross-sectional area of the sight post 120 may be slightly smaller than the cross-sectional area of the diamond-shaped aperture, which may enable the sight post 120 to extend at least partially through the diamond-shaped aperture into the second opening 114. In some embodiments, the sight post 120 may move vertically (e.g., up or down) along a vertical axis passing through one or more of the sight post 120 and the elevation knob 116 when the elevation knob 116 is rotated. In some instances, the elevation knob 116 may be configured to rotate around a vertical, or substantially vertical axis, that also passes through a center of the sight post 120.

To provide tactile feedback to the user and help hold the sight post 120 at a selected elevation, the elevation knob 116 may include a detent 118 arranged at or near a bottom of the first opening 112 and toward a front/distal or back/proximal end of the flip-up portion 104. In some embodiments, the elevation knob 116 may further comprise a plurality of notches 119, where the notches 119 may be arranged near a bottom of the elevation knob 116. In some cases, the plurality of notches 119 may be periodically spaced around an outer circumference or bottom edge of the elevation knob 116 and may be shaped to interact with the detent 118 (e.g., if the detent 118 has a triangular shape, then the notches 119 may also have a triangular shape; if the detent 118 has a semicircular shape, then the notches 119 may also have a semicircular shape). In some cases, adjacent notches of the plurality of notches 119 may be separated by a non-notched portion (e.g., shown as non-notched portion 128 in FIG. 15). In some cases, the non-notched portions at or near the bottom of the elevation knob 116 may be shaped and sized to pass over the detent 118 with minimal or no interaction with the detent. For instance, when the elevation knob 116 is rotated, non-notched portions of the bottom of the elevation knob 116 may pass over the detent 118. Furthermore, the notches 119 and the detent 118 may be shaped and sized such that even when a notch 119 and the detent 118 fit snugly together, the detent 118 may still push up slightly on the elevation knob 116.

In some non-limiting examples, the opening 112 comprises a single detent 118. In such cases, the interface or interaction between the detent 118 and the circumference of the elevation knob 116 may cause the elevation knob 116 to tilt away from the detent 118. In some embodiments, this can be a tilt forward when the detent 118 is arranged at or near a rear of the first opening 112, and a tilt rearward when the detent 118 is arranged at or near a front of the first rectangular opening 112. Since the sight post 120 is tightly engaged with the elevation knob 116, tilting of the knob 116 may also cause a corresponding tilt of the sight post 120. Whatever slop, or gap between edges of the sight post 120 and sides of the diamond-shaped aperture 122 exists, as well as any slop between threads of the sight post 120 and the elevation knob 116, may be taken up by this tilting, which forces one or more angled faces of the sight post 120 to press against one or more angled faces of the diamond-shaped aperture 122. For instance, if the sight post 120 tilts in the front/distal direction, the front angled faces of the sight post 120 may press up against the front angled faces of the diamond-shaped aperture. Similarly, if the sight post tilts in the rear/proximal direction, the rear angled faces of the sight post 120 may be forced against the rear angled faces of the diamond-shaped aperture 122.

Figure 6:
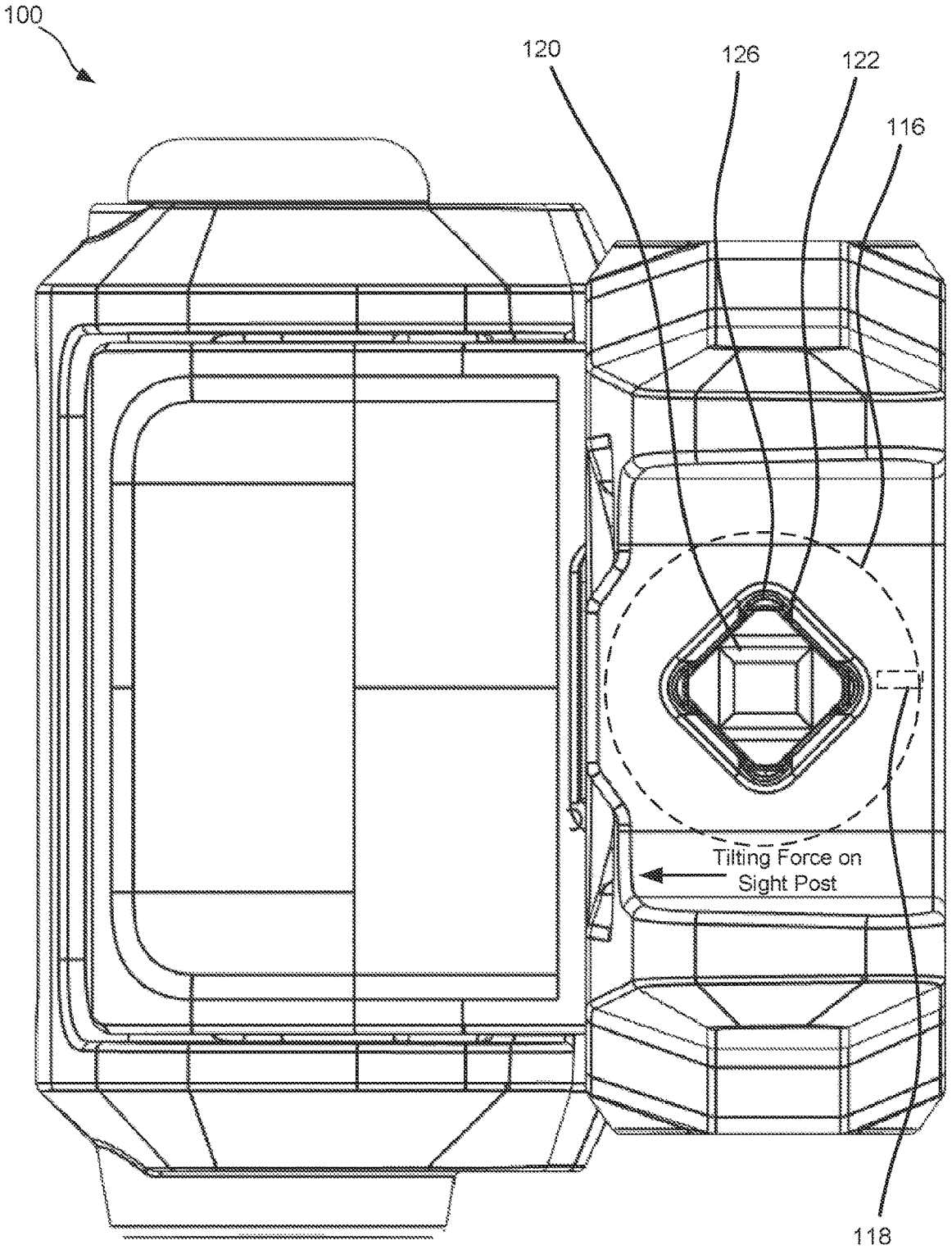
FIG. 6 is a top view of the front sight in FIG. 1, according to an embodiment of the disclosure.

FIG. 6 illustrates a top or overhead view of the front flip-up sight 100 to provide an alternate view of the tilting of the front sight post, in accordance with one or more implementations. In some cases, the front flip-up sight 100 may be similar or substantially similar to the front flip-up sight previously described in relation to FIG. 1. As seen, the front flip-up sight 100 comprises a sight post 120, a detent 118, a diamond-shaped aperture 122, an elevation knob 116, and one or more optional cutouts 126 in the diamond-shaped aperture 122. While manufacturers of this embodiment may attempt to minimize gaps between outer edges of the sight post 120 and inner faces of the diamond-shaped aperture 122, in practice, some gap will often exist, and this allows some level of horizontal movement (and misalignment) of the sight post 120. According to aspects of this disclosure, the detent 118 may be arranged toward a front/distal end or rear/proximal end of the elevation knob 116, which may serve to minimize the ability of the sight post 120 to move off center. In the example shown, the use of a single detent 118 near the rear/proximal end of the elevation knob causes the elevation knob 116 to tilt forward (or to the left) in the figure, which correspondingly causes the sight post 120 to tilt in the same direction. The tilting of the front sight post 120 may push or force one or more angled faces (e.g., two of the front angled faces, two of the rear angled faces) of the sight post 120 against one or more angled faces (e.g., two front angled faces, two rear angled faces) of the diamond-shaped aperture 122, thus minimizing or removing any slop or gap between the front sight post 120 and the diamond-shaped aperture 122. At the same time, by using a diamond-shaped aperture and/or by applying a bias that is arranged to split two of these angled faces (e.g., aligned between front and rear corners of the diamond-shaped aperture 122), the sight post 120 may be wedged or forced to a centered position relative to a barrel axis or longitudinal axis through the firearm. Said another way, the sight post 120 may be wedged or forced so that a plane passing through (e.g., perpendicular to) an axis passing through a center of the sight post 120 may be parallel or substantially parallel to a plane through the longitudinal (or barrel) axis of the firearm.

In some embodiments, the diamond-shaped aperture 122 may include one or more circular cutouts 126 at its corners. For instance, the front flip-up sight 100 illustrates a circular cutout 126 at each of the four corners of the diamond-shaped aperture 122. In some circumstances, these cutouts 126 may help reduce friction between the sight post 120 and the diamond-shaped aperture 122, for instance, when the sight post 120 is raised or lowered by rotating the elevation knob 116. In some aspects, these cutouts 126 may also help minimize the effects or influence that corners of the diamond-shaped aperture 122 have on the centering of the sight post 120, which could run contrary to the purpose of the disclosure.

Figure 15:
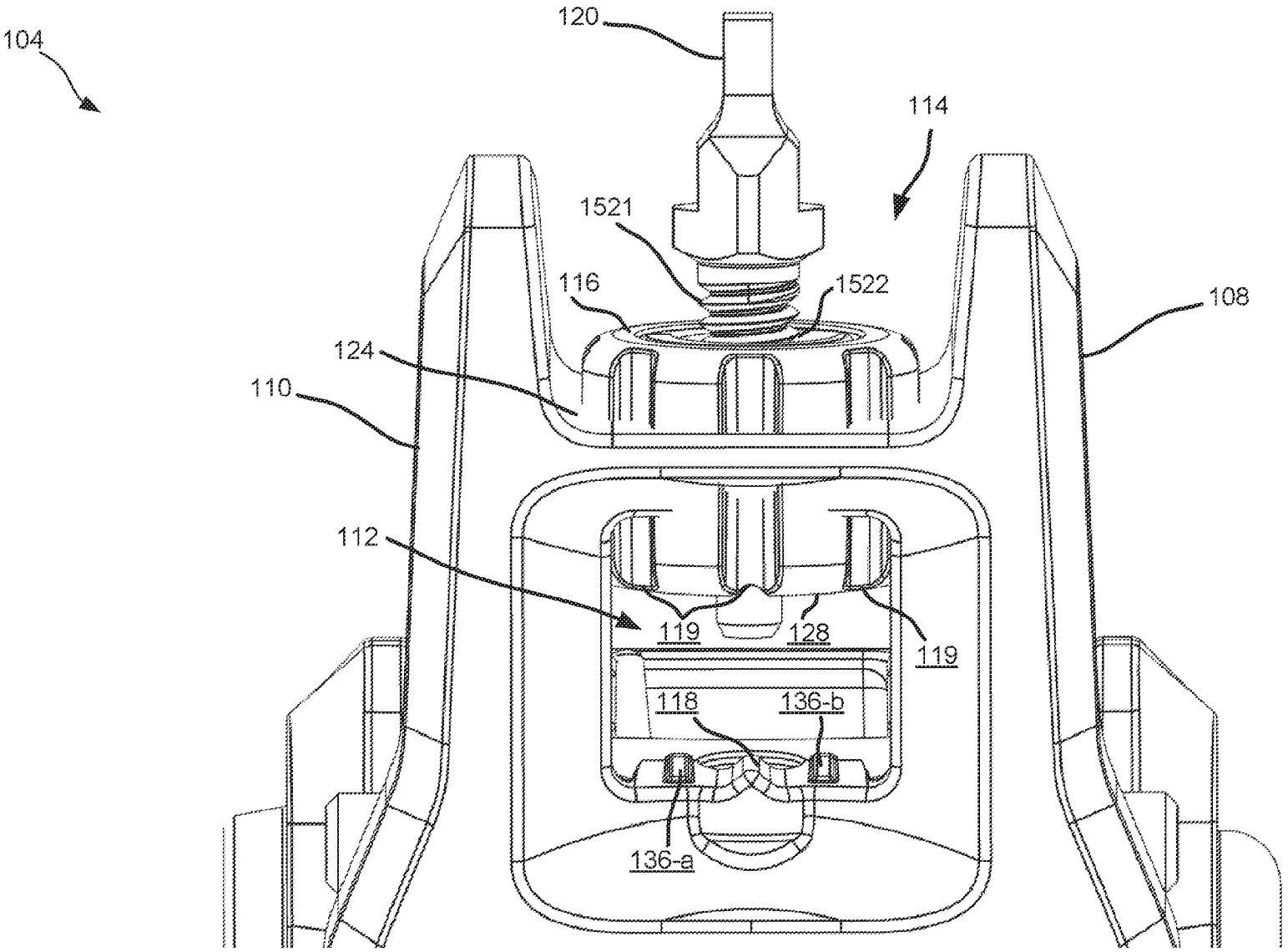
FIG. 15 illustrates a partially exploded view of a flip-up portion of the front sight in FIG. 1, according to an embodiment of the disclosure.
Figure 16B:
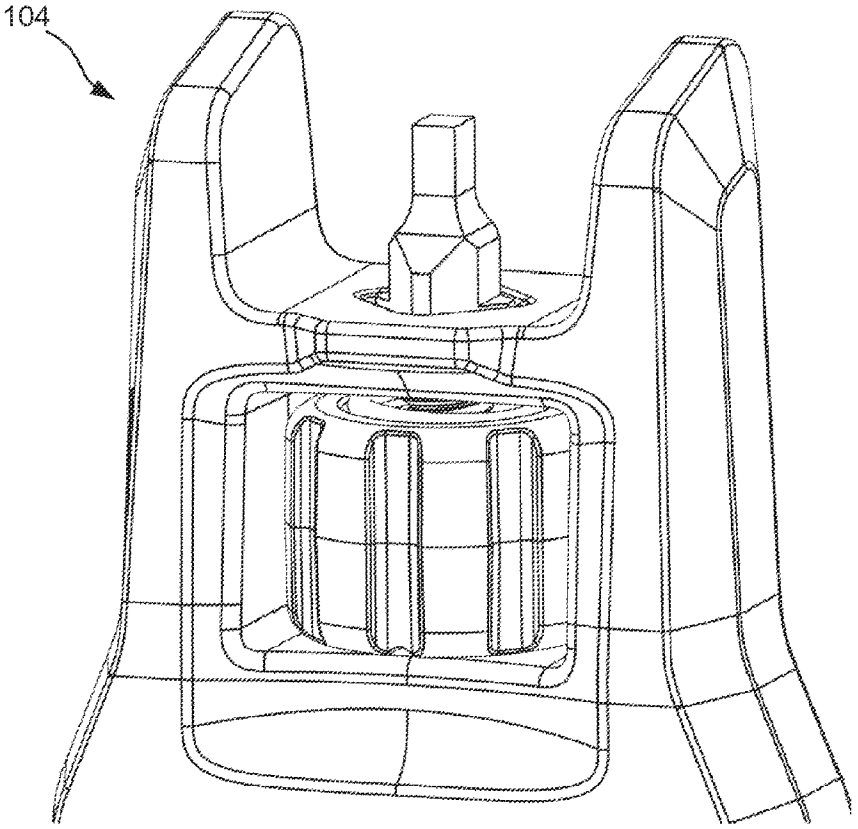
FIG. 16B illustrates a detailed front view of a flip-up portion of the front sight in FIG. 1, according to an embodiment of the disclosure.
Figure 16A:
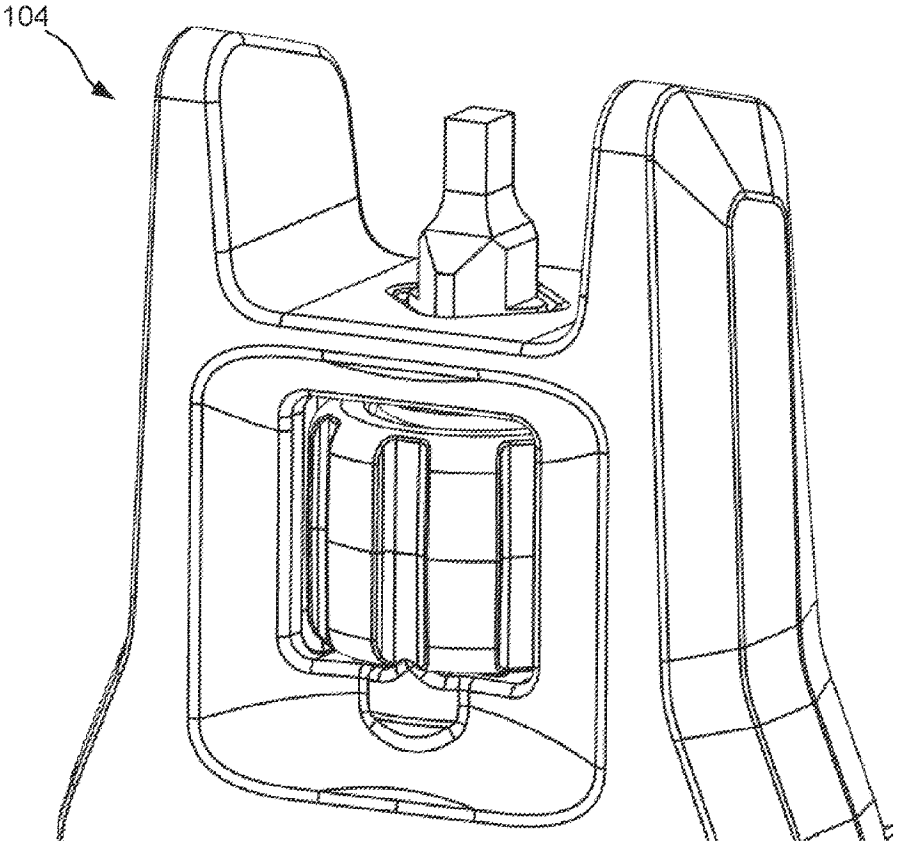
FIG. 16A illustrates a detailed rear view of a flip-up portion of the front sight in FIG. 1, according to an embodiment of the disclosure.
Figure 17:
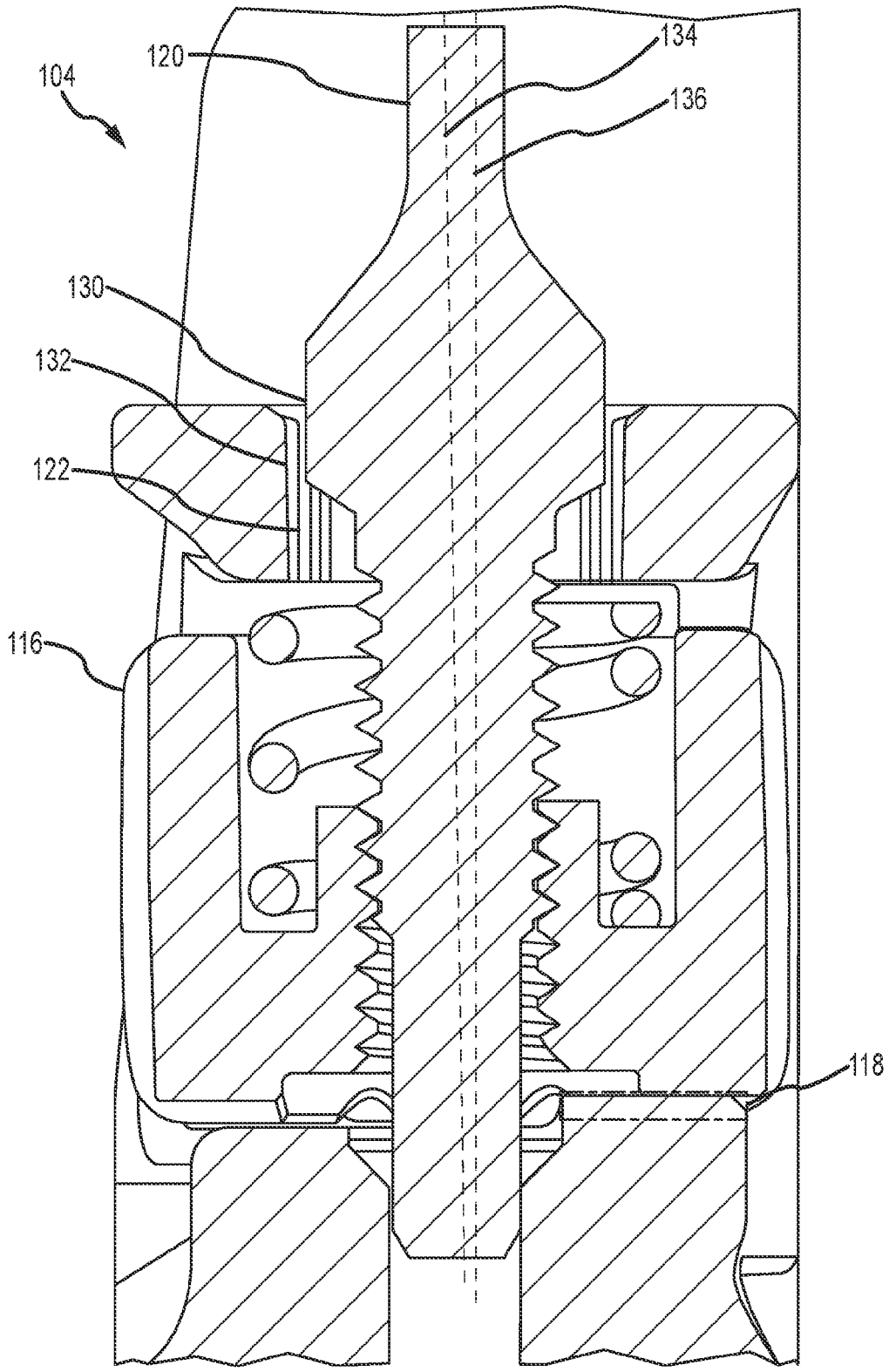
FIG. 17 illustrates a cross-sectional view of the flip-up portion in FIGS. 16A-16B, according to an embodiment of the disclosure.

FIGS. 15-17 show alternative views that help illustrate the interaction of the detent 118, the notches 119 in the elevation knob 116, the sight post 120, and the diamond-shaped aperture 122. Turning now to FIG. 15, which illustrates a partially exploded view of the front flip-up portion 104 (or simply, flip-up portion 104) of a front flip-up sight. The flip-up portion 104 may implement one or more aspects of the flip-up portion previously described in relation to FIG. 1 or any of the other figures described herein. For ease of illustration, the sight post 120 and elevation knob 116 have been moved upward from their in-use positions, allowing the notches 119 and the detent 118 to be more easily visible. In some cases, the front flip-up portion 104 comprises two openings (e.g., opening 112, opening 114), which may be similar or substantially similar to the openings described in relation to FIG. 1. The openings 112 and 114, which may be examples of rectangular openings, may be separated by a horizontal connector 124, where the horizontal connector 124 spans between arms 108, 110 of the front-up portion 104. In some cases, the elevation knob 116 comprises one or more notches 119 on a first side (e.g., distal side, bottom side) and a sight post 120 extending from a second side. For instance, the sight post 120 may be directly threaded into the knob through a screw hole on the second side (e.g., proximal side, upper side) of the knob 116. In the example shown, the sight post 120 comprises a threaded portion 1521 for threading the sight post 120 into a screw hole 1520 on the second side of the knob 116. In some examples, the screw hole 1520 may be positioned at or near the center of the knob. As noted above, the sight post 120 may be shaped and sized to extend at least partially through an aperture (e.g., shown as aperture 122 in FIG. 1) in the horizontal connector 124.

In some embodiments, the elevation knob 116 may be rotationally arranged in the first opening 112 and the sight post 120 may extend at least partially through the aperture into the second opening 114. The detent 118 may be arranged below the elevation knob 116 and near a front (e.g., distal end), or alternatively, a rear (e.g., proximal end) of the first opening 112. In some cases, the first opening 112 may also comprise one or more optional protrusions on one or more sides of the detent 118. For instance, in the example shown, the first opening 112 comprises a protrusion 136 (e.g., protrusion 136-*a*, protrusion 136-*b*) on either side of the detent 118. In some cases, these optional protrusions 136 may be shaped and sized to help tilt the elevation knob 116, which may serve to minimize misalignment of the sight post (i.e., by helping wedge or force the sight post 120 into a centered and stable position), reduce thread tolerance between the screw hole 1522 and the threaded portion 1521, or a combination thereof. In some cases, the notches 119 may be shaped and sized to interact with one or more of the at least one detent 118 and the one or more protrusions 136. For instance, in some cases, the tilting of the elevation knob 116 and the sight post 120 may be caused by one or more of the protrusions 136 and the detent 118. In some other cases, the protrusions 136 rather than the detent 118 may primarily cause the tilting. In one non-limiting example, the detent 118 may be tall enough to hold the elevation knob 116 at a selected position, but not tall enough to cause the elevation knob 116 to tilt when the detent 118 is engaged with one of the notches 119. In such cases, the protrusions 136 may be made tall enough to cause the elevation knob 116 and the sight post 120 to tilt (e.g., forward, rearward).

FIGS. 16A and 16B illustrate rear and front views, respectively, of the front flip-up portion 104 previously described in relation to FIG. 15.

FIG. 17 illustrates a cross-sectional view of the flip-up portion 104 of a front flip-up sight. The front flip-up portion 104 (or simply, flip-up portion 104) may be similar or substantially similar to the flip-up portion 104 described in relation to FIG. 1 or any of the figures described herein. FIG. 17 shows the cross section of the flip-up portion 104 viewed from the left side. As seen, the flip-up portion 104 comprises a detent 118, an elevation knob 116, one or more notches (not visible) on a first side of the knob 116, a sight post 120 on a second side of the knob 116, and an aperture 122 (e.g., a diamond-shaped aperture) through which the sight post 120 at least partially extends. In some embodiments, the sight post 120 may be threaded into the knob 116, although other fastening means besides threading are contemplated in different embodiments. In some other cases, the sight post 120 and the knob 116 may be constructed as a unitary structure. In this example, the detent 118 is arranged toward a back (or proximal end) of the flip-up portion 104, i.e., right of the page. Further, the detent 118 is shaped and sized to contact a rear bottom surface of the elevation knob 116. The interface or contact between the detent 118 and the bottom surface of the elevation knob 116 may cause the elevation knob 116 to tilt forward (i.e., left of the page), which may in turn cause the sight post 120 to also tilt forward. FIG. 17 illustrates a first vertical axis 136 passing through the flip-up portion 104, for instance, through the center of the diamond-shaped aperture 122. In some cases, the sight post 120 and the elevation knob 116 may be concentric (i.e., their centers lie on the same axis). As seen, FIG. 17 also illustrates a second vertical axis 134 passing upward through the center of the elevation knob 116 and the sight post 120. In some cases, the second vertical axis 134 may be tilted forward of the first vertical axis 136 based at least in part on the tilting of the sight post 120, the tilting of the knob 116, or a combination thereof. In some instances, this tilting of the sight post 120 may cause a front 130 of the sight post 120 to force (or press) against a front 132 of the diamond-shaped aperture 122. For example, the front 130 of the sight post 120 may wedge between the two angled faces at the front 132 of the diamond-shaped aperture 122. This wedging may serve to minimize, or even remove, the ability of the sight post 120 to move sideways (i.e., in and out of the page in FIG. 17), and thereby facilitate in enhancing the centering of the sight post 120 with respect to existing technologies. This figure may be exaggerated to more clearly show tilting caused by the single detent 118.

Generally, this disclosure has focused on a diamond-shaped aperture 122 and a sight post 120 with a diamond-shaped cross section (i.e., when viewed from above). However, these shapes are not intended to be limiting. Rather any corresponding shapes that cause a wedging of the sight post to a centered position are contemplated in different embodiments. For instance, in one non-limiting example, the aperture and sight post may have triangular shapes. In such cases, the top vertices of these triangles may be arranged opposite from the detent 118 such that a front angle of the triangular sight post 120 pushes into a front angle or wedge shape of the triangular-shaped aperture. Alternatively, instead of a diamond shape, both the aperture and sight post could have four curved faces each meeting at angled corners (e.g., a diamond shape with curved rather than straight faces, a superellipse, an asteroid, etc.). In another example, ovular shapes could be used for the aperture 122 and/or the sight post 120. In some other cases, rhombus or pentagonal shapes may be utilized for the aperture 122 and/or the sight post 120. It should be noted that, the cross-sectional shape used for the sight post 120 may or may not be identical to the shape of the aperture 122. For instance, in one non-limiting example, the aperture 122 may have an ovular shape, where its major (or longer) axis may be parallel or substantially parallel to a longitudinal axis (or barrel axis) through the firearm, while the sight post 120 may have a diamond-shaped cross section. As another example, the aperture 122 may be diamond-shaped and the sight post 120 may have an ovular cross section with its major axis (i.e., longer axis) parallel or substantially parallel to the barrel axis of the firearm.

Although the figures show the detent 118 at a rear of the flip-up portion 104 or the first opening 112, equally effective implementations may be achievable by positioning the detent 118 at or near a front of the flip-up portion 104 or the first opening 112. Such an arrangement may cause the elevation knob 116 and/or the sight post 120 to tilt backward (or rearward) instead of forward. It should be noted that, the centering effect of the sight post 120 wedging between two rear angled faces of the diamond-shaped aperture 122 may be the same (or substantially the same) as when the sight post 120 wedges between two front angled faces of the aperture 122.

Figure 2:
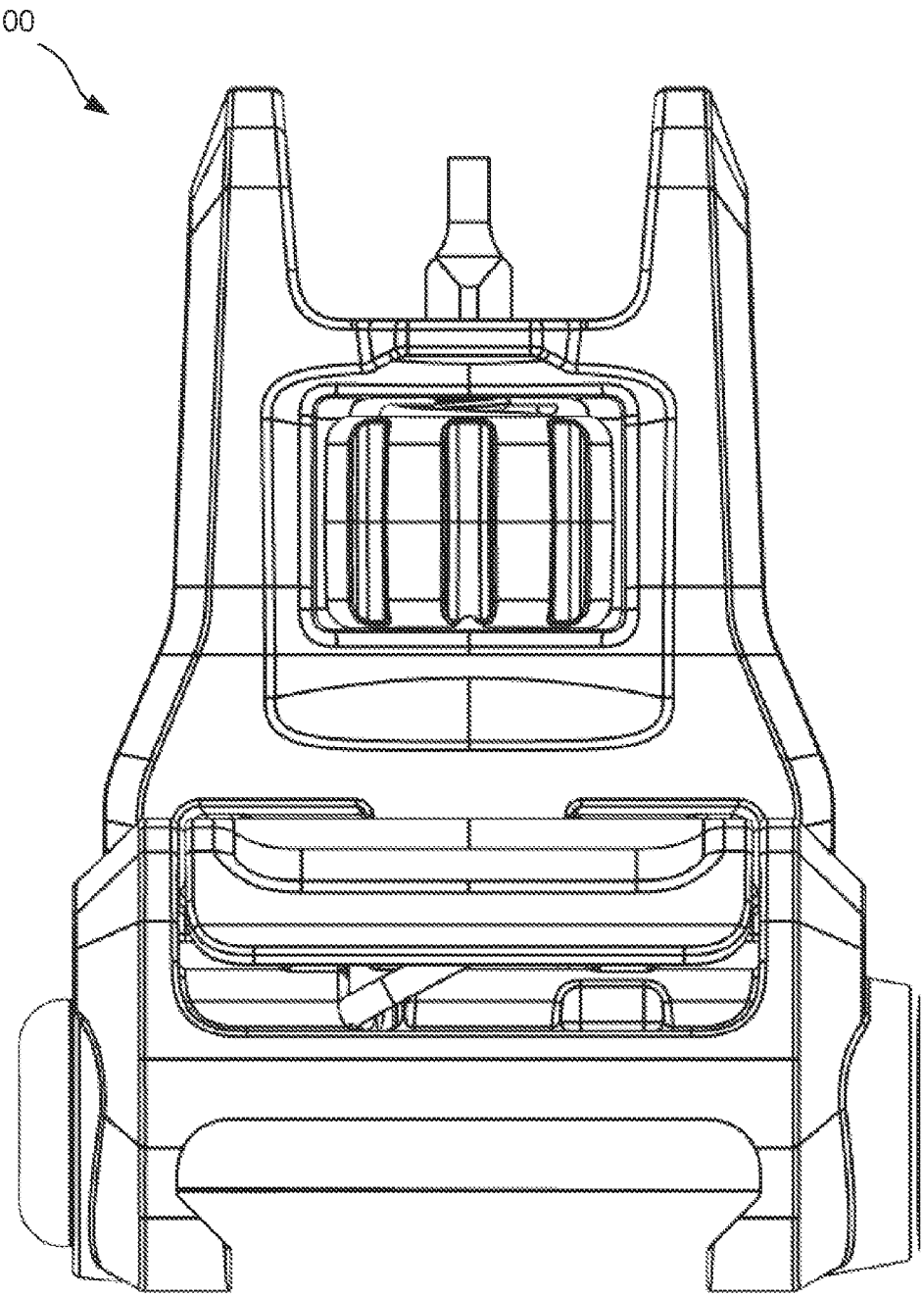
FIG. 2 is a front view of the front sight in FIG. 1, according to an embodiment of the disclosure.
Figure 3:
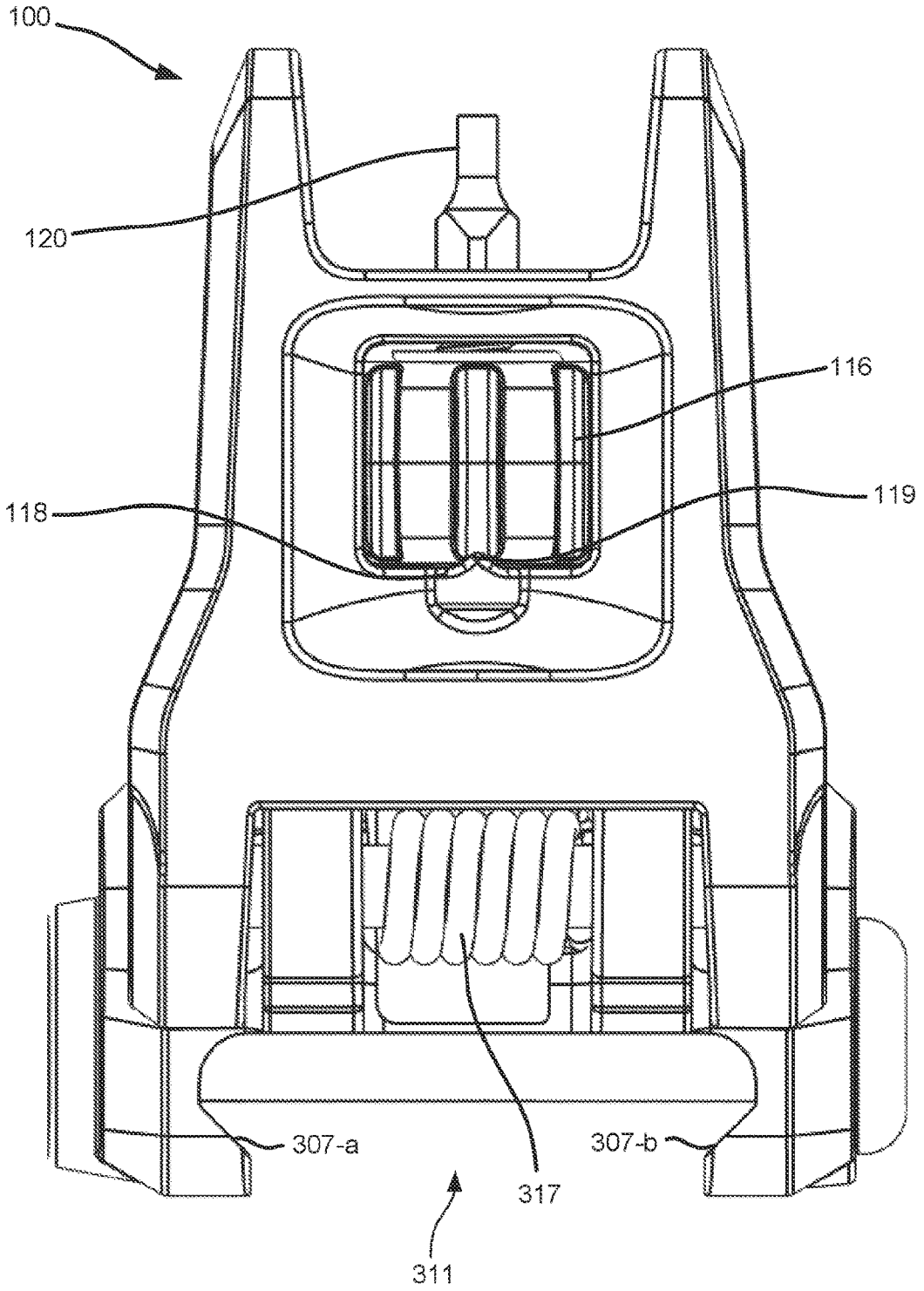
FIG. 3 is a rear view of the front sight in FIG. 1, according to an embodiment of the disclosure.
Figure 4:
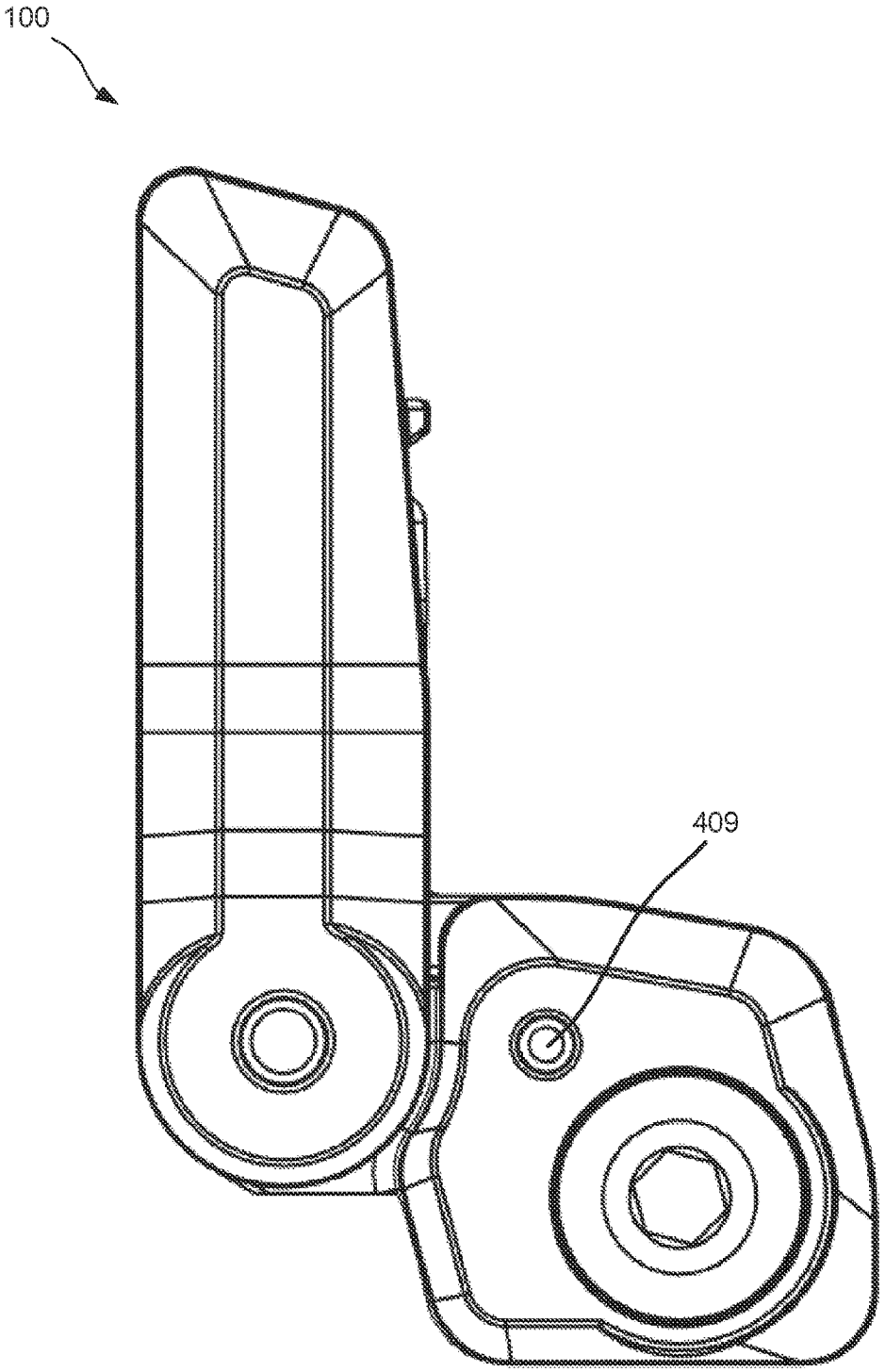
FIG. 4 is a side view of the front sight in FIG. 1, according to an embodiment of the disclosure.
Figure 5:
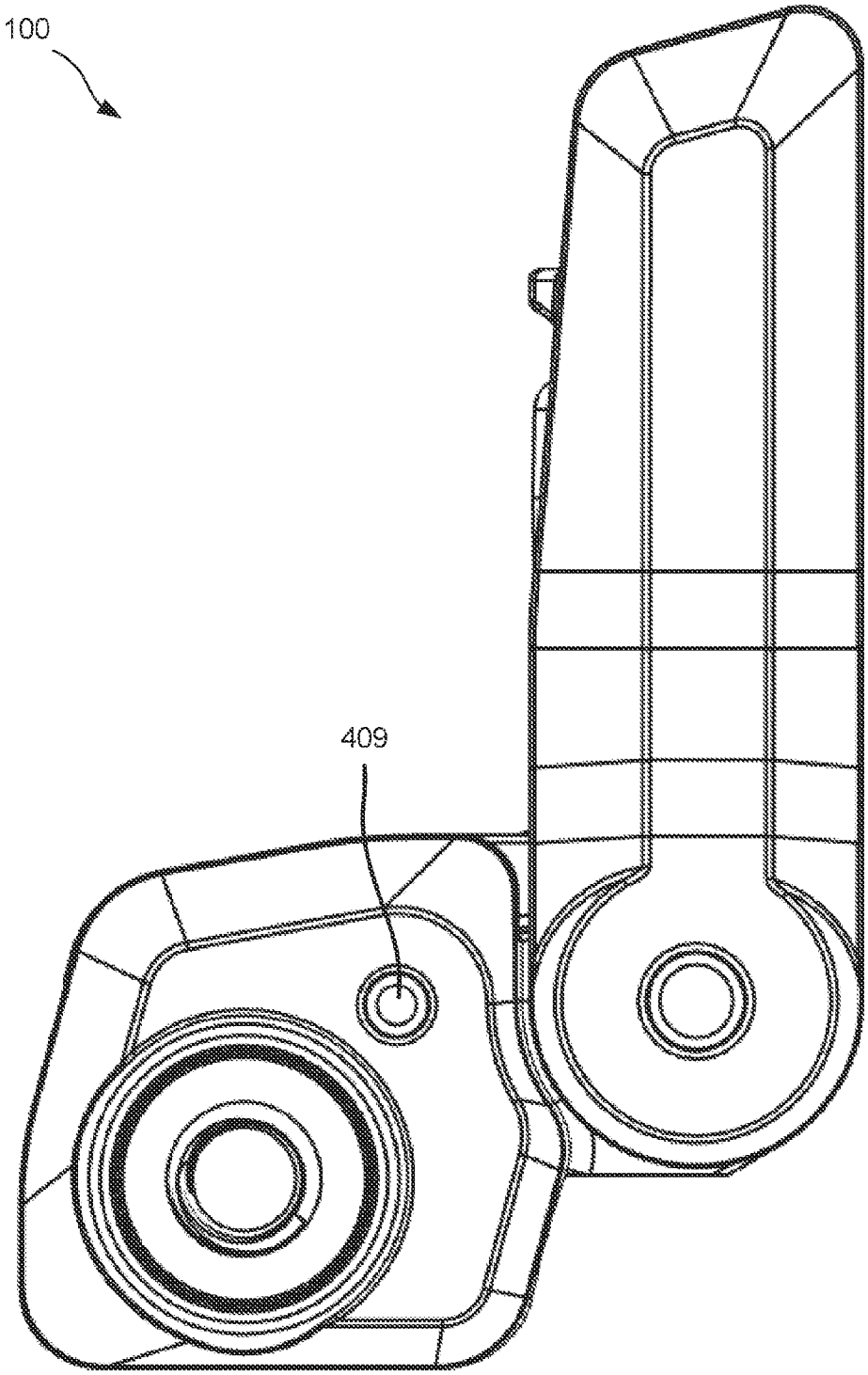
FIG. 5 is another side view of the front sight in FIG. 1, according to an embodiment of the disclosure.
Figure 7:
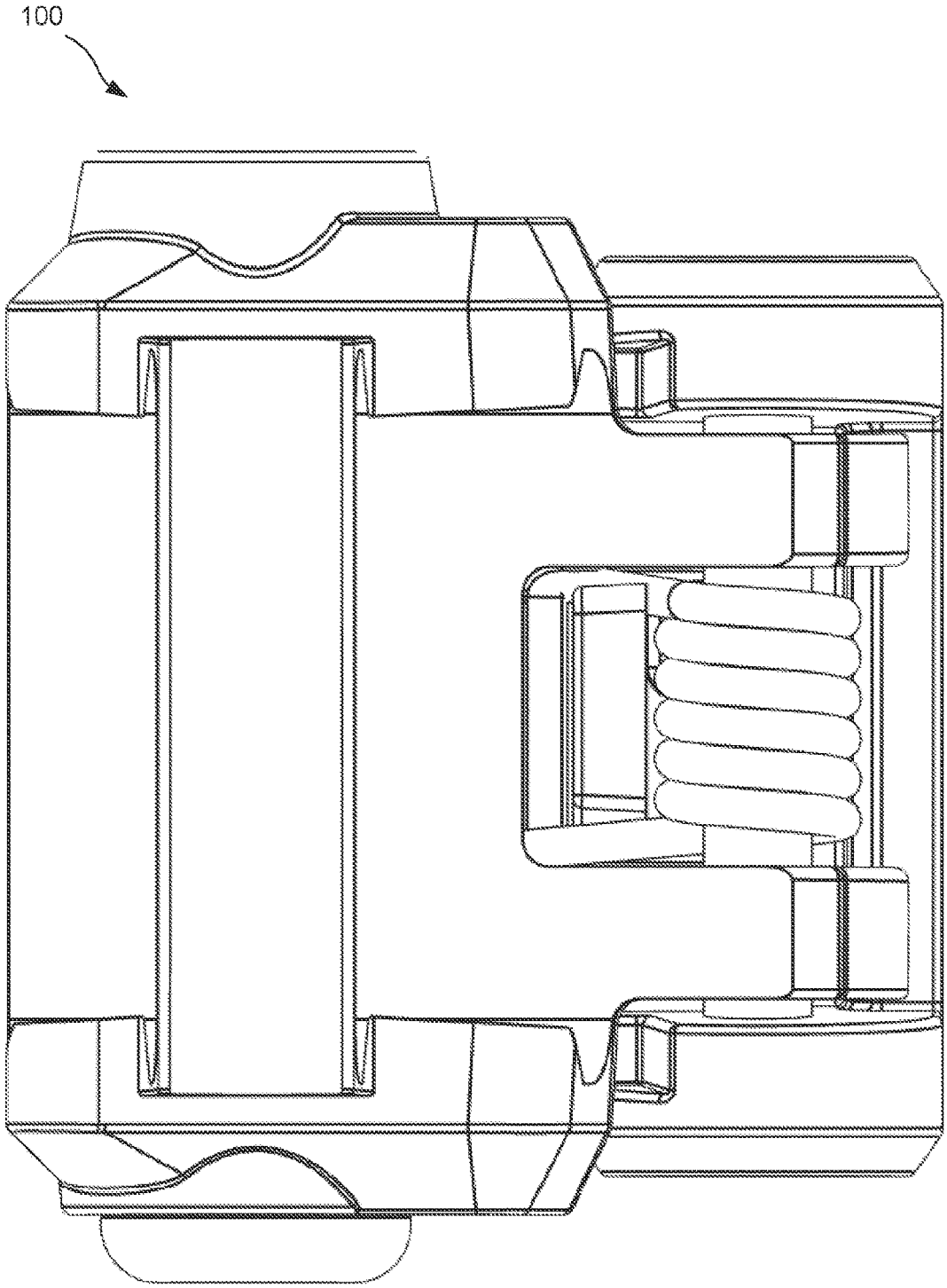
FIG. 7 is a bottom view of the front sight in FIG. 1, according to an embodiment of the disclosure.

FIGS. 2-5 and 6 provide further illustrations and details surrounding the centering of the front sight post 120. FIG. 2 illustrates a rear view of the front flip-up sight 100 in FIG. 1, in accordance with one or more implementations. FIG. 3 illustrates a front view of the front flip-up sight 100 in FIG. 1, in accordance with one or more implementations. FIGS. 4 and 5 are alternate side views of the front-flip up sight 100 in FIG. 1, in accordance with one or more implementations. FIG. 7 illustrates a bottom view of the front-flip up sight 100, according to an embodiment of the disclosure.

Figure 8:
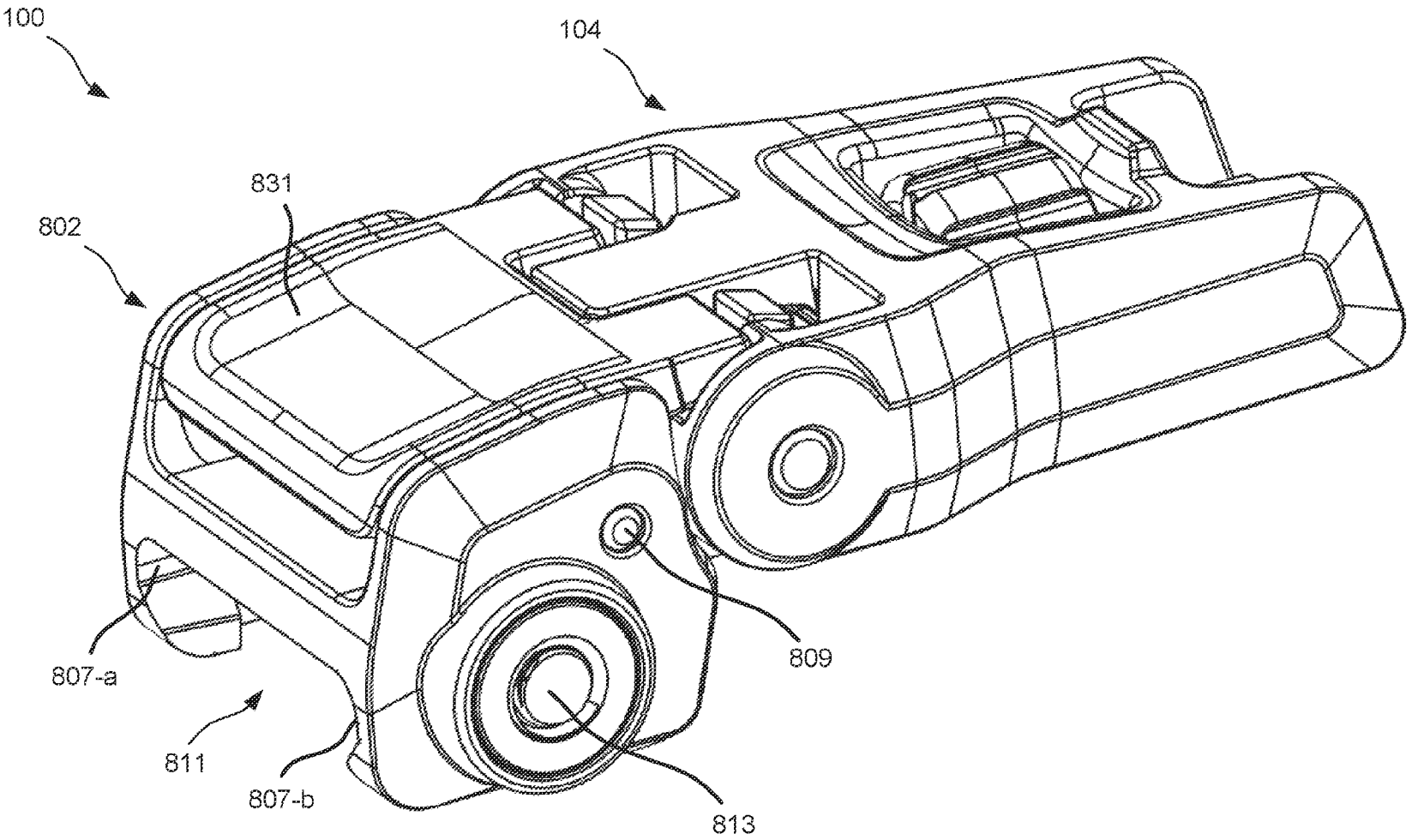
FIG. 8 is a perspective view of a front sight of a sighting system in a stowed position, according to an embodiment of the disclosure.

In some embodiments, the front-flip up sight 100 may be configured to be flipped between a deployed and a stowed position. FIGS. 8-14 illustrate various views of the front flip-up sight 100 in FIG. 1 in the stowed position. As shown in FIG. 8, the front flip-up sight 100 comprises a base 802, a latch 831 (also shown as latch 931 in FIG. 9), guide surfaces 807, a channel 811, a mounting screw 813, and a hinge pin 809. The base 802 may be similar or substantially similar to the base 102 previously described in relation to FIG. 1. In some cases, the front flip-up sight 100 may be configured to be mounted on an accessory mounting rail, such as a Picatinny rail. The width of the channel 811 or the distance between opposing guide surfaces 807 (also referred to as rail-engaging surfaces) may be varied using the mounting screw 813. In some cases, a user may place the front flip-up sight 100 on an accessory mounting rail such that the rail is within the channel 811. The user may then tighten or clamp the base 802 over the rail using the mounting screw 813 to secure the front flip-up sight 100 in place. In some examples, the hinge pin 809 may allow the front flip-up portion 104 to pivot between a stowed position (e.g., in FIG. 8) and a deployed position (e.g., in FIG. 1). In some embodiments, the hinge pin 809 may be spring-loaded (e.g., using spring 317 in FIG. 3, using spring 1017 in FIG. 10), and the hinge mechanism (i.e., the hinge pin 809 and the spring 317) may be controlled using the latch 831 provided on the top side of the base 802. A user may press on the latch 831 to release the front flip-up portion 104 to the up (or deployed position).

Figure 9:
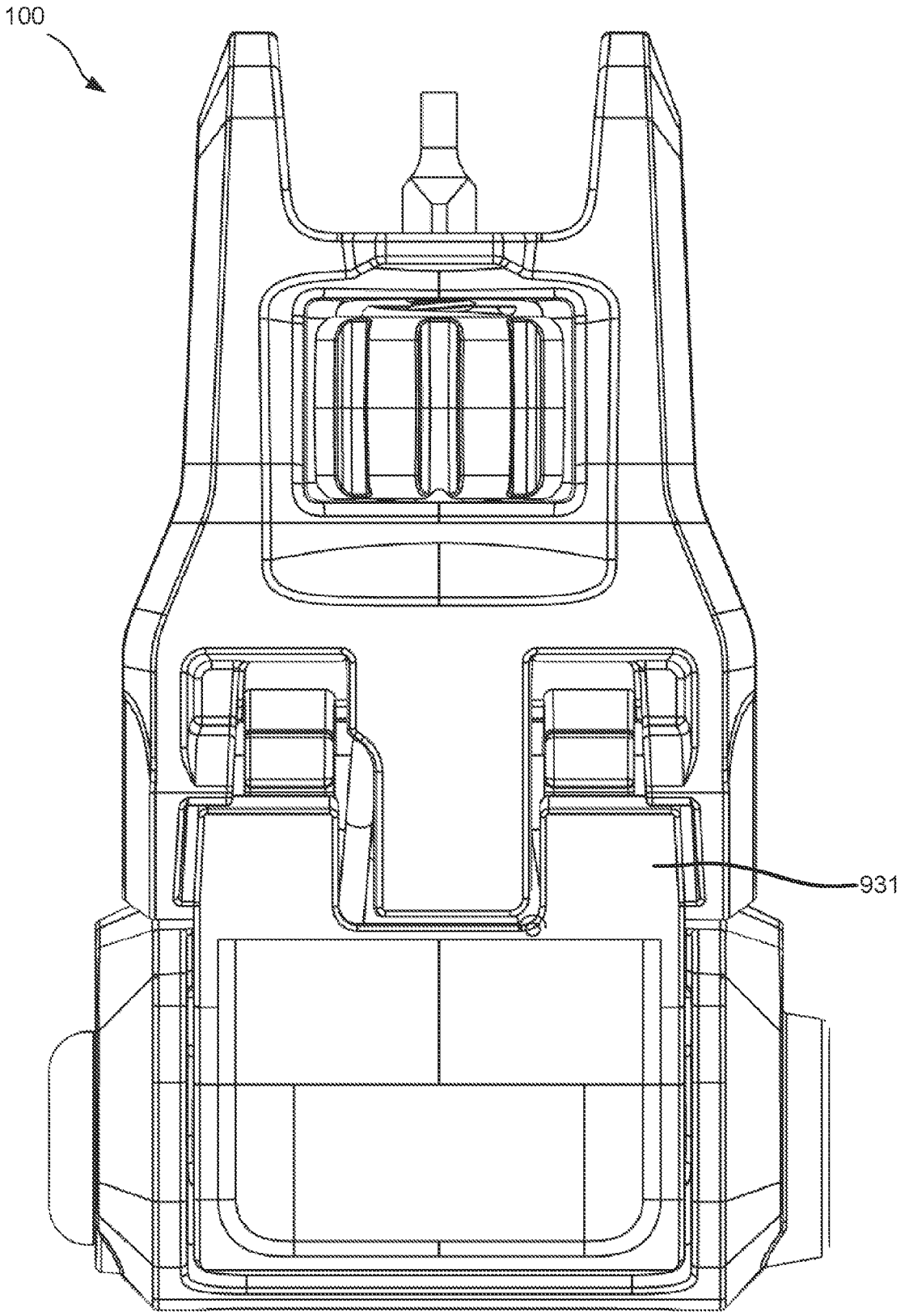
FIG. 9 is a top view of the front sight in FIG. 8, according to an embodiment of the disclosure.

FIG. 9 illustrates a top view of the front flip-up sight 100 in the stowed position showing a latch 931. As shown, the latch 931 may be installed on the top of the base. Depressing the latch 931 may allow the flip-up portion 104 of the sight to deploy, further described below in relation to FIG. 10.

Figure 10:
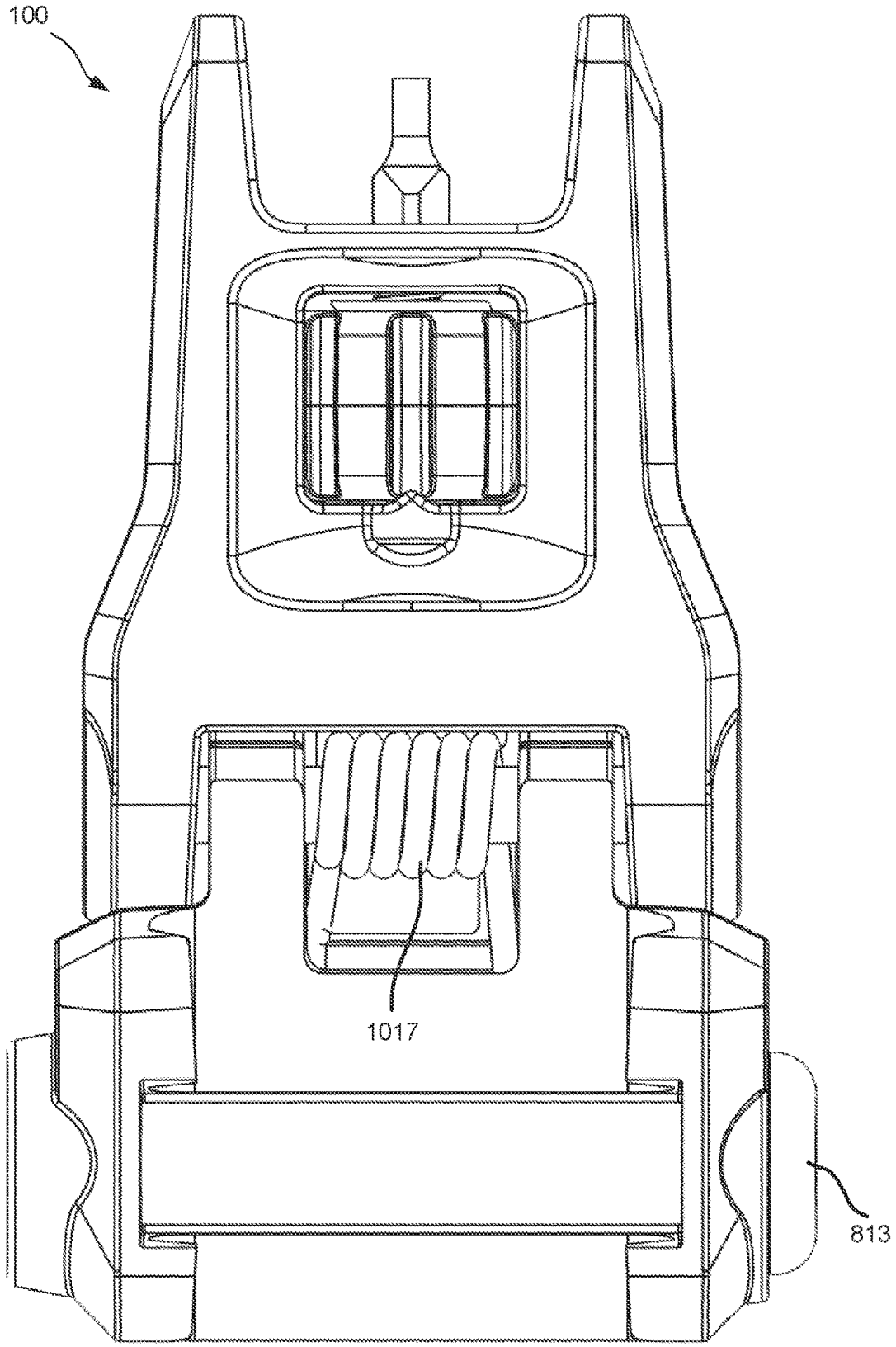
FIG. 10 is a bottom view of the front sight in FIG. 8, according to an embodiment of the disclosure.

FIG. 10 illustrates a bottom view of the front flip-up sight 100 in the stowed position. As seen, the front flip-up sight 100 comprises a spring 1017, which may be similar or substantially similar to spring 317 in FIG. 3. The spring 1017 may be used to spring-load a hinge pin (e.g., shown as hinge pin 809 in FIG. 8), which may allow a user to bias the front flip-up portion 104 from a stowed to a deployed position by clicking on a latch (e.g., shown as latch 931), for instance. As seen in FIG. 9, the latch 931 may be installed on a top side of the base 102, although other applicable locations may be utilized in different embodiments.

Figure 11:
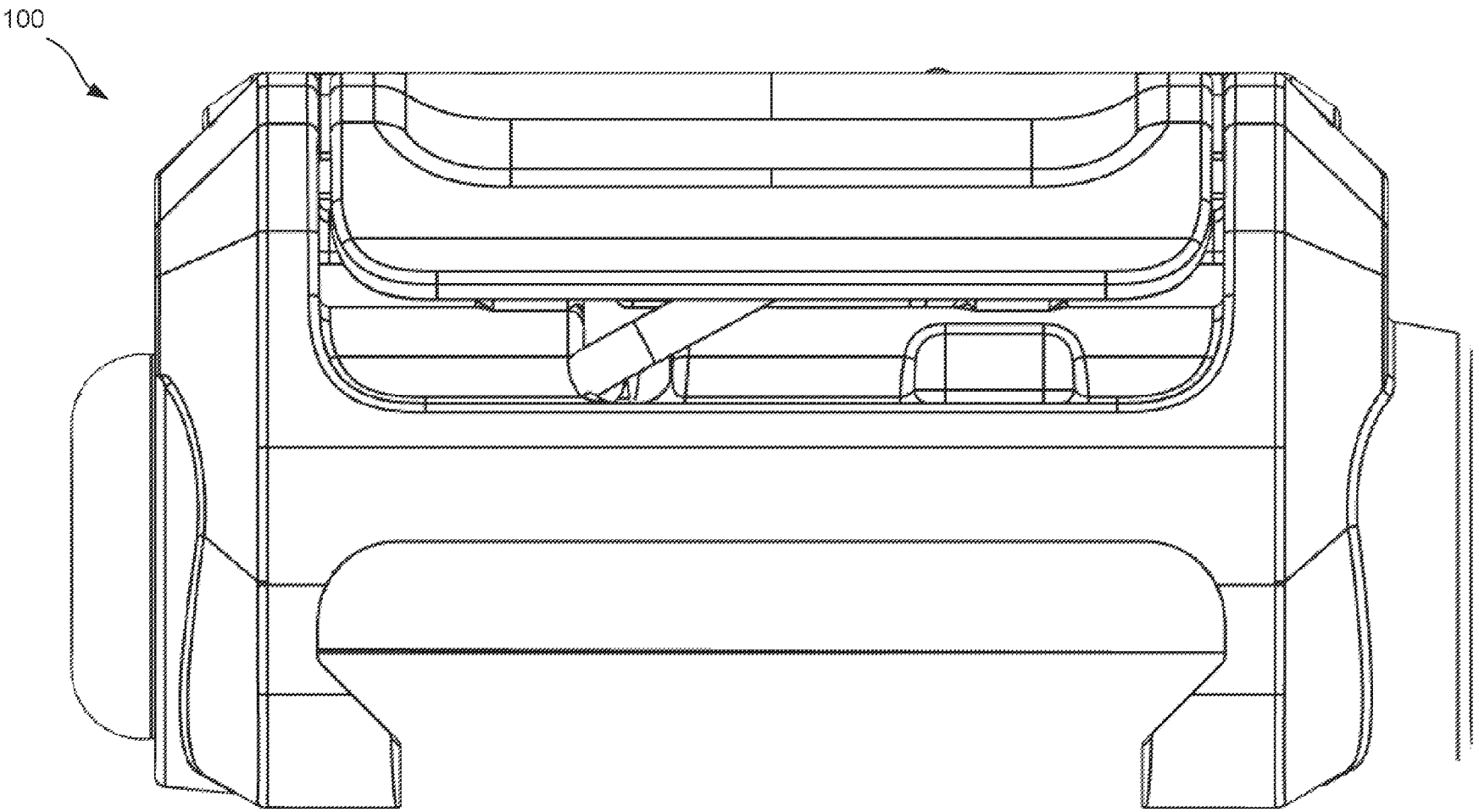
FIG. 11 is a front view of the front sight in FIG. 8, according to an embodiment of the disclosure.
Figure 12:
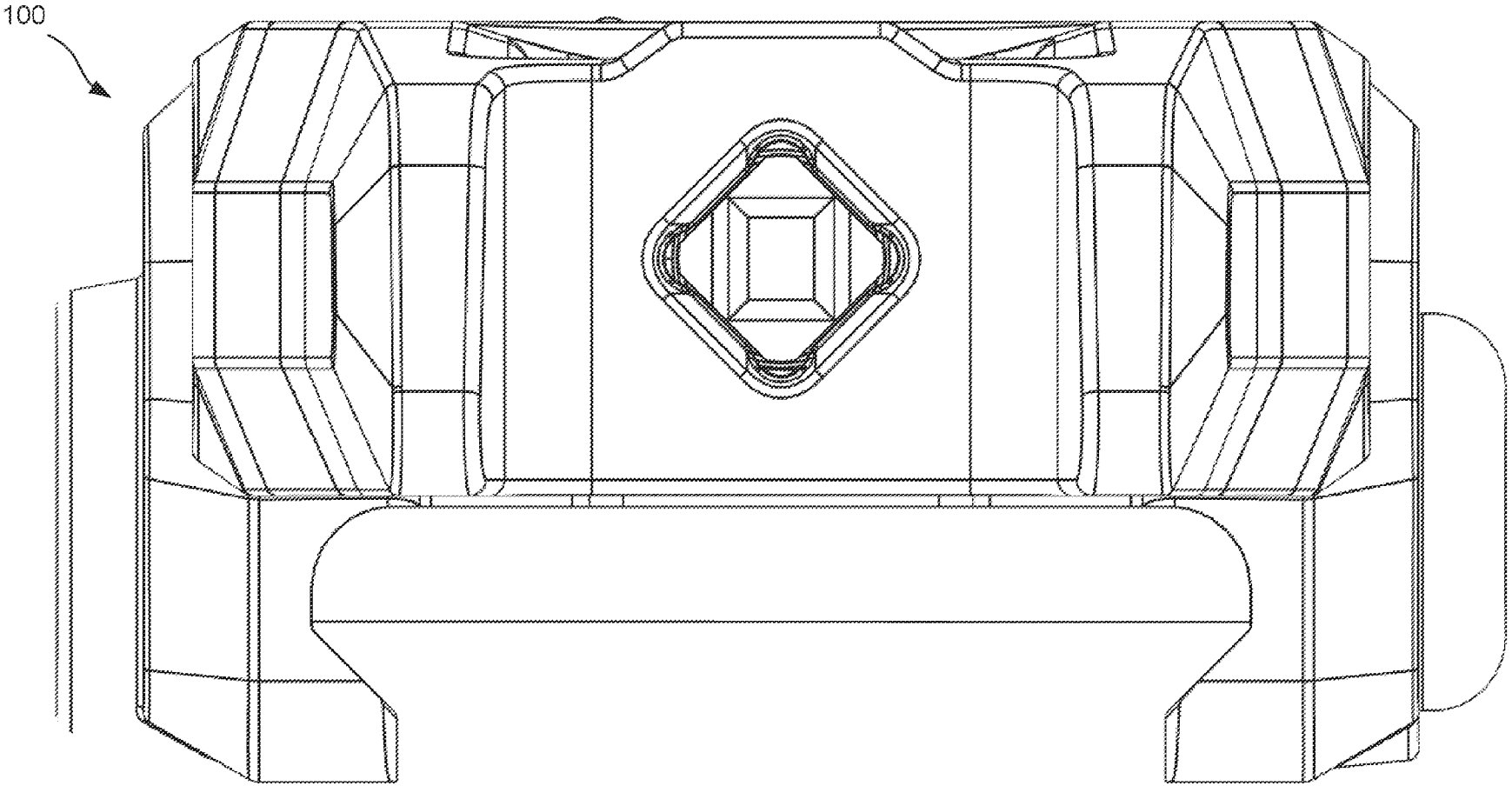
FIG. 12 is a rear view of the front sight in FIG. 8, according to an embodiment of the disclosure.
Figure 13:
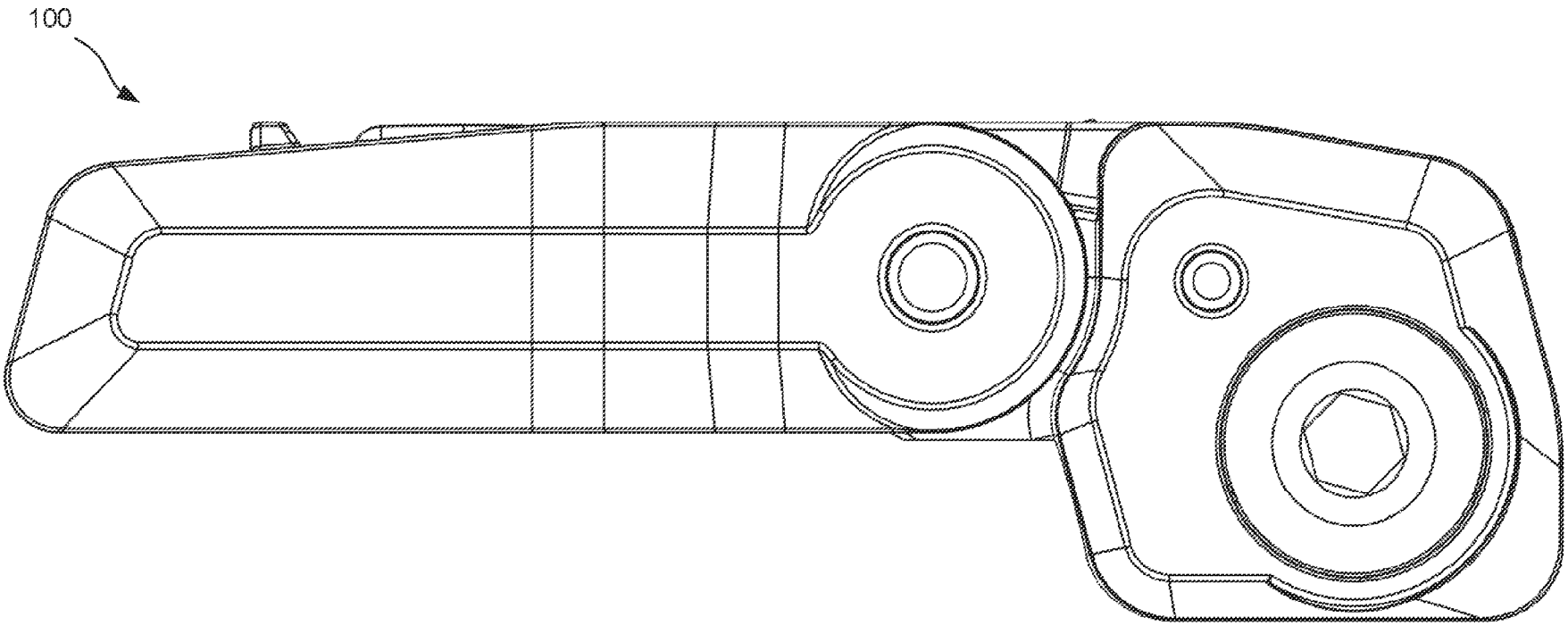
FIG. 13 is a side view of the front sight in FIG. 8, according to an embodiment of the disclosure.
Figure 14:
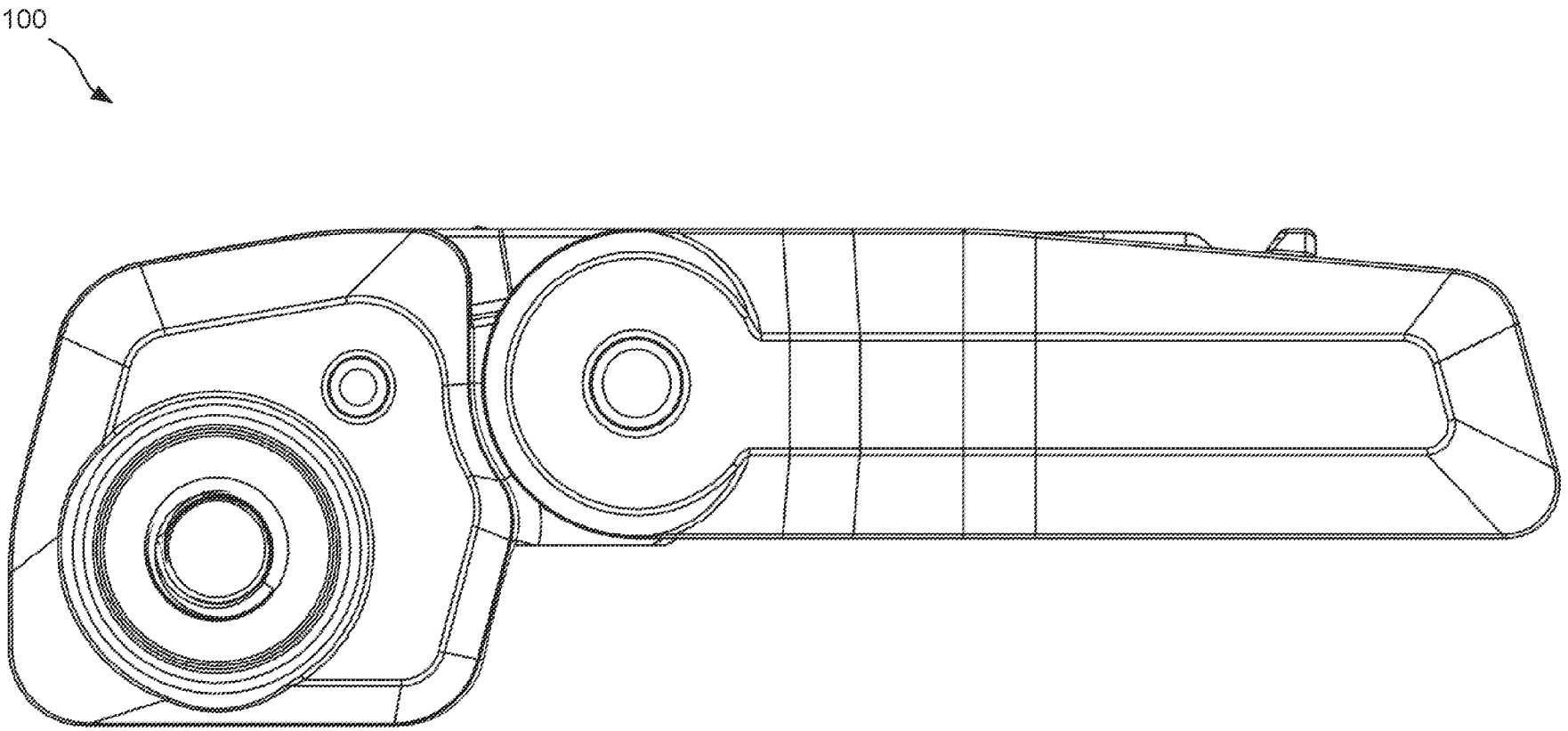
FIG. 14 is another side view of the front sight in FIG. 8, according to an embodiment of the disclosure.

FIG. 11 illustrates a front view of the front flip-up sight 100 in the stowed position, according to an embodiment of the disclosure. Further, FIG. 12 illustrates a rear view of the front flip-up sight 100 in the stowed position, according to an embodiment of the disclosure. FIG. 12 shows the diamond-shaped aperture 122, the sight post 120, and the one or more optional cutouts 126, previously described in relation to FIG. 6. FIGS. 13 and 14 illustrate alternate side views of the front flip-up sight 100 in the stowed position, in accordance with one or more implementations. FIGS. 16A and 16B illustrate a detailed rear view and a detail front view, respectively, of the flip-up portion 104 of the front sight in FIG. 1, in accordance with one or more implementations.

Disassociating Rear Sight Aperture from Windage Screw

As noted above, there is a need for a rear flip-up sight (or simply, rear sight) having a plurality of apertures, such as a small and a large aperture. In some instances, the rear sight described in this disclosure may be designed to provide users with the ability to immediately employ the large aperture when deploying the sight. Additionally, or alternatively, the rear sight of the present disclosure may be designed to minimize or avoid misalignment, and/or alleviate issues due to windage shift or canting while switching between apertures, as seen in some current technologies.

Aspects of this disclosure relate to a flat, paddle-like aperture mechanism comprising a first aperture having a first size (e.g., first diameter) and a second aperture having a second size (e.g., second diameter). In some cases, the first aperture size may be larger than the second aperture size. The paddle-like aperture mechanism may be configured to be flipped (e.g., rotated 180°) to select between the large and small apertures, which may optimize compactness and/or provide users with the ability to first deploy the sight with either the small or large aperture without introducing damage sensitivities. Currently used rear aperture mechanisms (e.g., having apertures of different sizes) are often threaded and suffer from lateral shift when switching between apertures. As noted above, this issue is exacerbated when using aperture mechanisms that flip (or rotate 180 degrees), versus the traditional 90° rotation. In some cases, both large and small aperture holes may be visible simultaneously during use. While some manufacturers have attempted to mitigate the lateral shift issue by compensating the top and bottom of the aperture (i.e., hole locations and/or surrounding material), such sights often appear odd and ungainly. In order to enhance the aesthetics of the sight, as well as mitigate the lateral shift issue, a center threaded nut (or threaded tab, such as tab 2020-*c* in FIG. 20C) that interfaces with the windage screw instead of the flat, paddle-like aperture may be utilized in the rear sight of the present disclosure. In some embodiments, this center threaded nut does not rotate, but instead, shifts laterally along the windage screw, thereby pushing the aperture mechanism left or right. In some cases, the aperture mechanism itself may or may not be threaded. For instance, if the aperture mechanism is not threaded, it may be configured to rotate around the windage screw with minimal to no lateral shifting. In such cases, the aperture mechanism may be laterally held in place by the center threaded nut or threaded tab. Such a design may allow the aperture to have a singular, vertical, symmetrical centerline (e.g., no jogs or canting) with enhanced aesthetics, as well as a compact form.

Figure 18:
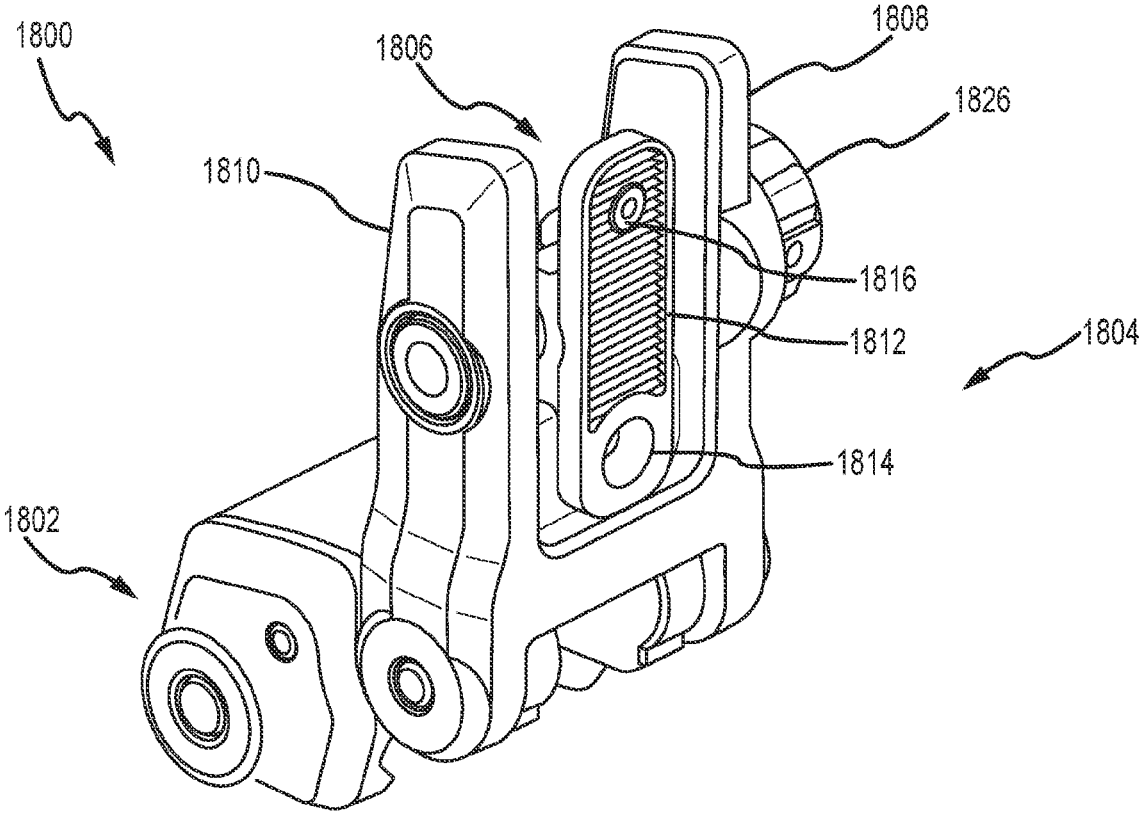
FIG. 18 illustrates a perspective view of a rear sight of a sighting system in a deployed position, according to an embodiment of the disclosure.

FIG. 18 illustrates a perspective view of a rear sight 1800 of a sighting system in a deployed position, according to an embodiment of the disclosure. As seen, the rear sight 1800 comprises a base 1802, a rear flip-up portion 1804, and an aperture mechanism 1812. In some cases, the rear flip-up portion 1804 implements one or more aspects of the front flip-up portion 104 previously described in relation to FIG. 1. As seen, the rear flip-up portion 1804 comprises a first rear arm 1808 and a second rear arm 1810, and an opening 1806 positioned between the two arms 1808, 1810. The aperture mechanism 1812 may be positioned within the opening 1806 and may comprise a first end having a first aperture 1814 and a second end having a second aperture 1816. In the example shown, the first aperture 1814 is of a different size (e.g., larger) than the second aperture 1816 and is arranged on an opposing end of the aperture mechanism 1812 (also referred to as paddle-like aperture 1812) as the second aperture.

In some embodiments, the paddle-like aperture or aperture mechanism 1812 may be configured to flip (or rotate 180°) around a windage screw (e.g., shown as windage screw 1922 in FIG. 19) with minimal or no lateral movement along the windage screw. Flipping or rotating the paddle-like aperture 1812 180° may allow a user to switch between the large aperture (i.e., first aperture 1814) and the small aperture (i.e., second aperture 1816). In some examples, the windage screw (e.g., windage screw 1922 in FIG. 19) may pass through each of the two arms 1808, 1810 of the rear flip-up portion 1804. Further, a windage knob 1826 may be coupled at one end of the windage screw, for instance, on an outside face of one of the two rear arms 1808, 1810. In some embodiments, the aperture mechanism 1812 may be configured to flip or pivot around the windage screw when the windage knob 1826 is rotated by a user.

Figure 19:
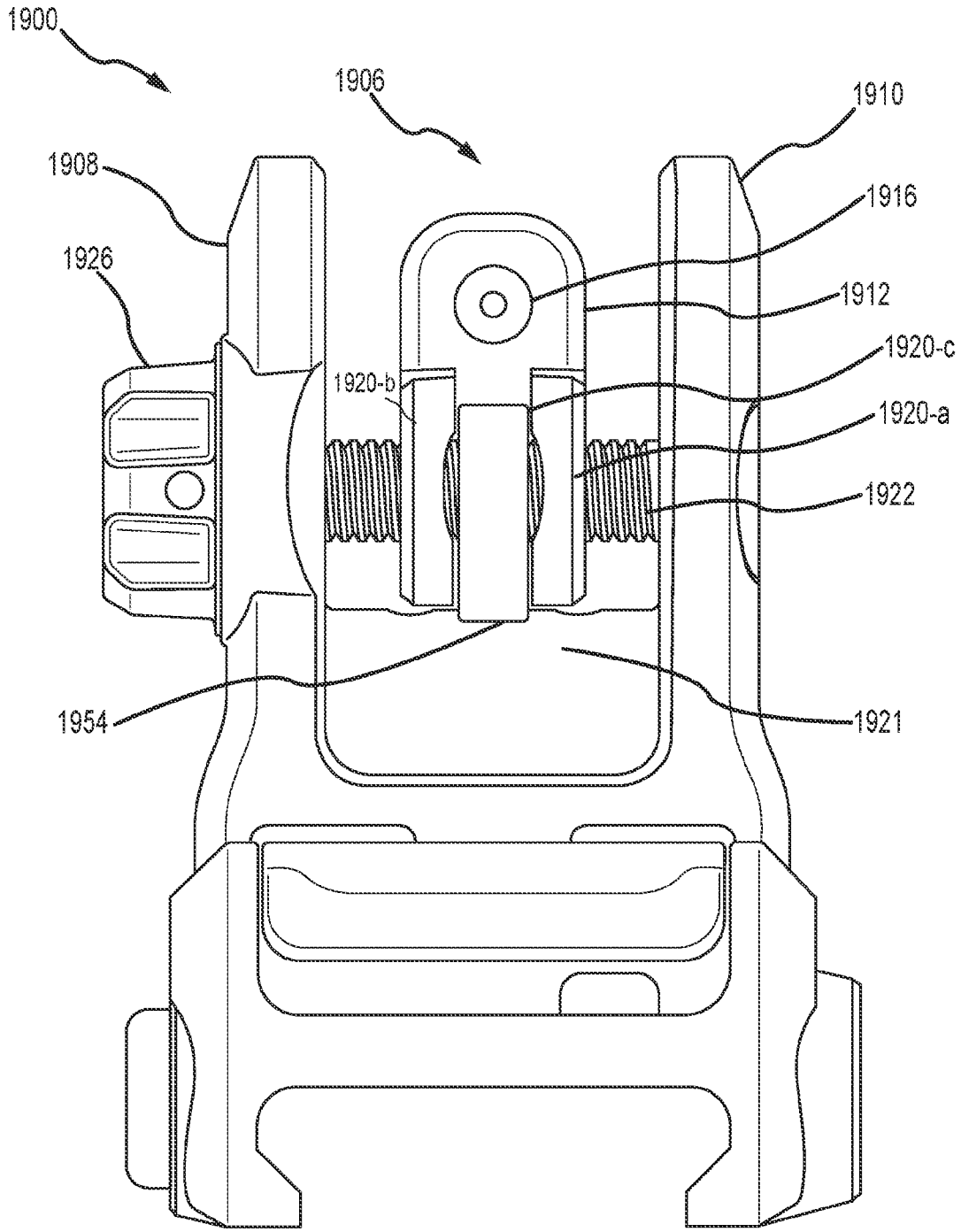
FIG. 19 illustrates a front view of the rear sight in FIG. 18, according to an embodiment of the disclosure.
Figure 20A:
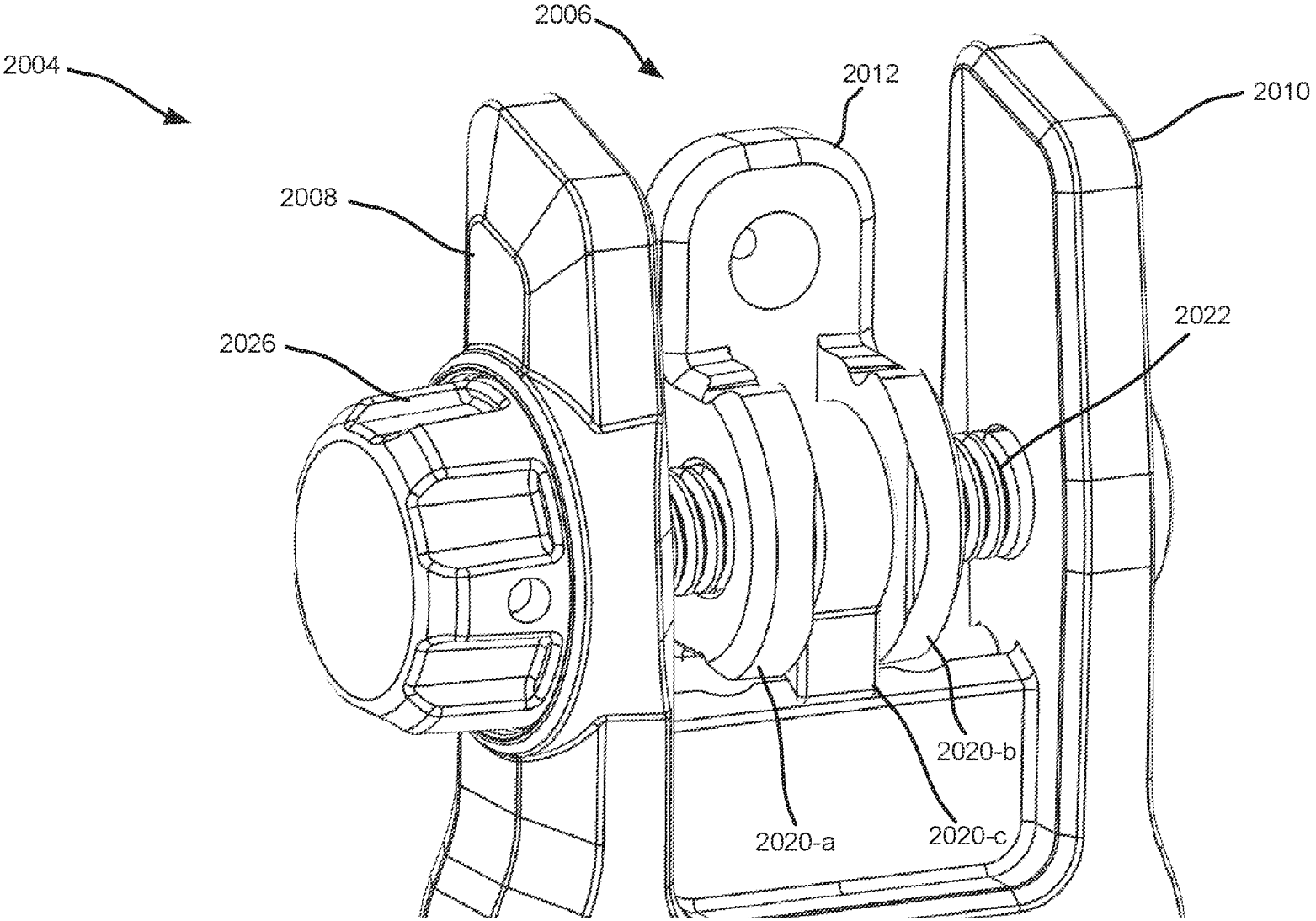
FIG. 20A illustrates a detailed perspective view of an aperture mechanism of the rear sight in FIG. 18, according to an embodiment of the disclosure.
Figure 20C:
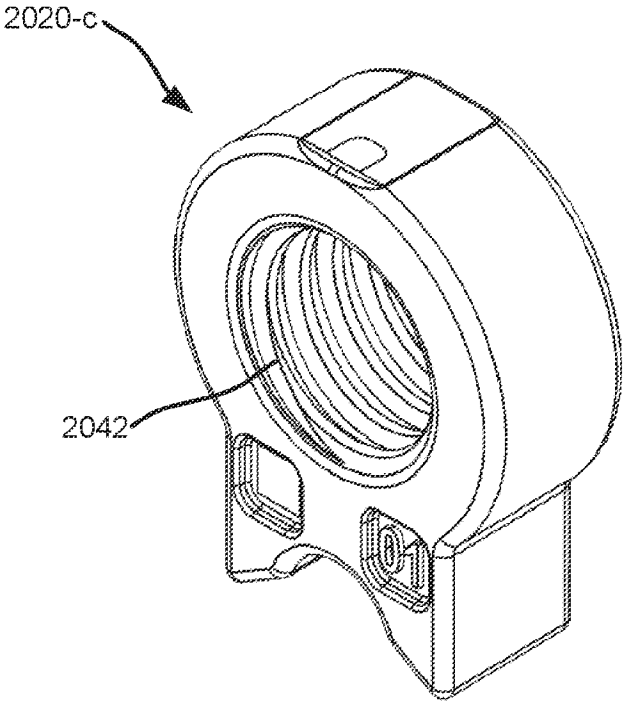
FIG. 20C illustrates a perspective view of a threaded tab for laterally moving an aperture mechanism of a rear sight, according to an alternate embodiment of the disclosure.
Figure 20B:
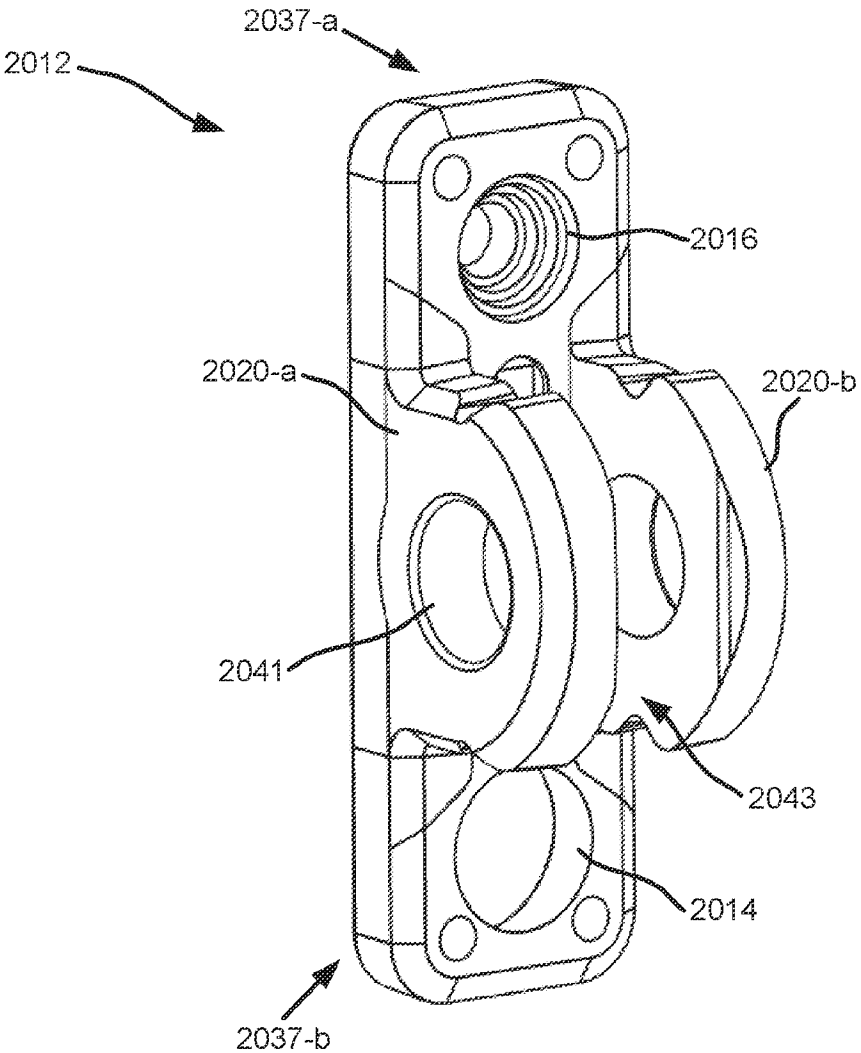
FIG. 20B illustrates a perspective view of an aperture mechanism showing tabs for coupling the aperture mechanism to a windage screw, according to an alternate embodiment of the disclosure.
Figure 21:
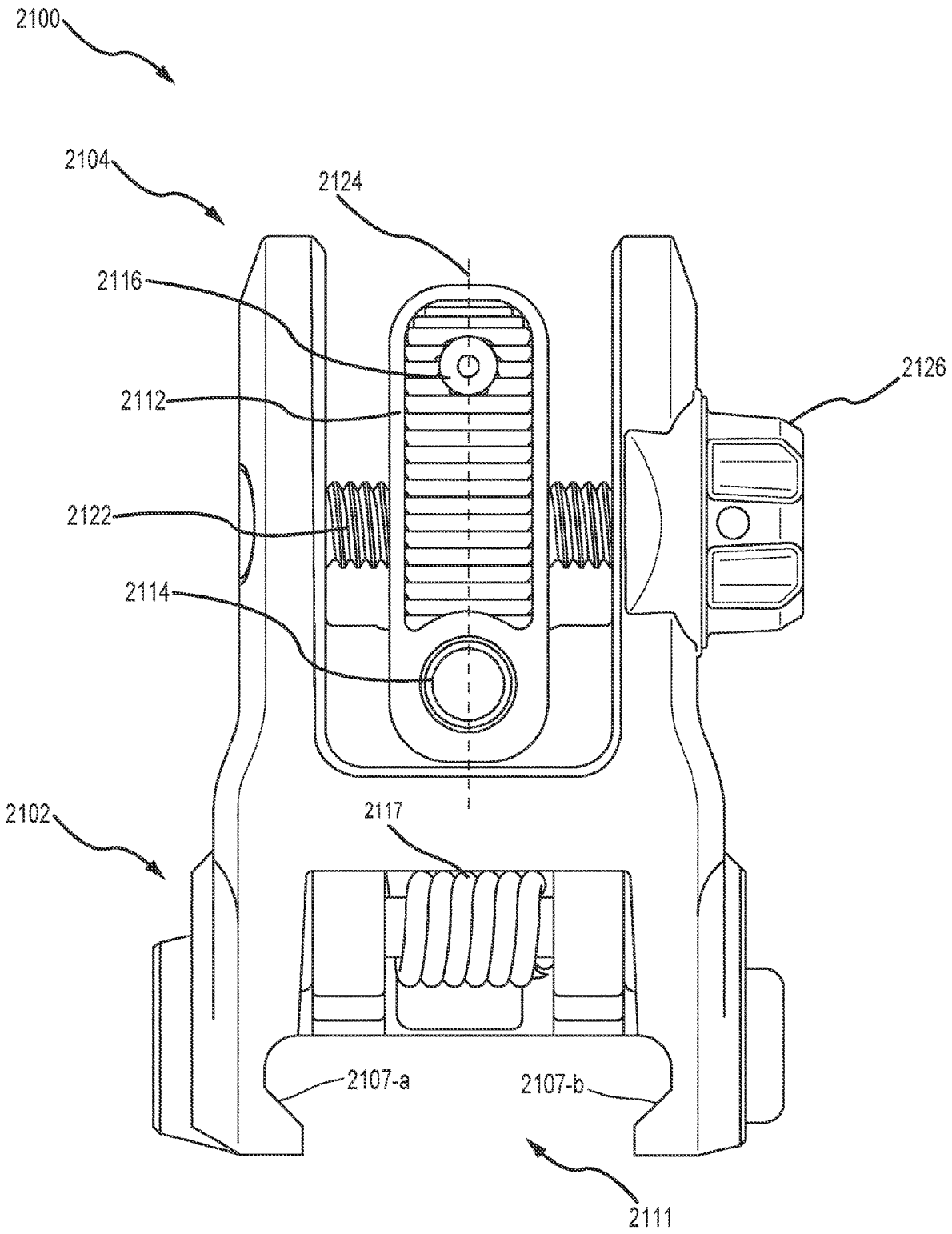
FIG. 21 illustrates a rear view of the rear sight in FIG. 18, according to an embodiment of the disclosure.

FIGS. 19-21 provide further illustrations and details surrounding overcoming of the windage shift misalignment when flipping between the large and small apertures.

Turning now to FIG. 19 which illustrates a front view of a rear flip-up sight 1900 of a sighting system, according to an embodiment of the disclosure. The rear flip-up sight 1900 may be similar or substantially similar to the rear flip-up sight 1800 described in relation to FIG. 18, or to any of the other rear flip-up sights described herein. As seen, the rear sight 1900 comprises two rear arms (e.g., rear arm 1908, rear arm 1910), an opening 1906, a windage knob 1926, a windage screw 1922, and an aperture mechanism 1912. In some cases, the aperture mechanism 1912 may comprise two apertures, e.g., a larger aperture 1916 and a smaller aperture (not visible but shown as aperture 1814 in FIG. 18). Further, the two apertures having different sizes may be arranged on opposing ends of the aperture mechanism 1912.

In some embodiments, the windage screw 1922 may pass through each of the two rear arms 1908, 1910, as well as the aperture mechanism 1912 of the rear flip-up portion. Further, the windage knob 1926 may be coupled to the windage screw 1922 and may be arranged on an outside face of one of the two rear arms (e.g., rear arm 1908) of the rear flip-up portion. In some cases, the aperture mechanism 1912 may be configured to flip or rotate 180 degrees around the windage screw 1922 when the windage knob 1926 is rotated. To mitigate the lateral shift issue, the rear flip-up portion comprises one or more tabs (e.g., first tab 1920-*a*, second tab 1920-*b*, third tab 1920-*c*) positioned within the opening (e.g., shown as opening 1806 in FIG. 18) between the two arms. In some cases, one or more of the tabs (e.g., tab 1920-*c*) may be a threaded tab. Although not necessary, in some cases, the threaded tab (e.g., tab 1920-*c*) may be positioned between the first and the second non-threaded tabs 1920-*a*, 1920-*b*. The threaded tab may be configured to move laterally along the windage screw 1922 when one or more of the windage knob 1926 and the windage screw 1922 rotate. Additionally, or alternatively, the aperture mechanism 1912 may be slidably coupled to the windage screw 1922 via at least one of the first tab 1920-*a* and the second tab 1920-*b*. For example, when the windage knob 1926 is rotated, the windage screw 1922 may likewise rotate, and the threaded tab 1920-*c* may laterally move along the windage screw 1922. Further, the paddle-like aperture 1912 may be slidably coupled to the windage screw 1922 via two tabs 1920 (e.g., first tab 1920-*a*, second tab 1920-*b*) each having a non-threaded aperture therein, which may be shaped and sized to allow the windage screw 1922 to pass through the non-threaded aperture mechanism 1912. In some embodiments, these two tabs 1920 may be spaced apart to allow the threaded tab 1920-*c* to rest between them. In some circumstances, when the threaded tab 1920-*c* moves laterally it pushes against an inside edge of one of the other two tabs 1920 (i.e., tab 1920-*a*, tab 1920-*b*) causing the paddle-like aperture 1912 to move laterally with the threaded tab 1920-*c*. In this way, rotation of the windage knob 1926 causes lateral movement of the paddle-like aperture or aperture mechanism 1912 without it being subject to unwanted shift when it is flipped. In some cases, such a design may also allow the first and the second apertures of the aperture mechanism to be aligned along the same vertical axis, which may be less distracting and/or more aesthetically pleasing to some users.

In some cases, the tabs 1920 of the rear flip-up sight 1900 may also comprise one or more notches (e.g., notch 1954 of third tab 1920-*c*). Further, the rear flip-up sight 1900 may also comprise an upward biased detent 1921 (also shown as detent 3310 in FIG. 33). In some embodiments, the interfacing between the notch 1954 at or near the bottom of the tab 1920-*c* and the top edge (e.g., shown as top edge 3356 in FIG. 33) of the detent 1921 may help guide lateral movement of the threaded tab 1920-*c* along the windage screw 1922, further described below in relation to FIG. 33.

FIG. 20A illustrates a detailed perspective view of a rear flip-up portion 2004, according to an embodiment of the disclosure. In some cases, the rear flip-up portion 2004 may implement one or more aspects of the rear flip-up portion 1904 of rear sight 1900 in FIG. 19. As seen, the rear flip-up portion 2004 comprises two rear arms 2008, 2010 having an opening 2006 between them. Further, an aperture mechanism 2012 (also referred to as a paddle-like aperture 2012) and a plurality of tabs 2020 (e.g., tabs 2020-*a* and 2020-*b*, which may be examples of non-threaded tabs; tab 2020-*c*, which may be an example of a threaded tab or a center-threaded nut) are positioned in the opening 2006 between the two rear arms. In some embodiments, the threaded tab 2020-*c* may be positioned between the two non-threaded tabs 2020-*a* and 2020-*b*. FIG. 20A also shows a windage knob 2026 on an outside face of rear arm 2008 and a windage screw 2022. The windage screw 2022 passes through each of the two rear arms 2008, 2010 and is coupled to the windage knob 2026. In some embodiments, the aperture mechanism 2012 is configured to pivot or flip (e.g., rotate 180 degrees) around the windage screw 2022 when the windage knob is rotated. In some cases, the aperture mechanism 2012 is slidably coupled to the windage screw 2022 via at least one of the first tab 2020-*a* and the second tab 2020-*b*. In addition to the aperture symmetry (e.g., small aperture 2014 and large aperture 2016 are aligned along the same vertical axis), the aperture mechanism 2012 may also be designed to be symmetrical in its weight distribution. For instance, in some embodiments, the first tab 2020-*a* and the second tab 2020-*b* extend from the same face of the aperture mechanism 2012. In one non-limiting example, the tabs 2020-*a* and 2020-*b* extend from the distal face (i.e., side or direction associated with direction of firing) of the aperture mechanism 2012. Further, the tabs 2020-*a* and 2020-*b* may be positioned midway or roughly midway between the opposing ends (e.g., shows as ends 2037-*a* and 2037-*b* in FIG. 20B) of the aperture mechanism. In other words, the center of an opening (e.g., opening 2041 in FIG. 20B) of each of the tabs 2020-*a* and 2020-*b* may be midway or roughly midway between the two ends 2037 of the aperture mechanism.

Additionally, or alternatively, as seen in FIGS. 20B and 20C, the aperture mechanism 2012 may be unitary in construction with the first and the second tabs 2020-*a* and 2020-*b* (e.g., non-threaded tabs), while the tab 2020-*c* (e.g., threaded tab) may be a separate piece. FIG. 20B illustrates a detailed view of the aperture mechanism 2012 comprising a first end 2037-*a* having aperture 2016 (e.g., a smaller aperture) and a second end 2037-*b* having aperture 2014 (e.g., a larger aperture). In some cases, the aperture mechanism 2012 may further comprise non-threaded tabs 2020-*a* and 2020-*b*, each having a non-threaded opening 2041 shaped and sized to allow a windage screw (e.g., shown as windage screw 2022 in FIG. 20A) to pass through. As seen, the first and second non-threaded tabs 2020-*a* and 2020-*b* may be formed as a unitary construction with the aperture mechanism 2012 and may enable the aperture mechanism to slidably couple to the windage screw.

FIG. 20C illustrates a detailed view of the threaded tab 2020-*c* of the rear flip-up portion. As seen, the threaded tab 2020-*c* comprises a threaded opening 2042, where the threaded opening 2042 is shaped and sized to receive the windage screw. In some cases, the threaded tab 2020-*c* may be shaped and sized to fit in an opening (e.g., shown as opening 2043 in FIG. 20B) between the first and second non-threaded tabs 2020-*a* and 2020-*b*. In such cases, the threaded opening 2042 of the tab 2020-*c* may be aligned with the non-threaded openings 2041 of each of tabs 2020-*a* and 2020-*b* so that the windage screw can pass through the tabs 2020. In some embodiments, the radius of the opening 2042 may be the same or roughly the same as the radius of the opening 2041.

FIG. 21 illustrates a rear view of a rear flip-up sight 2100 of a sighting system, according to an embodiment of the disclosure. In some cases, the rear flip-up sight 2100 (or simply, rear-sight 2100) may be similar or substantially similar to rear-sight 1800, rear-sight 1900, and/or rear-sight 2000, previously described in relation to FIGS. 18, 19, and/or 20A-C, respectively. As noted above, the lateral movement of the aperture mechanism, such as aperture mechanism 2112, with the threaded tab (e.g., shown as threaded tab 2020-*c* in FIGS. 20A and C) may serve to counter the lateral shift introduced due to rotation of windage knob 2126 and/or windage screw 2122. Thus, as seen in FIG. 21, this means that the small and large apertures 2116, 2114 can be aligned along the same vertical axis 2124, and no offset between them or a jog in the paddle-like aperture 2112 is needed. For instance, the threaded tab (e.g., tab 2020-*c* in FIG. 20C) positioned between the first and second non-threaded tabs (e.g., tabs 2020-*a*, 2020-*b* in FIG. 20B) may be configured to move laterally along the windage screw 2122 when one or more of the windage knob 2126 and the windage screw 2122 rotate. In such cases, the rotation of the windage knob 2126 may further cause one or more of: the threaded tab to push against an inside edge of one of the first non-threaded tab (e.g., tab 2020-*a* in FIG. 20B) and the second non-threaded tab (e.g., tab 2020-*b* in FIG. 20B); and lateral movement of the aperture mechanism or paddle-like aperture 2112 with the threaded tab. Currently used flip-up sights with small and large apertures often utilize an offset between the small and large apertures to compensate for the lateral shift of the aperture mechanism along the windage screw when the windage knob is rotated. However, by utilizing a threaded tab that rotates in the same direction as the windage screw, the lateral shift (e.g., in the right direction) of the aperture mechanism may be compensated by laterally moving the aperture mechanism in the opposite direction (e.g., in the left direction) by the same or similar lateral shift. In this way, the rear flip-up sight of the present disclosure may enable a user to maintain a consistent aiming point, for instance, after flipping between the large and small apertures, despite the apertures being aligned along the same vertical axis 2124.

Figure 26:
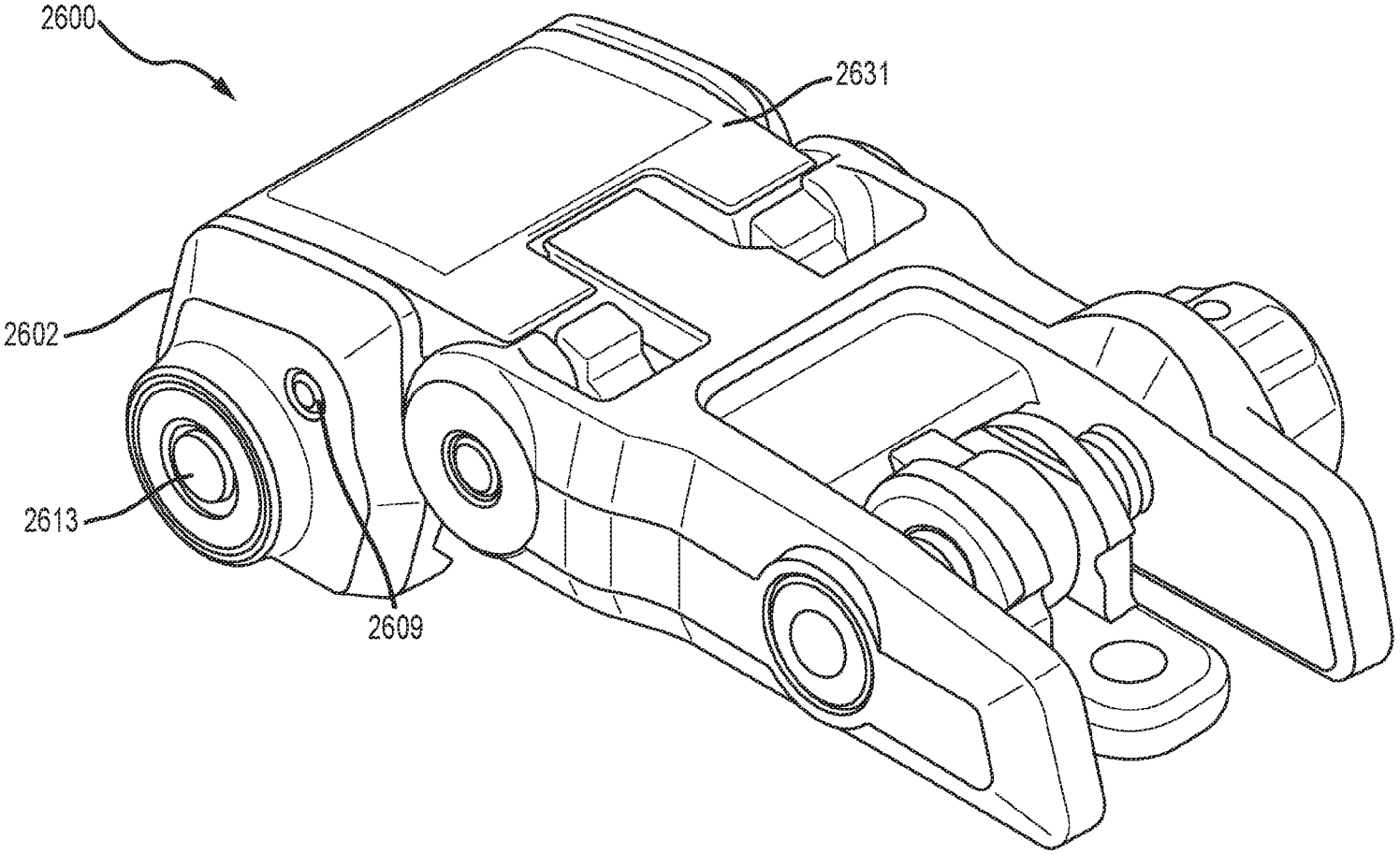
FIG. 26 illustrates a perspective view of a rear sight of a sighting system in a stowed position, according to an embodiment of the disclosure.

As shown in FIG. 21, the rear flip-up sight 2100 further comprises a base 2602, guide surfaces 2107 (e.g., guide surface 2107-*a*, guide surface 2107-*b*), a channel 2111, an actuator (e.g., shown as actuator 2613 in FIG. 26), and a hinge pin (e.g., shown as hinge pin 2609 in FIG. 26). The base 2602 may be similar or substantially similar to the base 1802 previously described in relation to FIG. 18. In some cases, the rear flip-up sight 2100 may be configured to be mounted on an accessory mounting rail, such as a Picatinny rail. The width of the channel 2111 or the distance between opposing guide surfaces 2107 (also referred to as rail-engaging surfaces) may be varied using the actuator. In some cases, a user may place the rear flip-up sight 2100 on an accessory mounting rail such that the rail is within the channel 2111 (e.g., surrounded on three sides by the channel 2111). The user may then tighten or clamp the base 2102 over the rail using the actuator to secure the rear flip-up sight 2100 in place. In some examples, the hinge pin may allow the rear flip-up portion 2104 to pivot between a stowed position (e.g., in FIG. 26) and a deployed position (e.g., in FIG. 18). In some embodiments, the hinge pin may be spring-loaded (e.g., using spring 2117, using spring 3217 in FIG. 32), and the hinge mechanism (e.g., hinge pin 2609 and the spring 3217) may be controlled using a tab (e.g., shown as tab 1027 in FIG. 10) provided on the side of the rear flip-up sight 2100. A user may press on the tab to bias the rear flip-up portion 2104 to the up (or deployed position).

Figure 22:
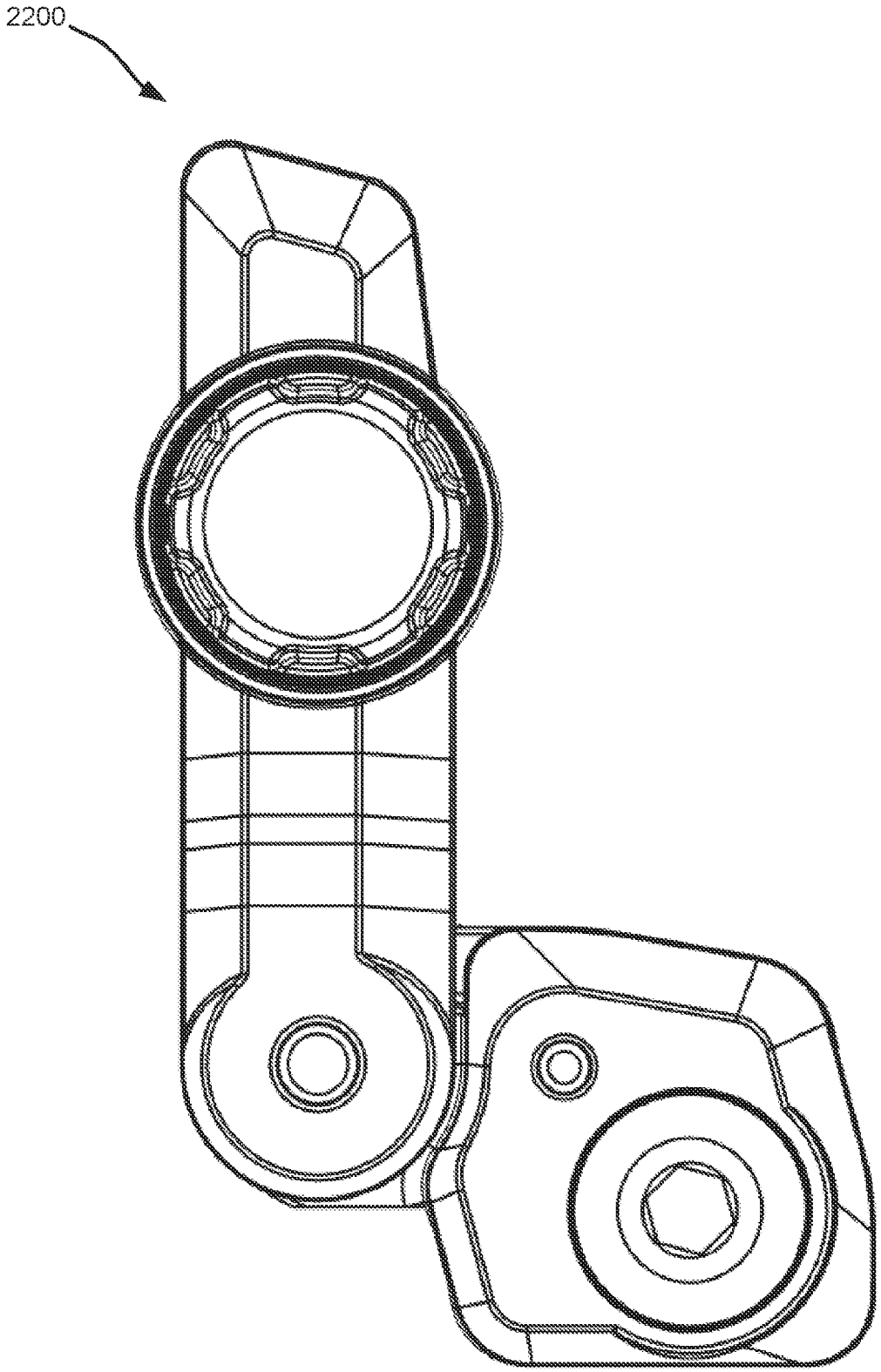
FIG. 22 illustrates a side view of the rear sight in FIG. 18, according to an embodiment of the disclosure.
Figure 23:
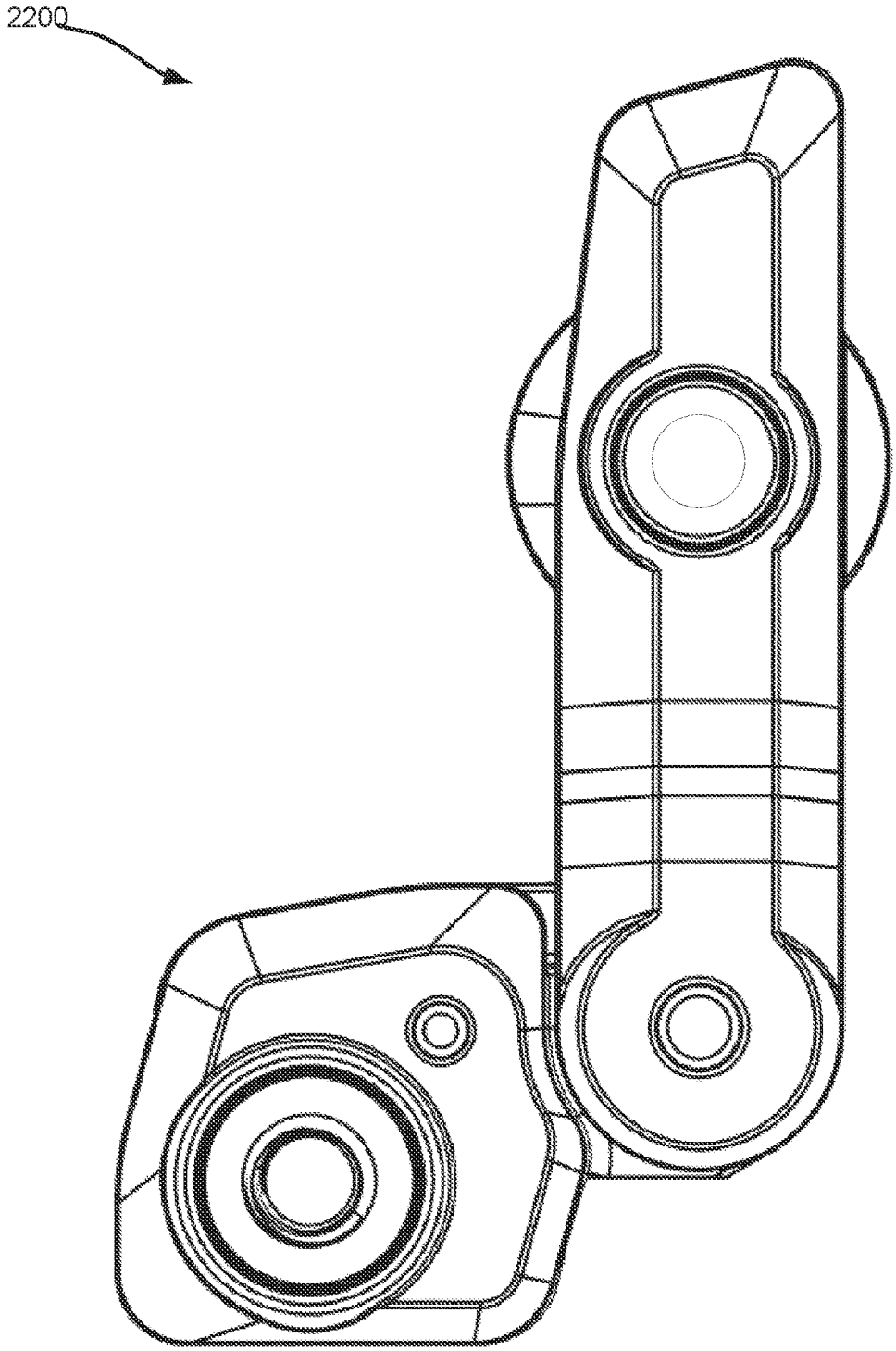
FIG. 23 illustrates another side view of the rear sight in FIG. 18, according to an embodiment of the disclosure.

FIG. 22 illustrates a side view of a rear flip-up sight 2200 of a sighting system, according to an embodiment of the disclosure. Rear flip-up sight 2200 may be similar or substantially similar to the rear flip-up sights 1800, 1900, 2000, and/or 2100, previously described in relation to FIGS. 18-21. FIG. 23 illustrates another side view of the rear flip-up sight 2200, according to an embodiment of the disclosure.

Figure 24:
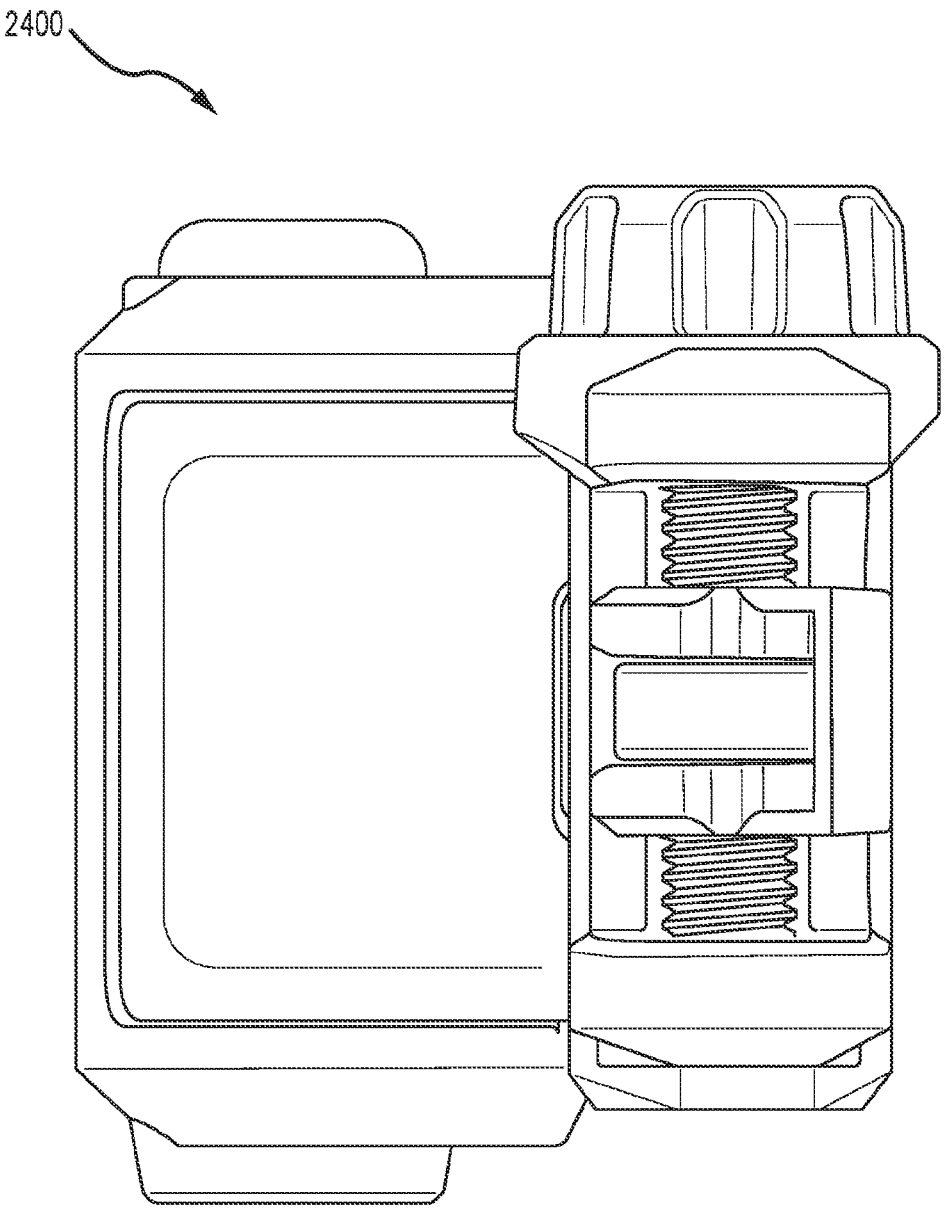
FIG. 24 illustrates a top view of the rear sight in FIG. 18, according to an embodiment of the disclosure.

FIG. 24 illustrates a top view of a rear flip-up sight 2400 of a sighting system, according to an embodiment of the disclosure. Rear flip-up sight 2400 may be similar or substantially similar to the rear flip-up sights 1800, 1900, 2000, and/or 2100, previously described in relation to FIGS. 18-21.

Figure 25:
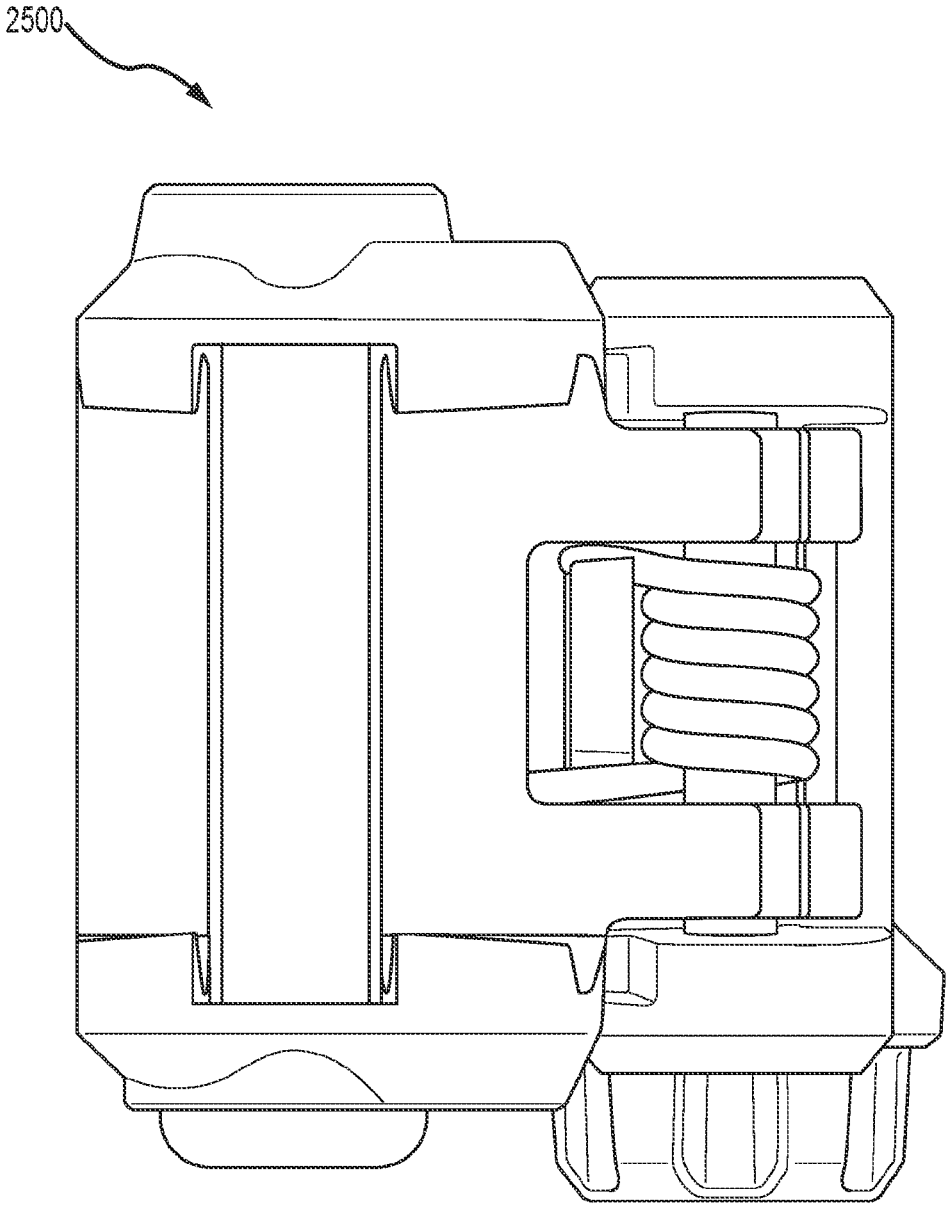
FIG. 25 illustrates a bottom view of the rear sight in FIG. 18, according to an embodiment of the disclosure.

FIG. 25 illustrates a bottom view of a rear flip-up sight 2500 of a sighting system, according to an embodiment of the disclosure. Rear flip-up sight 2500 may be similar or substantially similar to the rear flip-up sights 1800, 1900, 2000, and/or 2100, previously described in relation to FIGS. 18-21.

Figure 27:
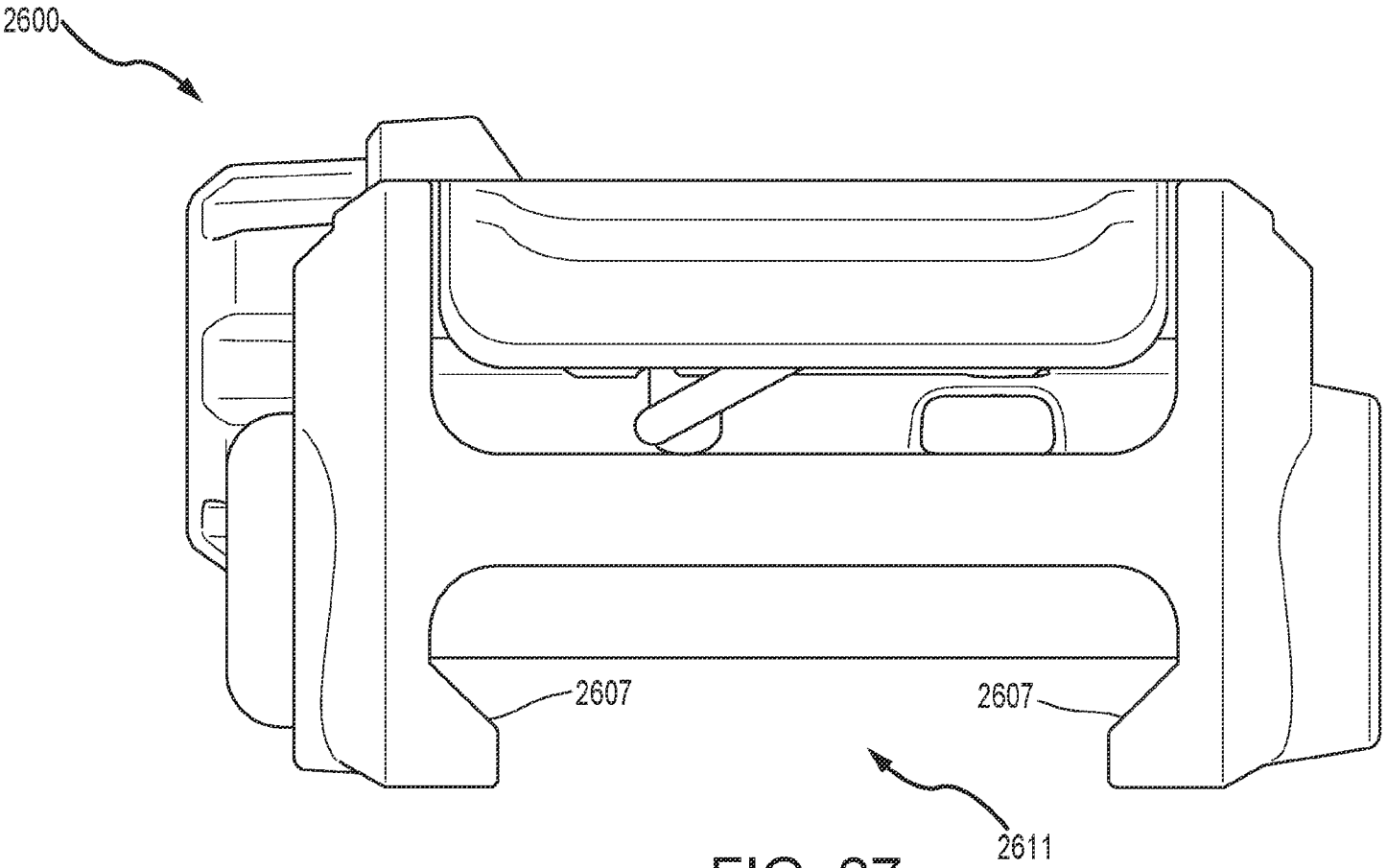
FIG. 27 illustrates a front view of the rear sight in FIG. 26, according to an embodiment of the disclosure.

FIG. 26 illustrates a perspective view of a rear flip-up sight 2600 of a sighting system in a stowed position, according to an embodiment of the disclosure. Similar to the front flip-up sight described earlier, the rear-sight or rear flip-up sight 2600 may be configured to be flipped between a deployed and a stowed position. FIGS. 26-32 illustrate various views of the rear flip-up sight in the stowed position. The rear flip-up sight 2600 may be similar or substantially similar to the rear flip-up sight 1800 described in relation to FIG. 18. As shown in FIGS. 26 and 27, the rear flip-up sight 2600 comprises a base 2602, guide surfaces 2607, a channel 2611, a mounting screw 2613, a latch 2631 (also referred to as a deployment lever 2631), and a hinge pin 2609. The base 2602 may be similar or substantially similar to the base 1802 previously described in relation to FIG. 18. In some cases, the rear flip-up sight 2600 may be configured to be mounted on an accessory mounting rail, such as a Picatinny rail. The width of the channel 2611 or the distance between opposing guide surfaces 2607 (also referred to as rail-engaging surfaces) may be varied using the actuator 2613. In some cases, a user may place the rear flip-up sight 2600 on an accessory mounting rail such that the rail is within the channel 2611. The user may then tighten or clamp the base 2602 over the rail using the actuator 2613 to secure the rear flip-up sight 2600 in place. In some examples, the hinge pin 2609 may allow the rear flip-up portion 2604 to pivot between a stowed position (e.g., in FIG. 26) and a deployed position (e.g., in FIG. 18). In some embodiments, the hinge pin 2609 may be spring-loaded (e.g., using spring 2117 in FIG. 21, using spring 3217 in FIG. 32), and the hinge mechanism (i.e., the hinge pin 2609 and the spring 3217) may be controlled using a latch (or another applicable mean(s)) provided on the top side of the base 2602 of the rear flip-up sight 2600. A user may press on the latch 2631 to bias the rear flip-up portion (e.g., shown as rear flip-up portion 2104 in FIG. 21) to the up (or deployed position). In some cases, the latch 2631 may be similar or substantially similar to the latch 831 and/or latch 931 described in relation to FIGS. 8 and/or 9, respectively. It should be noted that other applicable means besides a latch, such as a button, a lever, a slide, etc., may be utilized in different embodiments.

Figure 28:
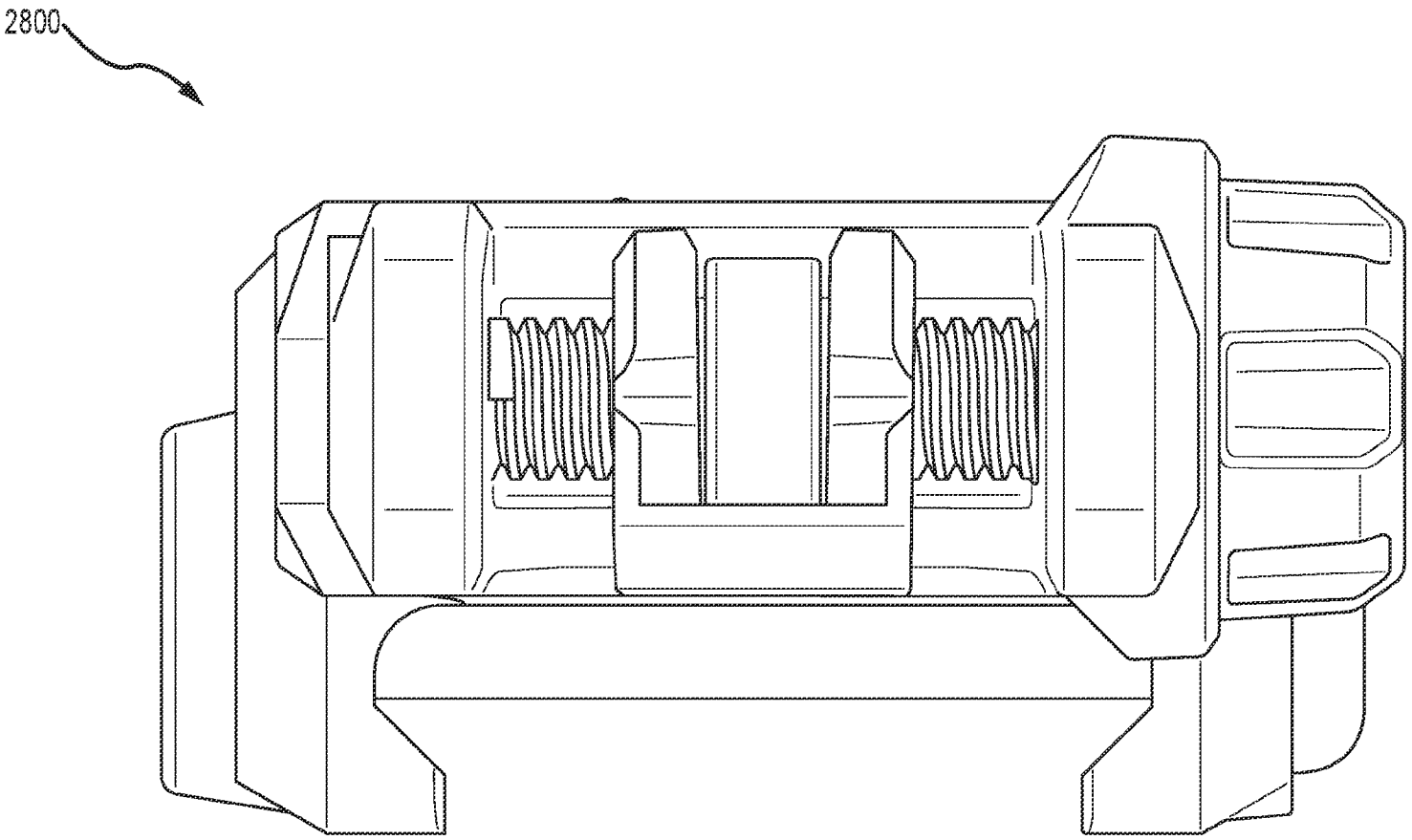
FIG. 28 illustrates a rear view of the rear sight in FIG. 26, according to an embodiment of the disclosure.

FIG. 27 illustrates a front view of the rear flip-up sight 2600 in the stowed position, according to an embodiment of the disclosure. In some cases, the rear flip-up sight 2600 may be similar or substantially similar to the rear flip-up sights 1800, 1900, 2000, 2100, and/or 2600, previously described in relation to FIGS. 18-21 and/or 26, respectively. FIG. 28 illustrates a rear view of a rear flip-up sight 2800, according to an embodiment of the disclosure. In some cases, the rear flip-up sight 2800 may be similar or substantially similar to the rear flip-up sights 1800, 1900, 2000, 2100, and/or 2600, previously described in relation to FIGS. 18-21 and/or 26, respectively.

Figure 29:
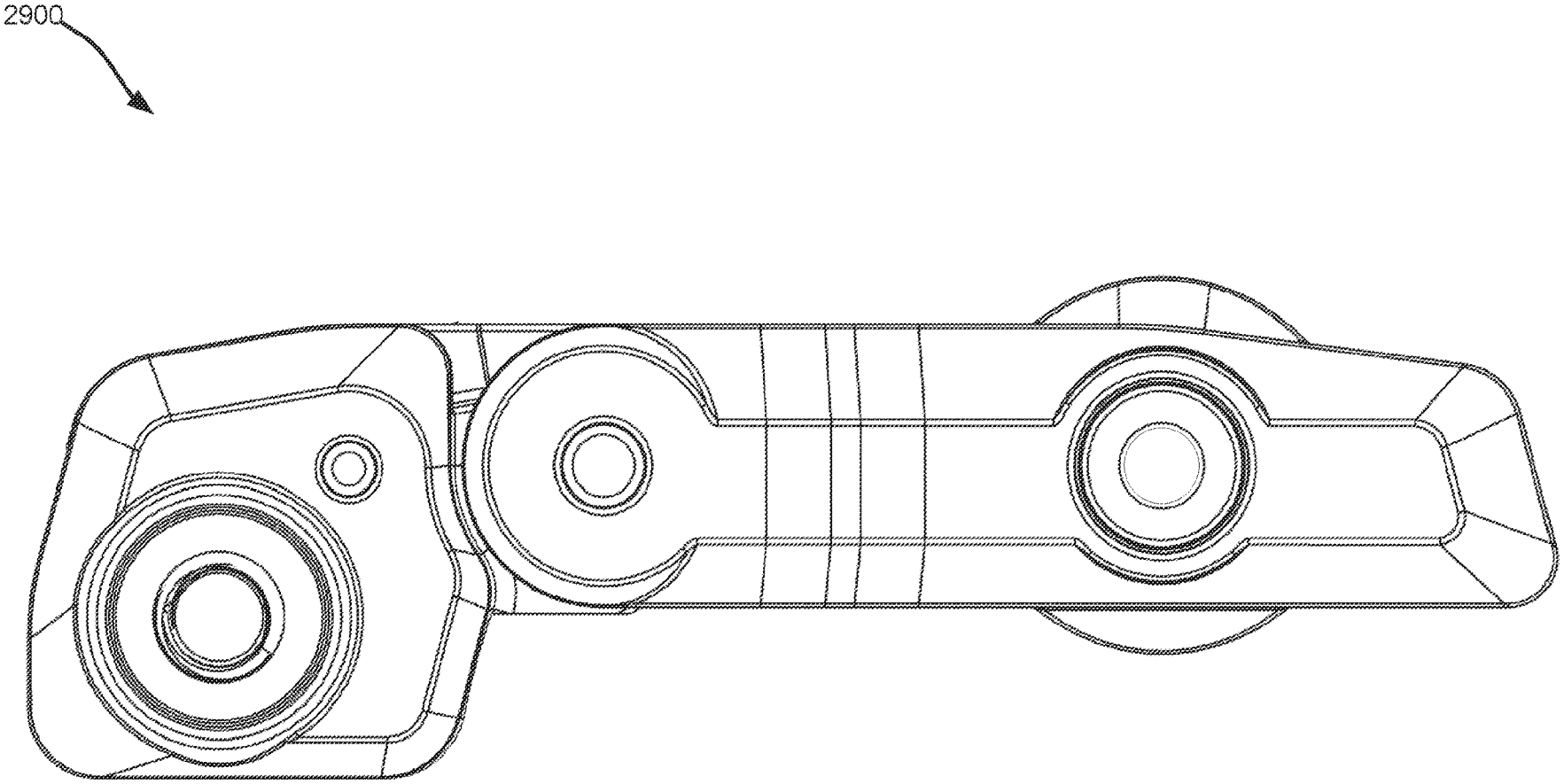
FIG. 29 illustrates a side view of the rear sight in FIG. 26, according to an embodiment of the disclosure.

FIG. 29 illustrates a side view of a rear flip-up sight 2900 of a sighting system in the stowed position, according to an embodiment of the disclosure. Rear flip-up sight 2900 may be similar or substantially similar to the rear flip-up sights

Figure 30:
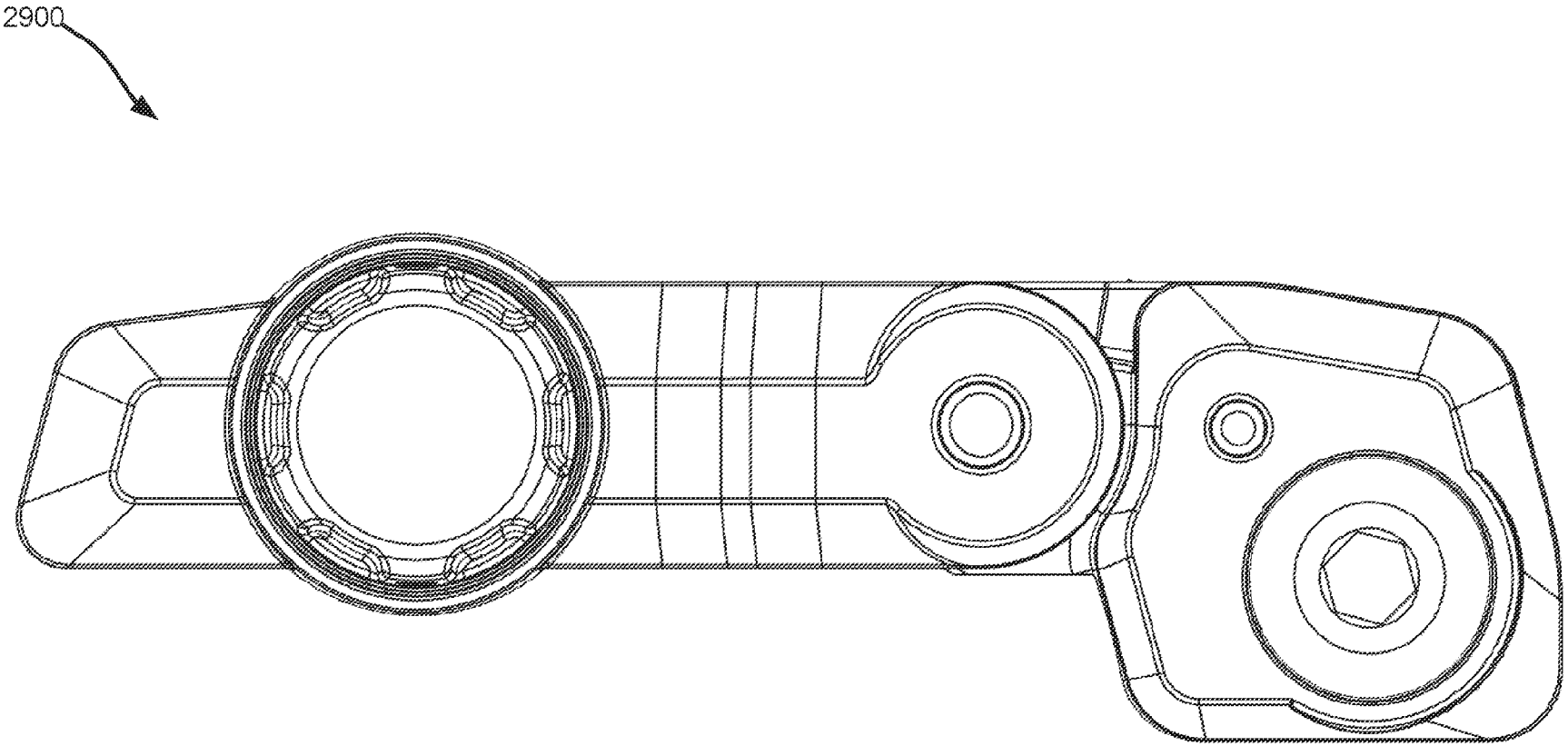
FIG. 30 illustrates another side view of the rear sight in FIG. 26, according to an embodiment of the disclosure.

1800, 1900, 2000, 2100, and/or 2600, previously described in relation to FIGS. 18-21 and/or 26, respectively. FIG. 30 illustrates another side view of the rear flip-up sight 2900, according to an embodiment of the disclosure.

Figure 31:
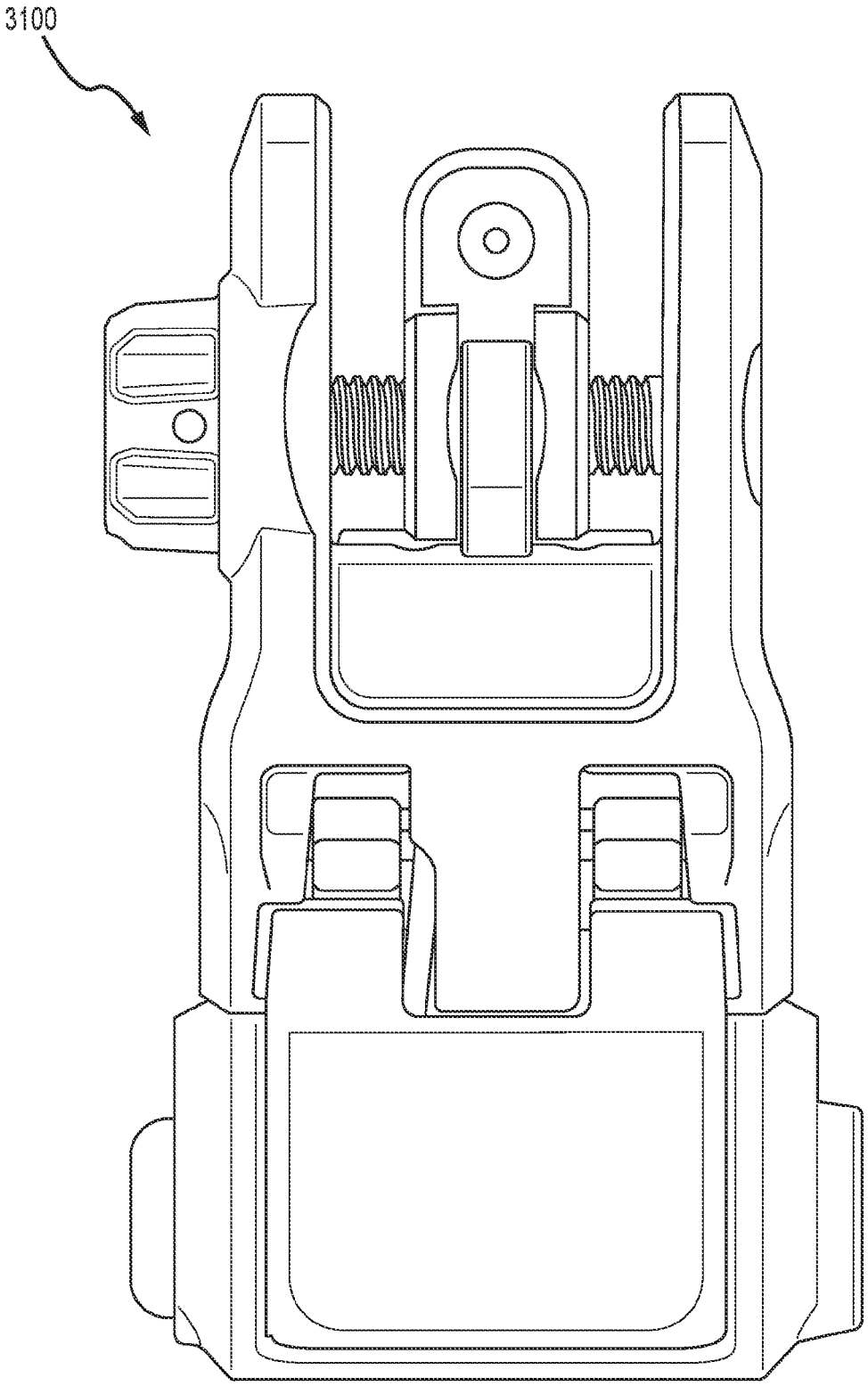
FIG. 31 illustrates a top view of the rear sight in FIG. 26, according to an embodiment of the disclosure.

FIG. 31 illustrates a top view of a rear flip-up sight 3100 of a sighting system, according to an embodiment of the disclosure. Rear flip-up sight 3100 may be similar or substantially similar to the rear flip-up sights 1800, 1900, 2000, 2100, and/or 2600, previously described in relation to FIGS. 18-21 and/or 26, respectively.

Figure 32:
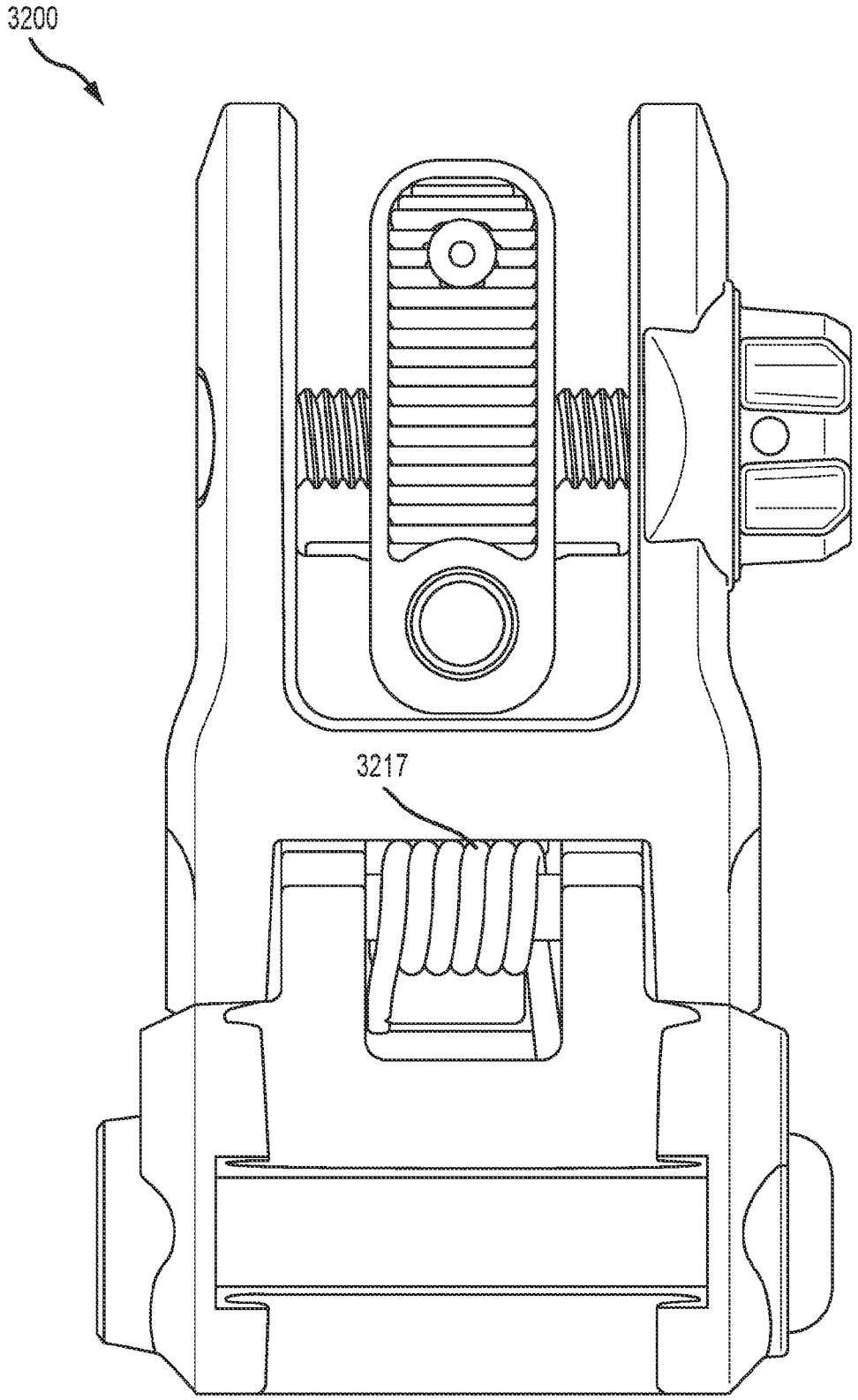
FIG. 32 illustrates a bottom view of the rear sight in FIG. 26, according to an embodiment of the disclosure.

FIG. 32 illustrates a bottom view of a rear flip-up sight 3200 showing the spring 3217, according to an embodiment of the disclosure. In some cases, the spring 3217 may assist in flipping the rear sight 3200 from a stowed to a deployed position and vice-versa. The spring 3217 may be similar or substantially similar to the spring 2117 described in relation to FIG. 21. Furthermore, rear flip-up sight 3200 may be similar or substantially similar to the rear flip-up sights 1800, 1900, 2000, 2100, 2600, and/or 3100, previously described in relation to FIGS. 18-21, 26, and/or 31, respectively.

Compact Windage Detent

As noted above, there is also a need in the art to provide a more compact windage adjustment knob in light of the volume taken up by a separate spring and detent. In some embodiments, this disclosure uses a ring-shaped leaf spring with built-in detents, the leaf spring configured to function as both the spring and detent, which serves to optimize the lateral size of the windage knob and/or reduce the number of individual parts used to assemble the rear flip-up sight.

Figure 33:
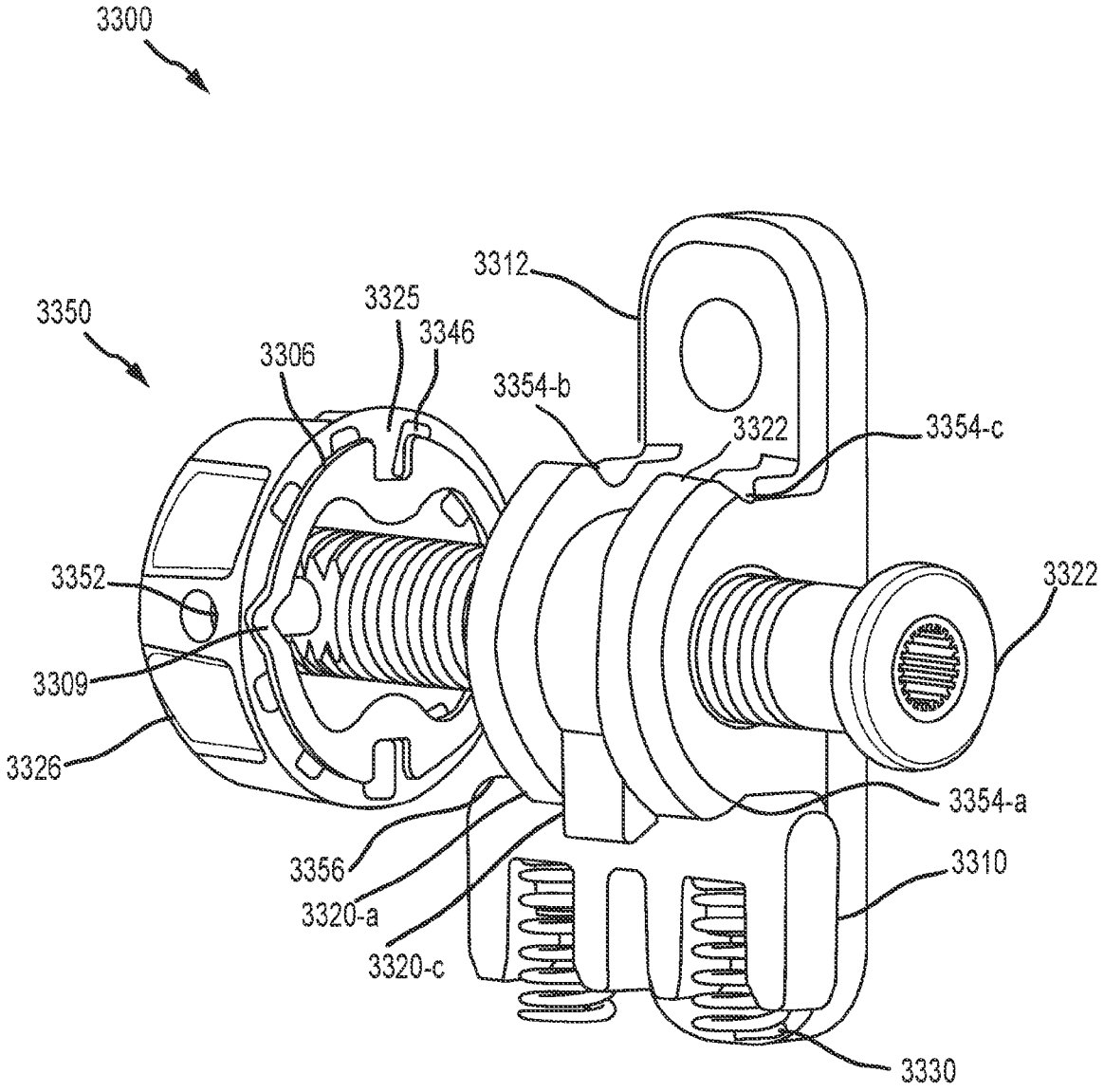
FIG. 33 illustrates a detailed perspective view of a windage knob and a leaf spring of a rear sight, according to an embodiment of the disclosure.

FIG. 33 illustrates a rear flip-up sight 3300 showing details of the windage detent mechanism, according to an embodiment of the disclosure. As seen, the rear flip-up sight 3300 comprises an aperture mechanism 3312 (also referred to as, paddle-like aperture 3312) and a windage detent mechanism 3350, the windage detent mechanism comprising a windage knob 3326, a windage screw 3322, and a circular leaf spring 3306 (also referred to as, leaf spring 3306). It should be noted that, other types of leaf springs besides a circular leaf spring may be implemented in different embodiments and the use or mention of a circular leaf spring is not intended to be limiting. In some embodiments, the circular leaf spring 3306 may be configured to provide tactile feedback to a user, for instance, when the windage knob 3326 is rotated. Additionally, or alternatively, the leaf spring 3306 may assist the windage knob 3326 in staying locked in one or more pre-defined positions. In some circumstances, the circular leaf spring 3306 may also help create pressure that prevents or minimizes lateral shifting of the windage screw 3322. In some embodiments, the windage knob 3326 may include a plurality of notches 3346 that may be equally spaced along (or near) a perimeter of the windage knob 3326, for example, on a face of the windage knob 3326 facing inward toward tabs 3320. As can be appreciated, the spacing of these notches 3346 may vary depending on the granularity of windage selection desired. In some cases, the windage knob 3326 may be coupled to the windage screw 3322 via a pin 3352 (or any other applicable coupling device) such that rotation of the windage knob 3326 results in corresponding rotation of the windage screw 3322 and thus lateral movement of the aperture mechanism or paddle-like aperture 3312.

In some cases, the radius of the circular leaf spring 3306 may be less than the outer radius of the windage knob 302. Additionally, or alternatively, the circular leaf spring 3306 may comprise one or more angled detents 3309 along its outer perimeter. The one or more angled detents 3309 may be shaped to engage, or fit into, the notches 3346, which may serve to provide tactile feedback to a user as the windage knob 3326 is rotated and/or to hold the windage knob 3326 in a selected position. In some embodiments, the circular leaf spring 3306 may be formed from a thin flexible material, such as thin sheet of metal (e.g., steel, aluminum, stainless steel, etc.) or any other applicable material. Further, the thickness of the circular leaf spring 3306 may be selected so that the one or more angled detents 3309 may be pushed inward and parallel (or substantially parallel) to a longitudinal axis of the windage screw 3322 when not aligned with one of the notches 3346, which may serve to create an outward bias force on the one or more angled detents 3309.

Figure 35:
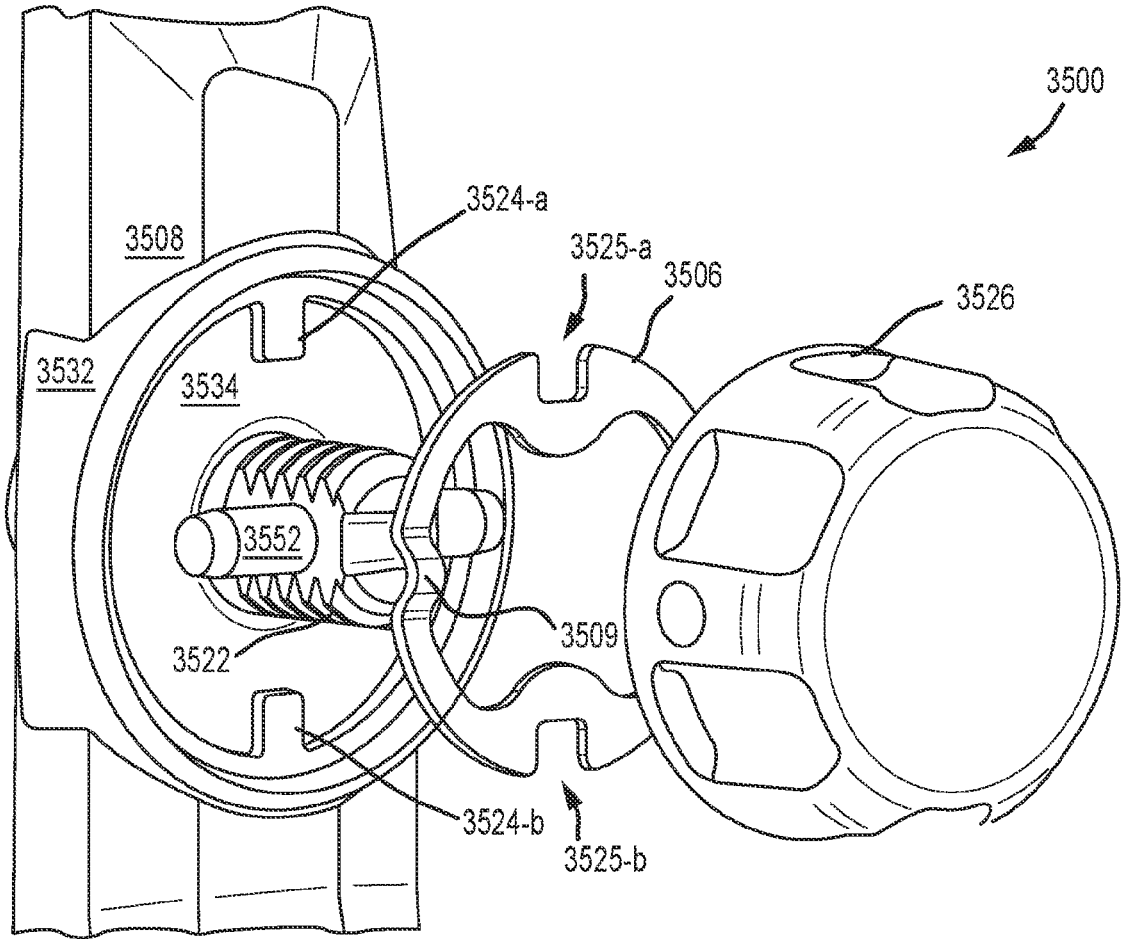
FIG. 35 illustrates an exploded view of the windage knob and leaf spring in FIG. 33, according to an alternate embodiment of the disclosure.

Turning now to FIG. 35, which illustrates an exploded view of a windage detent mechanism 3500 of a rear flip-up sight, according to an embodiment of the disclosure. The windage detent mechanism 3500 may be similar or substantially similar to windage detent mechanism 3350 previously described in relation to FIG. 33. As seen, the windage detent mechanism 3500 comprises a windage knob 3526, a windage screw 3522, a pin 3552 for coupling the windage screw 3522 to the windage knob 3526, and a leaf spring 3506. The leaf spring 3506 may be similar or substantially similar to the circular leaf spring 3306 previously described in relation to FIG. 33 and may comprise one or more angled detents 3509 and/or apertures 3525 (e.g., aperture 3525-*a*, aperture 3525-*b*) along its outer perimeter. In some embodiments, the arm (e.g., rear arm 3508) of the rear flip-up sight may include a circular boss 3532 having a slightly larger radius than that of the windage knob 3526. The circular boss 3532 may include a concentric recess 3534 for receiving the leaf spring 3506. In some embodiments, the circular boss 3532 may also include one or more protrusions 3524 (e.g., protrusion 3524-*a*, protrusion 3524-*b*), where the one or more protrusions 3524 may be shaped and sized to match the one or more apertures 3525 in the leaf spring 306. In some cases, the interfacing between the one or more protrusions 3524 and the apertures 325 may help minimize or prevent rotation of the leaf spring 3506 within the circular boss 3532. In the example shown, protrusions 3524 and apertures 3525 are rectangular, although other shapes, such as square, triangle or wedge shaped, trapezoid, etc., can also be implemented in different embodiments. In some aspects, the use of the leaf spring 3506, such as a circular leaf spring, having built in angled detents 3509 may allow for a more compact windage detent assembly than seen with traditional ball detent mechanisms.

Aperture Flip Detent

Figure 34:
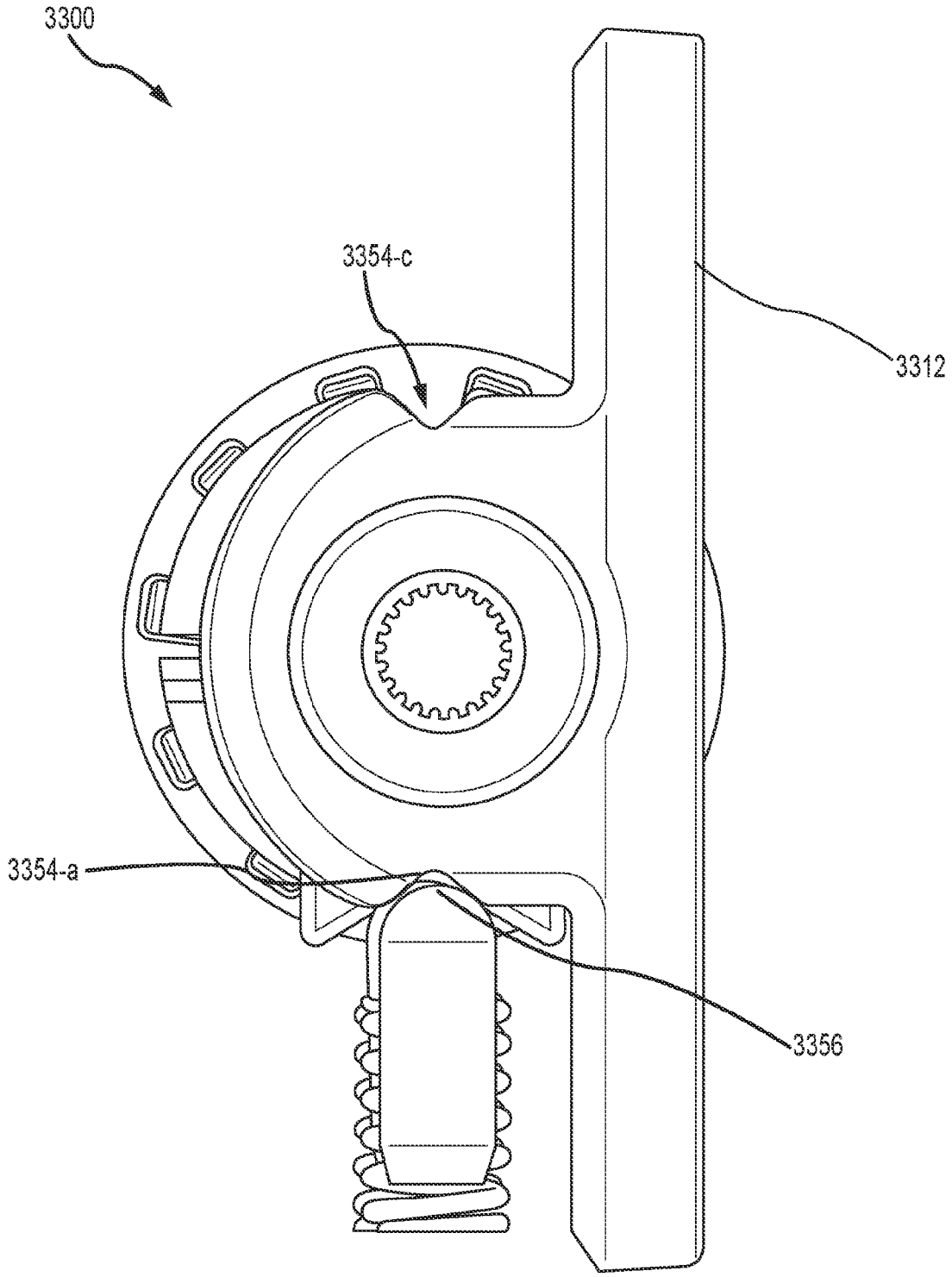
FIG. 34 illustrates a side view of the windage knob and leaf spring in FIG. 33, according to an embodiment of the disclosure.

FIGS. 33 and 34 show details of the windage knob 3326 and the leaf spring 3306 of the rear flip-up sight, according to an embodiment of the disclosure. As seen in FIG. 33, the rear flip-up sight 3300 comprises a vertically biased detent 3310 arranged below the tabs 3320 (e.g., threaded tab 3320-*c* and non-threaded tabs 3320-*a* and 3320-*b*). In some cases, this detent 3310 may be elongated in a vertical direction and laterally in a plane with the windage screw 3322. Further, the detent 3310 may be configured to be biased upward via one or more biasing components, such as coil springs 3330. In some circumstances, the coil springs 3330 may be configured to bias a top edge 3356 of the detent 3310 into notches 3354 (e.g., notch 3354-*a*) in the tabs 3320-*a*, 3320-*b* and/or into a notch (not visible) in the threaded tab 3320-*c*. The interfacing between the notch at or near the bottom of the threaded tab 3320-*c* and the top edge 3356 of the detent 3310 may help guide lateral movement of the threaded tab 3320-*c* along the windage screw 3322. In some instances, interfacing between the notches in the tabs

3320 and the top edge 3356 of the detent 3310 may also help provide tactile feedback to the user when the aperture mechanism or paddle-like aperture 3312 is flipped. Additionally, or alternatively, interfacing between the notches in the one or more tabs 3320 (e.g., tabs 3320-*a*, 3320-*b*, 3320-*c*) and the top edge of the detent may also help hold the paddle-like aperture 3312 in one of the two preferred positions (i.e., when either of the small or large apertures is selected, in which case a vertical axis through the small and large apertures is perpendicular or substantially perpendicular to a longitudinal axis through the firearm). In some examples, one or more of the tabs (e.g., tabs 3320-*a*, 3320-*b*) may also comprise one or more opposing notches 3354 (e.g., notches 3354-*b*, 3354-*c*) configured to interact with the top edge 3356 of the detent 3310. In one non-limiting example, the biased detent 3310 may be pushed downward and against the biasing components (e.g., coil spring(s) 3330), thus releasing the top edge 3356 of the detent 3310 from the notch 3354-*a* currently interfacing with the detent 3310. In such cases, the paddle-like aperture 3312 is free to flip over (or rotate) until the opposing notches (e.g., notches 3354-*b*, 3354-*c*) engage the biased detent 3310.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A sighting system for a firearm, comprising:

a front sight;

a rear sight;

wherein the front sight further comprises:

a first base;

a first flip-up portion, the first flip-up portion comprising two front arms and a horizontal connector connecting the two front arms, wherein the horizontal connector includes an aperture;

a knob comprising one or more notches on a first side of the knob;

a sight post extending from a second side of the knob, wherein the sight post is shaped and sized to extend at least partially through the aperture;

at least one detent and one or more protrusions, the at least one detent and one or more protrusions arranged to face the one or more notches, and wherein the one or more notches are shaped and sized to interact with one or more of the at least one detent and the one or more protrusions;

wherein the knob is configured to rotate about a first axis, the rotation causing one or more of:

tilting of the knob in a second direction, the tilting based at least in part on one or more of the at least one detent and the one or more protrusions interfacing with the one or more notches; and tilting of the sight post in the second direction, wherein the tilting of the sight post in the second direction forces at least a portion of the sight post to press against the aperture.

2. The sighting system of claim 1, wherein each of the sight post and the aperture comprise a plurality of angled faces, and wherein the tilting of the sight post in the second direction forces one or more angled faces of the sight post to press against one or more angled faces of the aperture.

3. The sighting system of claim 1, wherein the aperture is a diamond-shaped aperture.

4. The sighting system of claim 1, wherein the first flip-up portion further comprises:

a first opening and a second opening, wherein the first and the second openings are arranged between the two arms and separated by the horizontal connector, wherein the knob is rotationally arranged within the first opening, and wherein the sight post extends at partially through the aperture into the second opening.

5. The sighting system of claim 4, wherein the at least one detent is arranged below the knob and near a front or a rear of the first opening, and wherein the tilting of the knob and the sight post in the second direction comprises:

tilting forward when the at least one detent is arranged near the rear of the first opening, or tilting rearward when the at least one detent is arranged near a front of the first opening, wherein the forward or rearward tilting is based at least in part on the at least one detent pushing up on the knob.

6. The sighting system of claim 5, wherein the one or more notches comprises at least two notches arranged around an outer circumference of the knob, and wherein adjacent notches of the at least two notches are separated by a non-notched portion, wherein the non-notched portions of the knob are shaped and sized to pass over, and press against, the at least one detent when the knob is rotated.

7. The sighting system of claim 1, wherein the aperture is a diamond-shaped aperture comprising four corners and one or more circular cutouts, one circular cutout per corner.

8. The sighting system of claim 7, wherein the sight post comprises a diamond-shaped cross section, and wherein the aperture comprises four angled faces, and wherein the tilting of the sight post comprises:

applying a bias to the sight post, wherein the bias is arranged to split two of the four angled faces of the aperture and wedge or force the sight post to a centered position relative to a plane comprising a barrel axis and parallel to the barrel axis of the firearm.

9. The sighting system of claim 1, wherein the first axis passes through one or more of a center of the knob and a center of the sight post, and wherein a second axis passes through a center of the diamond-shaped aperture.

10. The sighting system of claim 9, wherein the first axis and the second axis tilt with respect to each other based at least in part on the tilting of the sight post, the tilting of the knob, or a combination thereof.

11. The sighting system of claim 1, wherein the rear sight comprises a second base and a second flip-up portion, the second flip-up portion further comprising:

two rear arms;

a third opening positioned between the two rear arms; and an aperture mechanism, wherein the aperture mechanism comprises a first end having a first rear aperture and a second end having a second rear aperture, wherein the first rear aperture is of a different size than the second rear aperture, and wherein the first aperture and the second aperture are aligned along a first vertical axis.

12. The sighting system of claim 11, further comprising:

a windage screw, the windage screw passing through each of the two rear arms of the second flip-up portion;

a windage knob coupled to the windage screw, wherein the windage knob is arranged on an outside face of one of the two rear arms of the second flip-up portion; and wherein the aperture mechanism is configured to flip around the windage screw when the windage knob is rotated.

13. The sighting system of claim 12, further comprising: a first tab and a second tab, and wherein the aperture mechanism is slidably coupled to the windage screw via at least one of the first tab and the second tab.

14. The sighting system of claim 13, further comprising:

a third tab positioned between the first tab and the second tab, wherein the third tab is a threaded tab configured to move laterally along the windage screw when one or more of the windage knob and the windage screw rotate.

15. The sighting system of claim 14, wherein rotation of the windage knob further causes one or more of:

the third tab to push against an inside edge of one of the first tab and the second tab; and lateral movement of the aperture mechanism with the third tab.

16. The sighting system of claim 1, wherein the rear sight comprises a second base and a second flip-up portion, the second flip-up portion further comprising:

two rear arms;

a third opening positioned between the two rear arms; and an aperture mechanism, wherein the aperture mechanism comprises a first end having a first rear aperture and a second end having a second rear aperture, wherein the first rear aperture is of a different size than the second rear aperture, and wherein a first vertical axis passes through a center of the first aperture and a second vertical axis passes through a center of the second aperture, and wherein the first vertical axis is different from the second vertical axis.

17. A flip-up aiming sight for use with a firearm, the flip-up aiming sight positioned near a distal end of the firearm, the flip-up aiming sight comprising:

a base for attachment to the firearm;

a first arm and a second arm, the first arm and the second arm positioned on opposite sides of a longitudinal plane through the firearm;

a horizontal connector for connecting the first arm and the second arm, wherein the horizontal connector includes a first aperture, the first aperture having a plurality of angled faces;

a second aperture, the second aperture formed by the first arm, the second arm, and the horizontal connector;

a knob, the knob positioned within the second aperture, the knob comprising:

one or more notches on a first side of the knob;

a sight post, the sight post extending from a second side of the knob, and wherein at least a portion of the sight post extends through the first aperture;

wherein the second aperture comprises at least one detent and one or more protrusions, the at least one detent and one or more protrusions shaped and sized to interact with the one or more notches when the knob is rotated;

wherein the knob is configured to rotate about a first vertical axis, the rotation causing one or more of:

tilting of the knob based at least in part on the at least one detent interfacing with one of the one or more notches; and tilting of the sight post in a direction along a longitudinal axis through the firearm, wherein the tilting of the sight post forces the sight post to press against one or more angled faces of the first aperture.

18. The flip-up aiming sight of claim 17, wherein the first vertical axis passes through one or more of a center of the knob and a center of the sight post, and wherein a second vertical axis passes through a center of the first aperture, and wherein the first vertical axis and the second vertical axis tilt with respect to each other based at least in part on the tilting of the sight post, the tilting of the knob, or a combination thereof.

* * * * *